US006918748B2

(12) United States Patent
Miyazawa

(10) Patent No.: US 6,918,748 B2
(45) Date of Patent: Jul. 19, 2005

(54) TUBE PUMP

(75) Inventor: Osamu Miyazawa, Suwa (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 10/198,067

(22) Filed: Jul. 18, 2002

(65) Prior Publication Data

US 2003/0021710 A1 Jan. 30, 2003

(30) Foreign Application Priority Data

Jul. 18, 2001 (JP) ..... 2001-218794
Aug. 2, 2001 (JP) ..... 2001-235396
Aug. 30, 2001 (JP) ..... 2001-262056

(51) Int. Cl.[7] ..... F04B 35/04

(52) U.S. Cl. ..... 417/410.1; 417/412; 417/477.1; 417/477.3; 417/477.5; 417/477.9

(58) Field of Search ..... 417/410.1, 412, 417/477.1, 477.3, 477.5, 477.9

(56) References Cited

U.S. PATENT DOCUMENTS 1,703,361 A 2/1929 Pohl
3,397,646 A * 8/1968 Allsopp, Jr. ..... 417/411
4,544,336 A * 10/1985 Faeser et al. ..... 417/412
4,968,229 A * 11/1990 Neuder ..... 417/474
5,083,908 A * 1/1992 Gagnebin et al. ..... 417/477.1
6,102,678 A * 8/2000 Peclat ..... 417/477.7

FOREIGN PATENT DOCUMENTS

DE 3243784 5/1984
JP 06-286158 10/1994
JP 2001-115972 4/2001
WO WO 89/07200 8/1989
WO WO 97/41353 11/1997

OTHER PUBLICATIONS

European Search Report, dated Nov. 3, 2003.
Communication from Korean Patent Office regarding counterpart application.

* cited by examiner

*Primary Examiner*—Charles G. Freay
(74) *Attorney, Agent, or Firm*—Harness, Dickey & Pierce, P.L.C.

(57) ABSTRACT

A tube pump (1A) of the present invention is provided with a main body (2) to which a tube (100) is attached, a rotor (5), an oscillator (6) located so as to touch an outer circumferential face of the rotor (5), and a plurality of rollers (10) mounted to the rotor (5) for pressurizing and thereby squeezing the tube (100). The oscillator (6) is essentially shaped like a rectangular plate, and is formed by laminating an electrode, a piezoelectric element, and a reinforcing plate. When an alternating current voltage is applied to the piezoelectric element, the oscillator (6) oscillates longitudinally in the direction of the length at minute amplitude as the piezoelectric element expands and contracts. The rotor (5) receives a frictional force and a pressing force from a convex portion (66) when the oscillator (6) expands, and the rotor (5) rotates as it repetitively receives the frictional force and the pressing force. Consequently, it is possible to provide a tube pump having a simple structure, and hence, having an advantage in reducing the size, particularly the thickness thereof.

40 Claims, 32 Drawing Sheets

TUBE PUMP

TECHNICAL FIELD

The present invention relates to a tube pump.

BACKGROUND ART

A tube pump that feeds a fluid within an elastic tube by squeezing the tube has been known and used extensively in, for example, medical equipment, printers, etc.

The tube pump generally includes a rotor, a motor for rotationally driving the rotor, and a plurality of rollers mounted to the rotor. These rollers pressurize a tube placed along the outer circumference of the rotor at a portion thereof to be sealed as the rotor rotates, whereby a fluid is fed forward.

The conventional tube pump, however, includes a large rotor-driving motor, and therefore, has a problem that it is difficult to reduce the size, particularly the thickness thereof. Also, the conventional tube pump has a problem that electromagnetic noises of the motor may possibly affect other equipment.

In addition, the conventional tube pump has a problem that the tube repetitively pressurized at a portion thereof to be sealed by the rollers deteriorates fast and has a short lifespan.

Further, the conventional tube pump has a problem that a segment of the tube is kept pressed by the rollers while not in use, so that the segment will have a flattening habit or deforming habit. Once the tube has the flattening habit, it results in adverse effects as follows: deterioration takes place at the segment; a quantity of discharge from the tube pump becomes unstable; and a desired quantity of discharge cannot be obtained. Hence, the conventional tube pump has an inconvenience that, for example, it cannot be stored over a long period after it is manufactured.

SUMMARY OF THE INVENTION

The object of the present invention is to provide a tube pump having a simple structure, and hence, having an advantage in reducing the size, particularly the thickness thereof.

In order to achieve the above object, the present invention relates to a tube pump, characterized by including:

a main body having an attachment portion to which an elastic tube is attached;

a rotor mounted rotatably with respect to the main body;

a plurality of pressurizing portions, provided to the rotor, for pressurizing a segment of the tube;

a driven member for moving in association with the rotor; and at least one oscillator located so as to touch the driven member and having a piezoelectric element, wherein the oscillator oscillates when an alternating current voltage is applied to the piezoelectric element and drives the driven member by repetitively applying a force to the driven member by means of oscillations, thereby rotating the rotor.

According to this arrangement, it is possible to provide a tube pump having a simple structure, and hence, having an advantage in reducing the size, particularly the thickness thereof.

Also, it is preferable that the driven member is formed integrally with or fixed to the rotor.

According to this arrangement, not only can the size and the thickness be further reduced, but also the structure can be extremely simple.

Also, it is preferable that the oscillator is located so as to touch the driven member along a direction of a rotational axis of the rotor.

According to this arrangement, the size can be further reduced.

Also, it is preferable that the oscillator is located so as to touch the driven member along a radius direction of the rotor.

According to this arrangement, it is possible to drive the rotor to rotate more smoothly in a reliable manner.

Also, it is preferable that the oscillator is located so as to touch the driven member from an outer circumference side of the rotor.

According to this arrangement, it is possible to drive the rotor to rotate more smoothly in a reliable manner.

Also, it is preferable that the oscillator is located so as to touch the driven member from an inner circumference side of the rotor.

According to this arrangement, not only can the rotor be driven to rotate more smoothly in a reliable manner, but also the size can be further reduced.

Also, it is preferable that the driven member rotates the rotor through a rotational force transmission mechanism.

According to this arrangement, it is possible to heighten a degree of freedom as to where the oscillator is located.

Also, it is preferable that the rotational force transmission mechanism is a speed changing unit.

According to this arrangement, it is possible to adjust a fluid feeding speed by changing the rotational speed of the rotor.

Also, it is preferable that the oscillator is positioned, almost entirely, on an inside of an outermost radius of the rotor.

According to this arrangement, the size can be further reduced.

Also, it is preferable that the oscillator is positioned, almost entirely, within a space as thick as the rotor in a direction of a rotational axis of the rotor.

According to this arrangement, the thickness can be further reduced.

Also, it is preferable that the driven member is provided with a slot, and the oscillator touches an inner face of the slot.

According to this arrangement, it is possible to prevent the touching position of the oscillator with respect to the rotor from being shifted, thereby reducing losses of a driving force.

Also, it is preferable that the oscillator is of a shape having a longer direction and a shorter direction.

According to this arrangement, it is possible to drive the rotor at higher efficiency.

Also, it is preferable that a vicinity of an end portion of the oscillator in a direction of length touches the driven member.

According to this arrangement, it is possible to drive the rotor at higher efficiency.

Also, it is preferable that the oscillator is shaped like a plate.

According to this arrangement, it is possible to drive the rotor at higher efficiency.

Also, it is preferable that the oscillator is almost shaped like a rectangle.

According to this arrangement, it is possible to drive the rotor at higher efficiency.

Also, it is preferable that the oscillator is located in an orientation substantially in parallel with the rotor.

According to this arrangement, the thickness can be further reduced.

Also, it is preferable that the tube pump further includes an arm portion provided so as to protrude from the oscillator, and the oscillator is supported by the arm portion.

According to this arrangement, it is possible to drive the rotor at higher efficiency.

Also, it is preferable that more than one oscillator is provided.

According to this arrangement, the size of each oscillator can be further reduced.

Also, it is preferable that the pressurizing portions are provided immovably with respect to the rotor.

According to this arrangement, the structure can be further simplified.

Also, it is preferable that the pressurizing portions are provided rotatably with respect to the rotor.

According to this arrangement, it is possible to allow the rotor to rotate more smoothly, thereby making it possible to feed a fluid more smoothly.

Also, it is preferable that the pressurizing portions are rollers supported rotatably about their respective rotational axes in a direction substantially along a rotational axis of the rotor.

According to this arrangement, it is possible to allow the rotor to rotate more smoothly, thereby making it possible to feed a fluid more smoothly.

Also, it is preferable that the pressurizing portions are rollers supported rotatably about their respective rotational axes in a direction intersecting with a rotational axis of the rotor at nearly right angles.

According to this arrangement, it is possible to allow the rotor to rotate more smoothly, thereby making it possible to feed a fluid more smoothly.

Also, it is preferable that the pressurizing portions are balls rotatable in an arbitrary direction.

According to this arrangement, it is possible to allow the rotor to rotate more smoothly, thereby making it possible to feed a fluid more smoothly, while the structure can be further simplified.

Also, it is preferable that the pressurizing portions pressurize the tube at a portion thereof to be sealed along a radius direction of the rotor.

According to this arrangement, it is possible to allow the rotor to rotate more smoothly, thereby making it possible to feed a fluid more smoothly.

It is preferable that the pressurizing portions pressurize the tube at a portion thereof to be sealed along a direction of a rotational axis of the rotor.

According to this arrangement, the size can be further reduced.

Also, it is preferable that an arc portion of the tube attached to the attachment portion is positioned on an inside of an outermost radius of the rotor.

According to this arrangement, the size can be further reduced.

Also, it is preferable that the main body includes a touching portion for touching any of the pressurizing portions present at a position for not pressurizing the tube.

According to this arrangement, it is possible to allow the rotor to rotate more smoothly, thereby making it possible to feed a fluid more smoothly.

Also, it is preferable that the main body supports the rotor from one side.

According to this arrangement, the thickness can be further reduced.

Also, it is preferable that the tube pump further includes a flexible plate member provided in close proximity to the tube attached to the attachment portion, and the pressurizing portions pressurize the segment of the tube at a portion thereof to be sealed through the plate member.

According to this arrangement, the lifespan of the tube can be extended.

Also, it is preferable that the plate member is provided almost across the segment of the tube attached to the attachment portion pressurized at a portion thereof to be sealed by the pressurizing portions.

According to this arrangement, the lifespan of the tube can be further extended.

Also, it is preferable that the plate member is provided in a displaceable manner in a thickness direction thereof.

According to this arrangement, the lifespan of the tube can be extended.

Also, it is preferable that the plate member is provided so as not to be displaced in an in-plane direction thereof.

According to this arrangement, the lifespan of the tube can be extended.

Also, it is preferable that the plate member is provided in a detachable/attachable manner with respect to the main body.

According to this arrangement, it is possible to replace the plate member with a new one when it is deteriorated or damaged.

Also, it is preferable that the tube pump further includes displacement quantity regulating means for regulating the plate member so as not to be displaced over a certain limit.

According to this arrangement, the lifespan of the tube can be further extended.

Also, it is preferable that at least one of the plurality of pressurizing portions is allowed to move with respect to the rotor in a predetermined movable range.

According to this arrangement, it is possible to prevent the tube from having a flattening habit or being blocked due to adhesion of the inner wall while not in use in a reliable manner.

Also, it is preferable that the plurality of pressurizing portions are able to go into a state that none of the plurality of pressurizing portions is pressurizing the tube while the rotor is at rest, and when the rotor starts to rotate in this state, the movable pressurizing portion moves relatively with respect to the rotor within the movable range, so that, in a steady rotation state of the rotor, the plurality of pressurizing portions go into a state that the plurality of pressurizing portions are placed at positions where at least one of the plurality of pressurizing portions pressurizes the tube at a portion thereof to be sealed regardless of a rotational position of the rotor.

According to this arrangement, it is possible to prevent the tube from having a flattening habit or being blocked due to adhesion of the inner wall while not in use without performing any special manipulation or the like, thereby achieving enhanced convenience.

Also, it is preferable that the movable pressurizing portion is allowed to move in a circumferential direction of the rotor within at least a part of the movable range.

According to this arrangement, it is possible to attain the aforementioned advantages with a simple structure.

It is preferable that the plurality of pressurizing portions are placed along a circumferential direction of the rotor at nearly equiangular intervals in a steady rotation state of the rotor.

According to this arrangement, it is possible to feed a fluid more smoothly.

Also, it is preferable that the movable pressurizing portion is allowed to move along a slot or a window formed in the rotor.

According to this arrangement, it is possible to attain the aforementioned advantages with a simple structure.

Also, it is preferable that the pressurizing portions are convex portions protruding from the rotor.

According to this arrangement, it is possible to attain the aforementioned advantages with a simple structure.

Also, it is preferable that:

the pressurizing portions are rollers rotatable about their respective rotational axes in a direction intersecting with a rotational axis of the rotor at nearly right angles; and the movable roller is provided with a regulating member for regulating an orientation of the movable roller so that the rotational axis of the movable roller intersects with the rotational axis of the rotor at nearly right angles.

According to this arrangement, it is possible to allow the rotor to rotate more smoothly, thereby making it possible to feed a fluid more smoothly.

Also, it is preferable that:

the pressurizing portions are rollers rotatable about their respective rotational axes in a direction substantially along a rotational axis of the rotor;

the tube pump further includes, a pressure-applying rotor mounted coaxially with the rotor, and a pressing portion, provided to the rotor, for pressing the movable roller in a rotational direction of the rotor; and the movable roller is not supported by the rotor, and in a steady rotation state of the rotor, the movable roller rotates while touching the pressure-applying rotor and the pressing portion.

According to this arrangement, not only can an extremely smooth operation be achieved, but also there can be offered an advantage in further reducing the thickness.

BEST MODE FOR CARRYING OUT THE INVENTION

The following description will describe in detail a tube pump of the present invention based on preferred embodiments shown in the accompanying drawings.

(First Embodiment)

Figure 1:
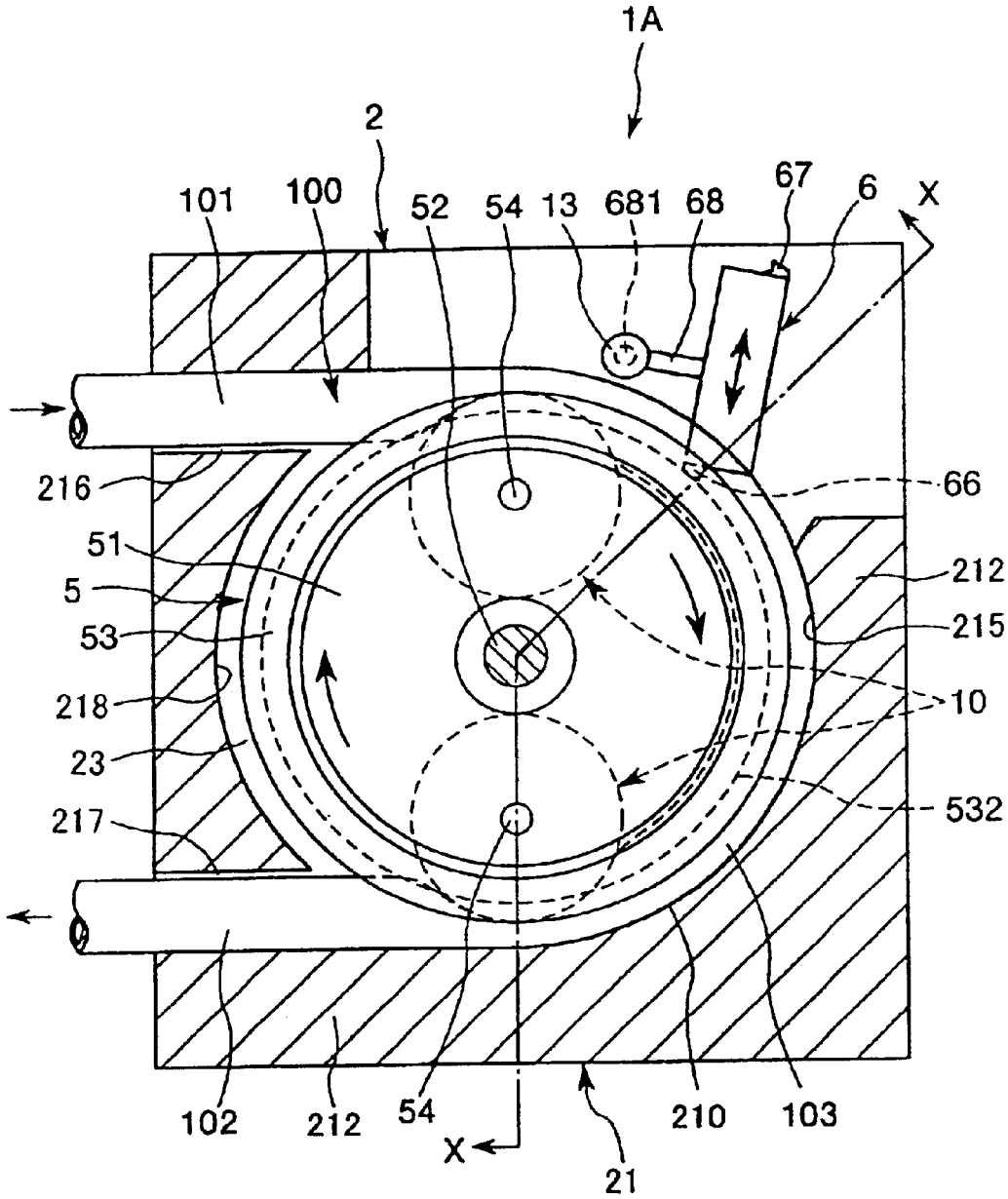
FIG. 1 is a cross-sectional plan view showing a first embodiment of a tube pump of the present invention.
Figure 2:
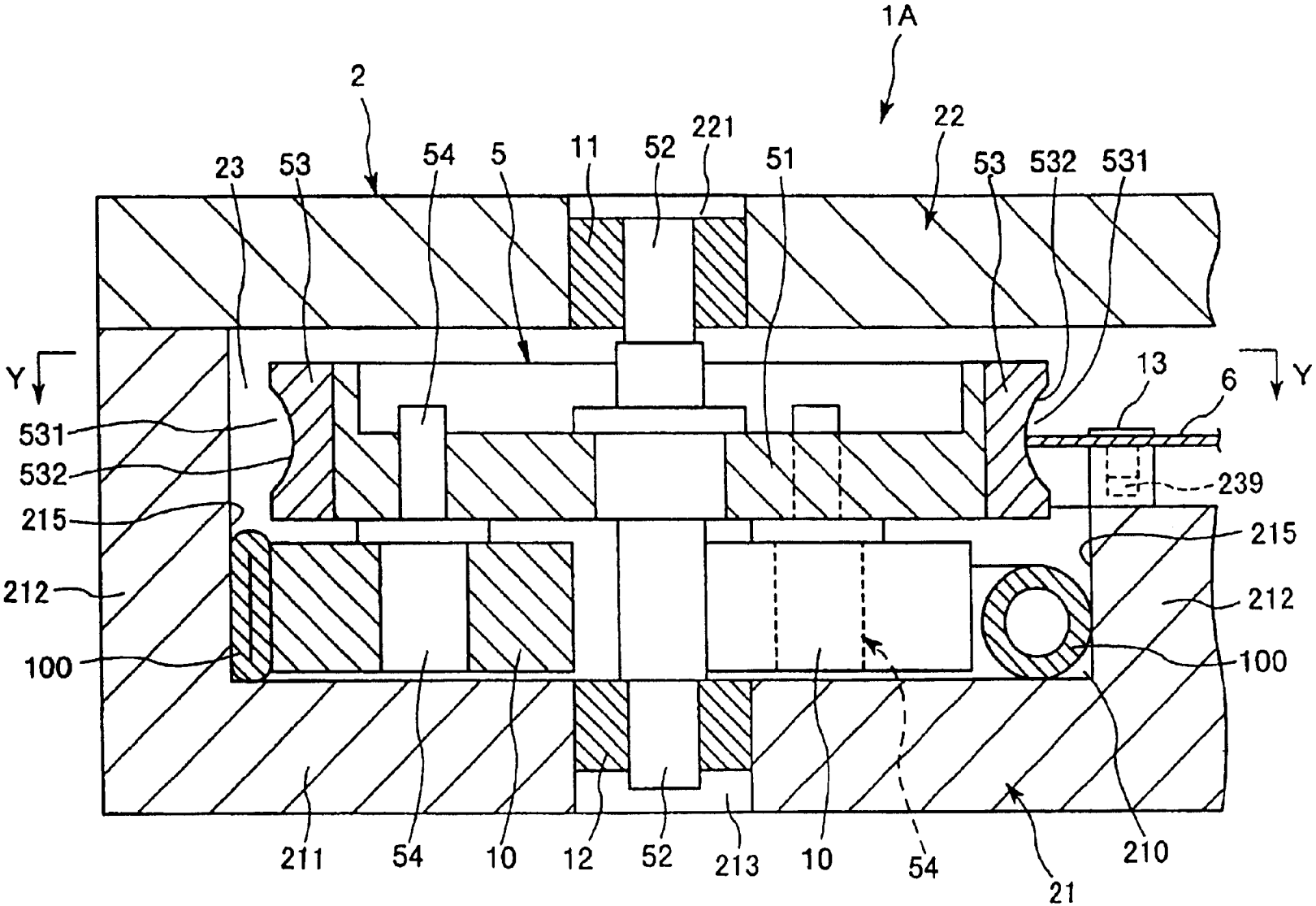
FIG. 2 is a cross-sectional side view showing the first embodiment of the tube pump of the present invention.
Figure 3:
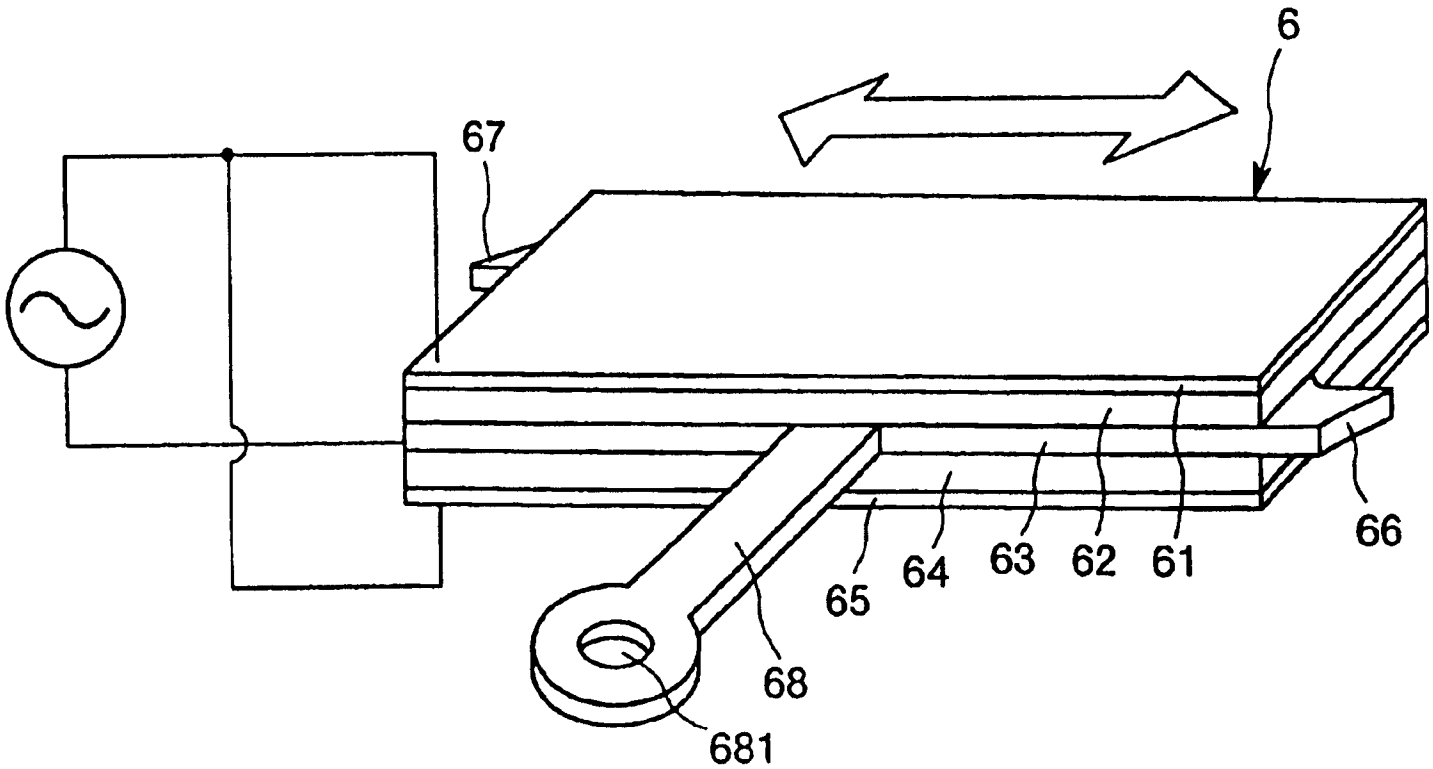
FIG. 3 is a perspective view showing an oscillator in the tube pump shown in FIGS. 1 and 2.
Figure 4:
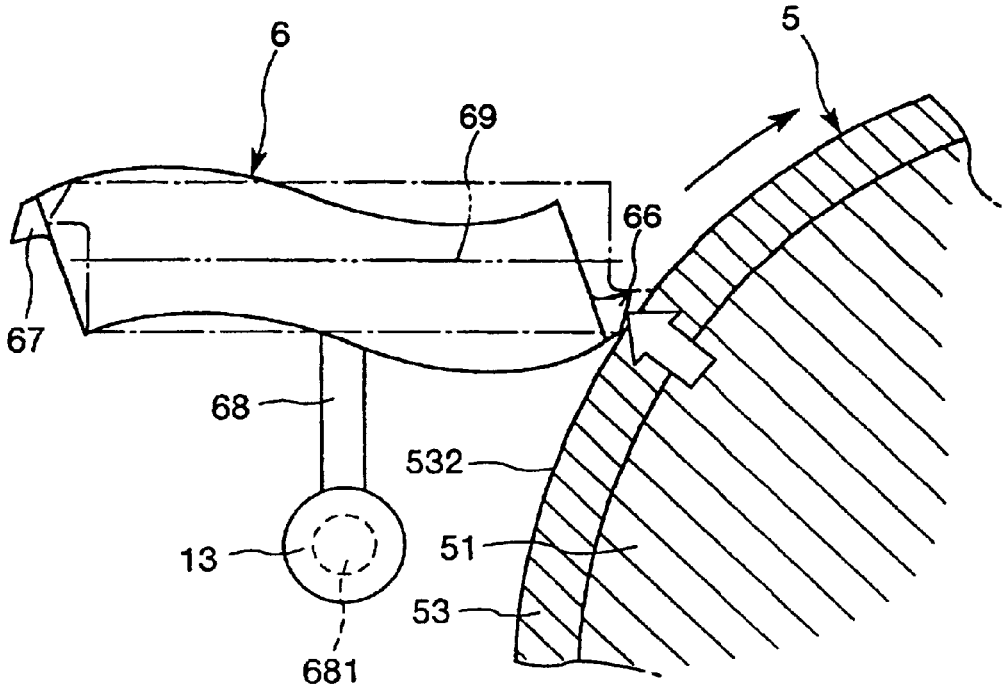
FIG. 4 is a plan view showing flex oscillations of the oscillator in the tube pump shown in FIGS. 1 and 2.
Figure 5:
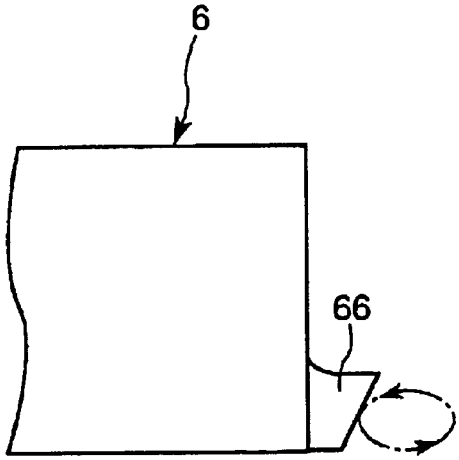
FIG. 5 is a plan view showing elliptical motion of a convex portion of the oscillator in the tube pump shown in FIGS. 1 and 2.

FIGS. 1 and 2 are respectively a cross-sectional plan view and a cross-sectional side view showing a first embodiment of the tube pump of the present invention. FIG. 3 is a perspective view showing an oscillator in the tube pump shown in FIGS. 1 and 2. FIG. 4 is a plan view showing flex oscillations of the oscillator in the tube pump shown in FIGS. 1 and 2. FIG. 5 is a plan view showing elliptical motion of a convex portion of the oscillator in the tube pump shown in FIGS. 1 and 2. FIG. 1 is a cross section taken along the line Y—Y of FIG. 2 and FIG. 2 is a cross section taken along the line X—X of FIG. 1. In the following description, the upper side and the lower side of FIG. 2 are assumed to be "top" and "bottom", respectively.

A tube pump 1A shown in FIGS. 1 and 2 is provided with a main body 2 having an attachment portion 210 to which an elastic tube 100 is attached, a rotor 5 mounted rotatably with respect to the main body 2, an oscillator 6 for rotationally driving the rotor 5, and a plurality of rollers 10 mounted to the rotor 5. The following description will describe an arrangement of each component.

As shown in FIG. 2, the main body 2 is composed of a base 21 and a cover 22 covering the upper side of the base 21. A space 23 for accommodating the rotor 5 and the tube 100 is defined in the interior of the main body 2. In the present embodiment, the base 21 and the cover 22 together form an enclosure.

The base 21 includes a bottom plate 211 and a wall portion 212 erected upward from the bottom plate 211. The bottom plate 211 is provided with an axial hole 213 into which a rotor rotational axis 52 described below is inserted.

The cover 22 is essentially shaped like a plate and is fixed to the upper side of the base 21. The cover 22 is provided with an axial hole 221 into which the rotor rotational axis 52 is inserted. The space 23 is defined by being surrounded with the bottom plate 211, the wall portion 212, and the cover 22.

As shown in FIG. 1, at least a part of the inner face of the wall portion 212 is formed arc-wise. In other words, an inner circumferential face 215 of the wall portion 212 in the right half of FIG. 1 is curved arc-wise.

The wall portion 212 in the left side of FIG. 1 is provided with slots 216 and 217, each of which communicates with the outside of the main body 2 from the space 23. The slot 216 is positioned at the upper side of FIG. 1 and the slot 217 is positioned at the lower side of FIG. 1.

In the present embodiment, an inner circumferential face 218 of the wall portion 212 between the slot 216 and the slot 217 is also formed arc-wise. However, the inner circumferential face 218 does not have to be formed arc-wise, and for example, it may be formed linearly.

The tube 100 is attached to the main body 2 arranged as above along the slot 216, the inner circumferential face 215, and the slot 217 essentially in the shape of a letter U. In other words, the tube 100 includes an arc portion 103 placed along the inner circumferential face 215, an upstream portion 101 extending to the outside of the main body 2 from one end of the arc portion 103 via the slot 216, and a downstream portion 102 extending to the outside of the main body 2 from the other end of the arc portion 103 via the slot 217.

As has been described, the attachment portion 210 for the tube 100 includes the inner circumferential face 215 and the slots 216 and 217.

The tube 100 has elasticity, that is, flexibility and restorability. Hence, when pressed by the rollers 10 described below, the tube 100 goes into a blocked state (the state shown in the left side of FIG. 2), and when the pressing is removed, the tube 100 restores to the original state (the state shown in the right side of FIG. 2).

The rotor 5 is mounted in the space 23 of the main body 2 concentrically with the inner circumferential face 215. The rotor 5 includes a rotor main body 51, the rotor rotational axis 52 installed so as to extend vertically from the central portion of the rotor main body 51, and an annular ring 53 fixed to the outer circumferential portion of the rotor main body 51 by press-fit, for example.

The rotor main body 51 is essentially shaped like a disc. The major diameter of the rotor 5 is less than the minor diameter of the inner circumferential face 215, that is, twice the radius of curvature of the inner circumferential face 215, thereby leaving a clearance between the outer circumference of the rotor 5 and the inner circumferential face 215.

As shown in FIG. 2, the top end portion of the rotor rotational axis 52 is inserted into the axial hole 221 and supported rotatably with respect to the cover 22 through a bearing 11. Also, the bottom end portion of the rotor rotational axis 52 is inserted into the axial hole 213 and supported rotatably with respect to the base 21 through a bearing 12. In short, the rotor 5 is mounted rotatably with respect to the main body 2.

The oscillator 6, which will be described below, touches the outer circumferential face of the rotor 5, that is, the outer circumferential face of the ring 53, so that when the oscillator 6 oscillates, the ring 53 repetitively receives a frictional force and a pressing force from the oscillator 6, thereby being driven to rotate in a clockwise direction of FIG. 1. In short, the ring 53 serves as a driven member driven by the oscillator 6.

Also, as shown in FIG. 2, in the present embodiment, a slot 531 is formed at the outer circumference of the ring 53 along the circumferential direction, and the oscillator 6 touches an inner face 532 of the slot 531. This arrangement makes it possible to prevent the touching position of the oscillator 6 from being shifted vertically with respect to the ring 53. Also, because the cross section of the inner face 532 is formed arc-wise, even if the touching position of the oscillator 6 with respect to the ring 53 slightly shifts vertically, the oscillator 6 and the ring 53 maintain their touching state, thereby losing no driving force.

Two roller rotational axes 54 are installed so as to protrude downward from the rotor main body 51. In short, the roller rotational axes 54 are installed in parallel with the rotor rotational axis 52.

The rollers 10, which block the tube 100 by pressing, that is, serve as pressurizing portions for pressurizing the tube 100, are mounted on the respective roller rotational axes 54 through unillustrated bearings. The rollers 10 are positioned at the lower side of the rotor main body 51, and mounted rotatably about their respective roller rotational axes 54, that is, allowed to rotate on their axes. Also, the rollers 10 rotate, namely, revolve about the rotor rotational axis 52 as the rotor 5 rotates.

The rollers 10 are formed essentially cylindrically. The rollers 10 are positioned on the inside of the tube 100 placed in the shape of a letter U, and positioned nearly as high as the tube 100 in the vertical direction.

Also, in the present embodiment, when viewed in a plane shown in FIG. 1, the rollers 10 are mounted at a positional relation so that they are essentially inscribed in the rotor main body 51 at the outermost edge thereof. In other words, when viewed in a plane shown in FIG. 1, the rollers 10 are mounted at positions so that they do not extend outside of the rotor 5.

As shown in FIG. 1, in the present embodiment, the two rollers 10 are mounted along the circumferential direction of the rotor 5 at equiangular intervals, that is, at intervals of 180°. In the present invention, three or more pressurizing portions like the rollers 10 may be mounted to the rotor 5. In this case, it is preferable that the pressurizing portions like the rollers 10 are also mounted along the circumferential direction of the rotor 5 at equiangular intervals.

When the rotor 5 rotates in a clockwise direction of FIG. 1, at least one of the two rollers 10 squeezes the arc portion 103 of the tube 100 along the rotational direction of the rotor 5 while pressurizing the arc portion 103 with the inner circumferential face 215, whereby a fluid within the tube 100 is fed forward. Consequently, the fluid is taken in from the upstream portion 101 of the tube 100 and discharged from the downstream portion 102 of the tube 100.

As has been described, in the present embodiment, the rollers 10 press the tube 100 from the inner circumference side to the outer circumference side in the radius direction of the rotor 5. Consequently, the direction of a reactive force that the rotor 5 receives from the arc portion 103 of the tube 100 becomes nearly perpendicular to the rotor rotational axis 52, which prevents the rotor 5 from tilting, thereby allowing the rotor 5 to rotate more smoothly in a reliable manner.

Also, in the present embodiment, because the rollers 10 squeeze the tube 100 while they are rotating on their axes, they do not pull the tube 100 in the direction of revolution, which prevents the tube 100 from being shifted with respect to the main body 2.

As shown in FIGS. 1 and 2, the base 21 of the main body 2 is provided with the oscillator 6 for rotationally driving the rotor 5. The oscillator 6 is small and thin in comparison with a typical motor or the like. According to the present invention, by using the oscillator 6 in rotationally driving the rotor 5, it is possible to reduce the size, particularly the thickness of the entire tube pump 1A. An explanation of the oscillator 6 will be given in the following.

As shown in FIG. 3, the oscillator 6 is essentially shaped like a rectangular plate. The oscillator 6 is composed of a plate electrode 61, a plate piezoelectric element 62, a reinforcing plate 63, a plate piezoelectric element 64, and a plate electrode 65, which are laminated sequentially in this order from the upper side of FIG. 3. The thickness direction is emphasized in the illustration of FIG. 3.

Each of the piezoelectric elements 62 and 64 is shaped like a rectangle and expands and contracts in the length direction when a voltage is applied. A forming material of the piezoelectric elements 62 and 64 is not especially limited, and lead zirconate titanate (PZT), crystal, lithium niobate, barium titanate, lead titanate, lead meta-niobate, polyvinylidene fluoride, lead zinc niobate, lead scandium niobate, etc. are available.

The piezoelectric elements 62 and 64 are fixed to both faces of the reinforcing plate 63, respectively. The reinforcing plate 63 is furnished with a function of reinforcing the entire oscillator 6, and therefore, prevents the oscillator 6 from being damaged by an excessively large amplitude, an external force, etc. A forming material of the reinforcing plate 63 is not especially limited, but metal materials of various kinds including, for example, stainless steel, aluminum, aluminum alloy, titanium, titanium alloy, copper, copper-based alloy, etc. are preferable.

The reinforcing plate 63 is preferably thinner than the piezoelectric elements 62 and 64. According to this arrangement, it is possible to allow the oscillator 6 to oscillate at high efficiency.

The reinforcing plate 63 is also furnished with a function as a common electrode for the piezoelectric elements 62 and 64. To be more specific, an alternating current voltage is applied to the piezoelectric element 62 by the electrode 61 and the reinforcing plate 63, and an alternating current voltage is applied to the piezoelectric element 64 by the electrode 65 and the reinforcing plate 63.

The piezoelectric elements 62 and 64 repetitively expand and contract in the length direction when an alternating current voltage is applied, and in association with such expansion and contraction, the reinforcing plate 63 repetitively expands and contracts in the length direction. In other words, when an alternating current voltage is applied to the piezoelectric elements 62 and 64, the oscillator 6 oscillates in the length direction at a minute amplitude, that is, it oscillates longitudinally, as indicated by an arrow of FIG. 3.

A convex portion 66 (e.g., a projection in the form of a tab) is formed integrally with the reinforcing plate 63 at the right end portion of FIG. 3. As shown in FIGS. 1 and 2, the oscillator 6 is located so that the convex portion 66 touches the ring 53 of the rotor 5.

The convex portion 66 is provided at a position shifted from a center line 69 at the center of the reinforcing plate 63 in the width direction, and is positioned at one corner portion according to the arrangement shown in the drawing. Also, according to the arrangement shown in the drawing, a similar convex portion 67 is provided symmetrically with the convex portion 66 in the corner portion at the opposite angle on the diagonal line. The convex portion 67 is not used according to the arrangement shown in FIG. 3.

Also, an arm portion 68 is provided so as to protrude in a direction nearly perpendicular to the length direction essentially from the center of the reinforcing plate 63. The arm portion 68 is provided with a hole 681 at its tip end portion, into which a bolt 13 (see FIGS. 1 and 2) is inserted.

As shown in FIGS. 1 and 2, the oscillator 6 arranged as above is located so as to touch the ring 53 of the rotor 5 from the outer circumference side in the radius direction.

Also, the oscillator 6 is located in an orientation substantially in parallel with the rotor 5. This arrangement is advantageous particularly in reducing the thickness of the entire tube pump 1A.

In addition, in the present embodiment, the thickness of the oscillator 6 is less than the thickness of the rotor 5, and the entire oscillator 6 is positioned within a space as thick as the rotor 5 in the vertical direction. This arrangement is advantageous particularly in reducing the thickness of the entire tube pump 1A.

The oscillator 6 is secured to a screw hole 239 made in the base 21 with the bolt 13 in close proximity to the hole 681 of the arm portion 68. In short, the oscillator 6 is supported by the arm portion 68. This arrangement allows the oscillator 6 to oscillate freely and to oscillate at a relatively large amplitude. Also, the oscillator 6 is located in a state that the convex portion 66 is pressure-contacted to the inner face 532 of the ring 53 due to the elasticity of the arm portion 68.

By allowing the oscillator 6 to oscillate by applying an alternating current voltage to the piezoelectric elements 62 and 64 in the state that the convex portion 66 touches the ring 53, the ring 53 receives a frictional force and a pressing force from the convex portion 66 when the oscillator 6 expands, and the rotor 5 rotates in a clockwise direction of FIG. 1 as it repetitively receives the frictional force and the pressing force.

As has been described above, in the present embodiment, the ring 53 serving as the driven member is fixed to the rotor main body 51 by press-fit, for example, so that the rotor 5 is rotationally driven directly by the oscillator 6. Consequently, the rotor 5 serves as both a rotor for the tube pump 1A and a rotor for an ultrasonic wave motor, which makes the tube pump 1A advantageous particularly in reducing the size and the thickness. Also, because the structure can be extremely simple, it is possible to save manufacturing costs.

Incidentally, the ring 53 may be formed integrally with the rotor main body 51 from a single member.

Also, in the present embodiment, because in-plane oscillations of the oscillator 6 are directly converted into rotations of the rotor 5, energy loss incident to this conversion is so small that it is possible to rotationally drive the rotor 5 at high efficiency.

Also, in the present embodiment, the direction of the frictional force and the pressing force conferred to the ring 53 from the convex portion 66 is nearly perpendicular to the rotor rotational axis 52, which prevents the rotor 5 from tilting, thereby allowing the rotor 5 to rotate more smoothly in a reliable manner.

In addition, different from the case of a typical motor using a magnetic force for driving, the oscillator 6 drives the ring 53 with the aforementioned frictional force and the pressing force, thereby yielding a high driving force. Hence, it is possible to rotate the rotor 5 with sufficient torque without disposing a speed reducing mechanism as described in the present embodiment.

The frequency of an alternating current voltage applied to the piezoelectric elements 62 and 64 is not especially limited, but preferably, it is nearly as high as the resonance frequency of the longitudinal oscillations of the oscillator 6. According to this arrangement, the amplitude of the oscillator 6 becomes larger, which makes it possible to rotationally drive the rotor 5 at a higher efficiency.

As has been described above, the oscillator 6 chiefly oscillates longitudinally in the length direction; however, it is more preferable to allow the convex portion 66 to oscillate elliptically by resonating longitudinal oscillations and flex oscillations. This arrangement makes it possible to rotationally drive the rotor 5 at higher efficiency. The following description will describe this point.

As shown in FIG. 4, when the oscillator 6 rotationally drives the rotor 5, the convex portion 66 receives a reactive force from the rotor 5 as indicated by an arrow of FIG. 4. In the present embodiment, because the convex portion 66 is provided at a position shifted from the center line 69 of the oscillator 6, when the oscillator 6 oscillates, it is deformed by the reactive force to bend in the in-plane direction as shown in FIG. 4. Deformation of the oscillator 6 is emphasized in the illustration of FIG. 4.

By selecting the frequency of an applied voltage, the shape and size of the oscillator 6, and the position of the convex portion 66 as needed, it is possible to set the frequency of the flex oscillations nearly as high as the frequency of the longitudinal oscillations. When arranged in this manner, the longitudinal oscillations and the flex oscillations of the oscillator 6 resonate, which not only makes the amplitude larger, but also allows the convex portion 66 to be displaced along an ellipse indicated by an alternate long and short dash line of FIG. 5. In short, the convex portion 66 moves elliptically.

As a result, during one cycle of the amplitude of the oscillator 6, the convex portion 66 is pressure-contacted to the ring 53 with a strong force when the convex portion 66 sends the ring 53 in the rotational direction, and when the convex portion 66 returns, the frictional force caused with the ring 53 is reduced or eliminated. Hence, the oscillations of the oscillator 6 can be converted into rotations of the rotor 5 at higher efficiency.

In the present invention, besides the advantage of being able to reduce the size and the thickness, there is another advantage that the peripheral equipment remains unaffected, because a typical motor is not used to rotate the rotor 5 and electromagnetic noises caused by the typical motor are none at all or minimal, if any.

Also, when the rotor 5 is not driven rotationally, that is, when the rotor 5 is at rest, the frictional force between the convex portion 66 and the ring 53 prevents the rotor 5 from rotating. In other words, the retention torque of the rotor 5 when the rotor 5 is at rest is high. Consequently, the rotor 5 will not rotate accidentally in the reverse direction by a pressure of a fluid within the tube 100 or the like, thereby making it possible to prevent backflow of the fluid within the tube 100.

Also, in the present embodiment, as shown in FIG. 2, there is no component that needs to be assembled from the lower side of the base 21 at the time of fabrication, and the components are assembled in one direction, that is, only from the upper side of FIG. 2, in fabricating the tube pump, which offers another advantage of making the fabrication easier.

In the present embodiment, one oscillator 6 is provided; however, in the present invention, more than one oscillator 6 may be provided.

(Second Embodiment)

Figure 6:
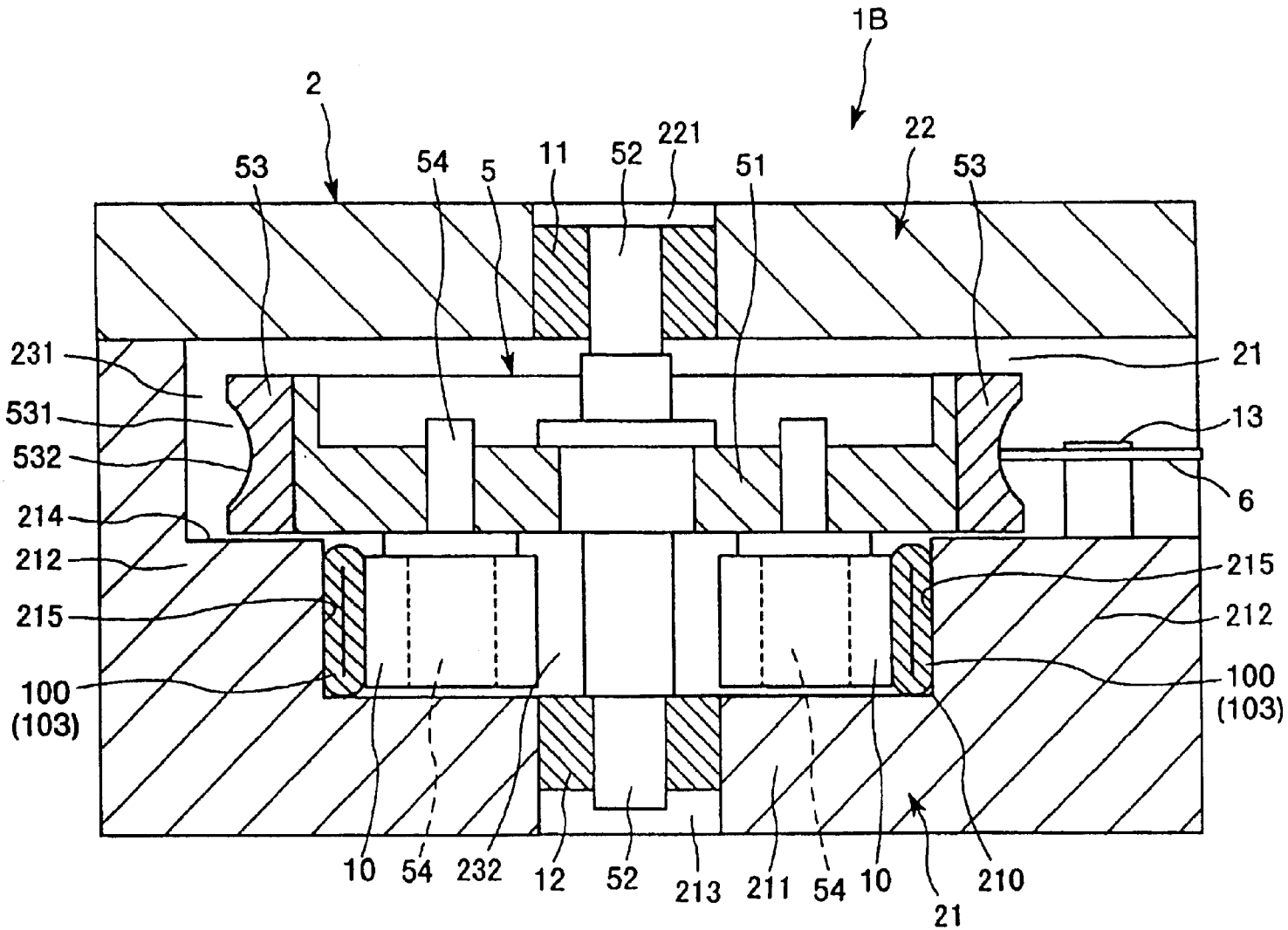
FIG. 6 is a cross-sectional side view showing a second embodiment of the tube pump of the present invention.

FIG. 6 is a cross-sectional side view showing a second embodiment of the tube pump of the present invention. In the following description, the upper side and the lower side of FIG. 6 are assumed to be "top" and "bottom", respectively.

The following description will describe the second embodiment of the tube pump of the present invention with reference to this drawing; however, the following description will chiefly describe a difference from the first embodiment above and the description as to the similar arrangements is omitted.

Compared with the tube pump 1A of the first embodiment above, in a tube pump 1B of the present embodiment, the rollers 10 are made smaller in diameter and are moved to the inner circumference side of the rotor 5.

Accordingly, the shape of the base 21 is changed by reducing the radius of curvature of the inner circumferential face 215. To be more specific, a step 214 is formed in the wall portion 212, and a bottom portion 232 in the space 23 for accommodating the tube 100 and the rollers 10 is made smaller in diameter than a top portion 231 of the space 23 for accommodating the rotor 5.

The arc portion 103 of the tube 100 attached to the base 21 arranged as above is positioned on the inside of the outermost radius of the rotor 5.

According to the above arrangement, in the present embodiment, the pressurizing portions like the rollers 10 are mounted at the inner circumference side of the rotor 5 as compared to the tube pump 1A of the first embodiment above, which makes it possible to reduce the torque required to rotate the rotor 5 in comparison with the tube pump 1A. Consequently, according to the tube pump 1B of the present embodiment, the size of the oscillator 6 can be reduced in comparison with the first embodiment above, and hence, the size of the entire tube pump 1B can be further reduced.

In the present embodiment, one oscillator 6 is provided; however, in the present invention, more than one oscillator 6 may be provided.

(Third Embodiment)

Figure 7:
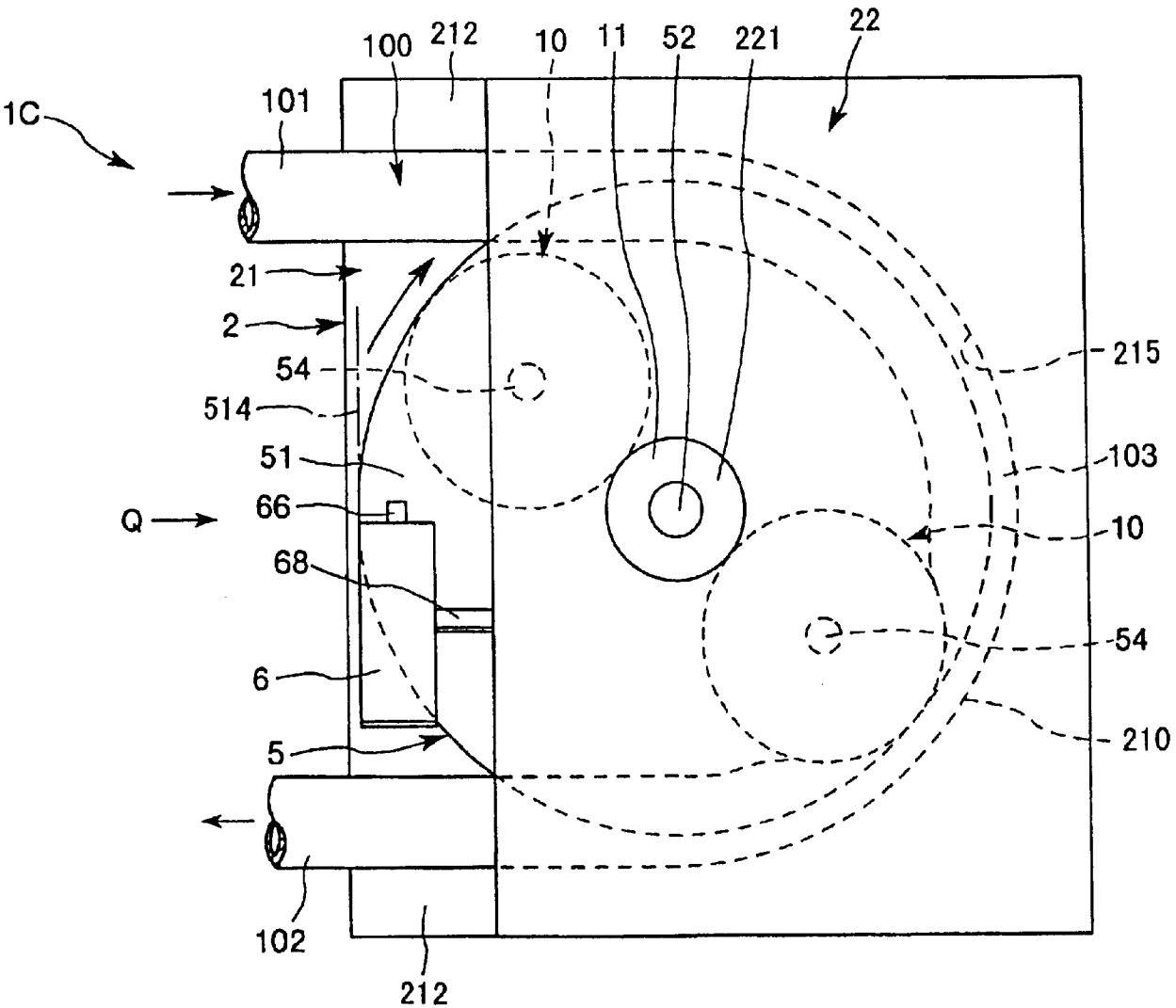
FIG. 7 is a plan view showing a third embodiment of the tube pump of the present invention.
Figure 8:
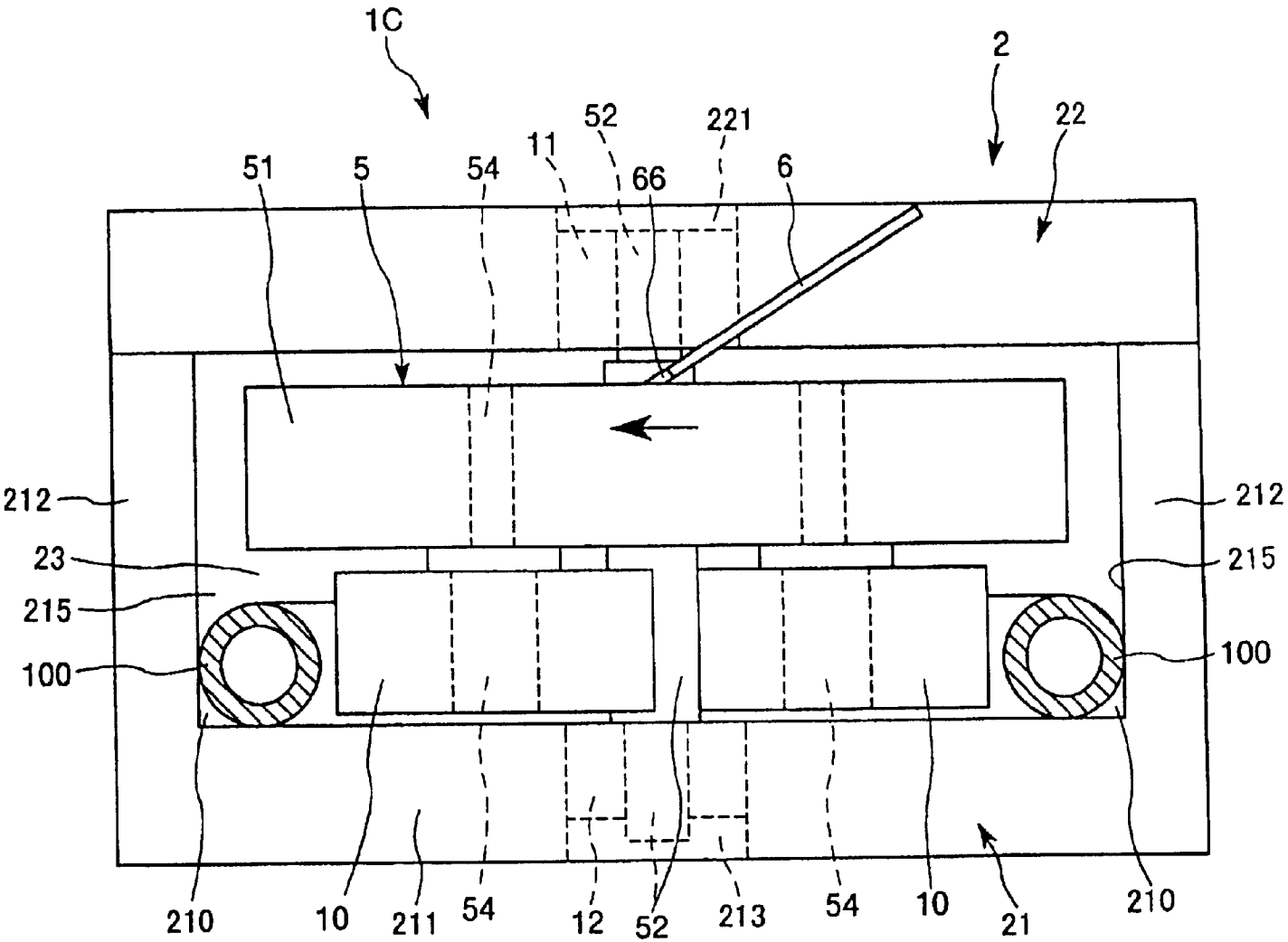
FIG. 8 is a view showing a plane indicated by an arrow Q of FIG. 7.

FIG. 7 is a plan view showing a third embodiment of the tube pump of the present invention. FIG. 8 is a side view showing the tube pump shown in FIG. 7. In the following description, the upper side and the lower side of FIG. 8 are assumed to be "top" and "bottom", respectively.

The following description will describe the third embodiment of the tube pump of the present invention with reference to these drawings; however, the following description will chiefly describe a difference from the first embodiment above and the description as to the similar arrangements is omitted.

In a tube pump 1C of the present embodiment, the oscillator 6 is located so as to touch the rotor main body 51 of the rotor 5 along the direction of the rotor rotational axis 52, and drives the rotor main body 51. In other words, in the present embodiment, the rotor main body 51 is the driven member, and the ring 53 is omitted from the rotor 5.

The arm portion 68 of the oscillator 6 is fixed to the cover 22 of the main body 2, and the convex portion 66 of the oscillator 6 touches the vicinity of the outer circumference on the top face of the rotor main body 51. Also, in the present embodiment, the convex portion 66 is provided at almost the center of the oscillator 6 in the width direction.

The oscillator 6, when viewed in a plane shown in FIG. 7, is located so that the length direction thereof is substantially in parallel with a tangential line 514 of the rotor main body 51. Also, as shown in FIG. 8, the oscillator 6 is located so as to tilt (e.g., be angled) with respect to the rotor main body 51. According to these arrangements, it is possible to convert oscillations of the oscillator 6 into rotations of the rotor 5 at a high efficiency.

As has been described, in the present embodiment, the oscillator 6 touches the rotor main body 51 of the rotor 5 along the direction of the rotor rotational axis 52, which makes it possible to superimpose the oscillator 6 and the rotor 5. This provides a further advantage in reducing the size of the entire tube pump 1C, particularly in reducing the occupied area in FIG. 7.

In the present embodiment, one oscillator 6 is provided; however, in the present invention, more than one oscillator 6 may be provided.

(Fourth Embodiment)

Figure 9:
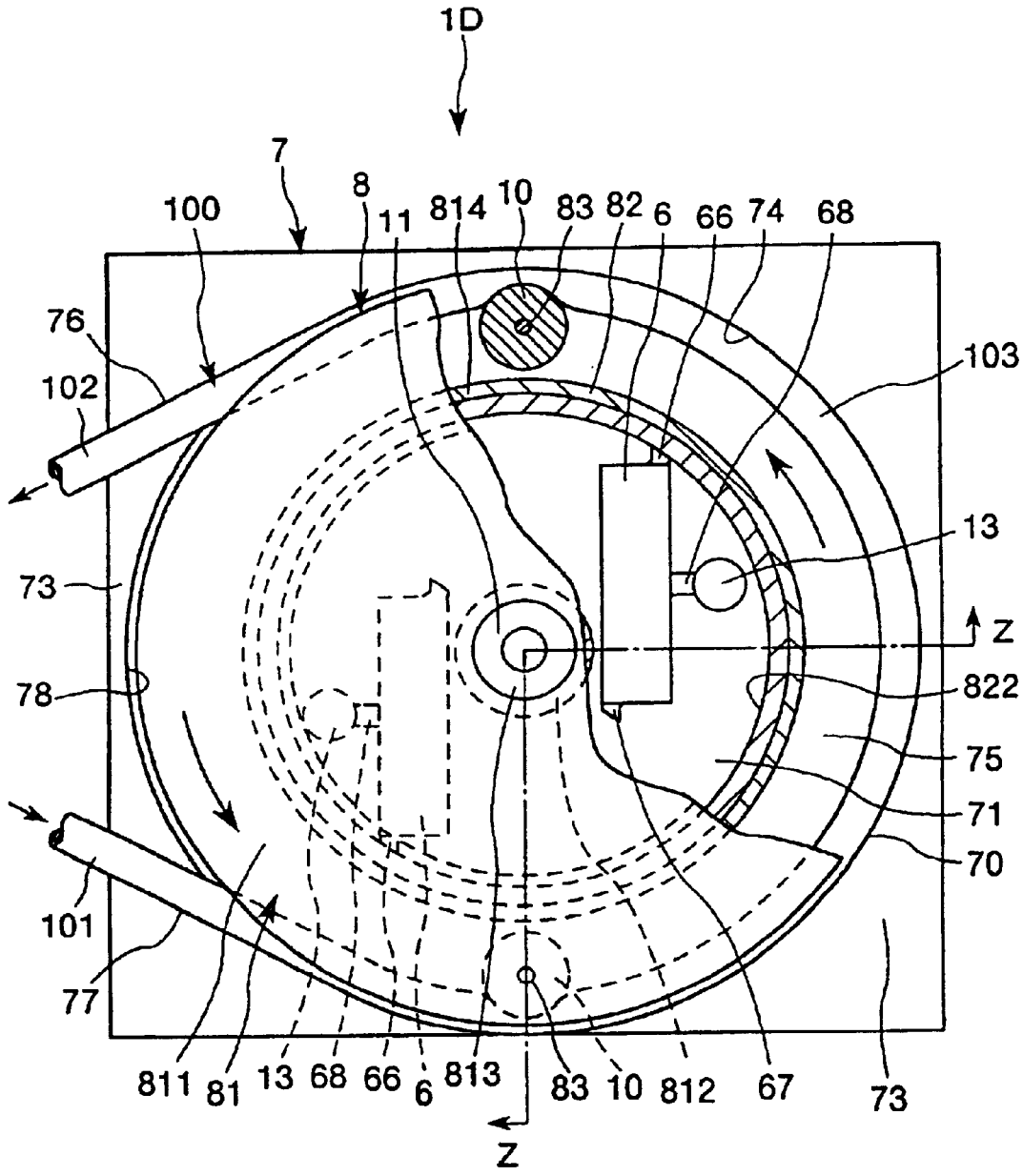
FIG. 9 is a partially cutaway plan view showing a fourth embodiment of the tube pump of the present invention.
Figure 10:
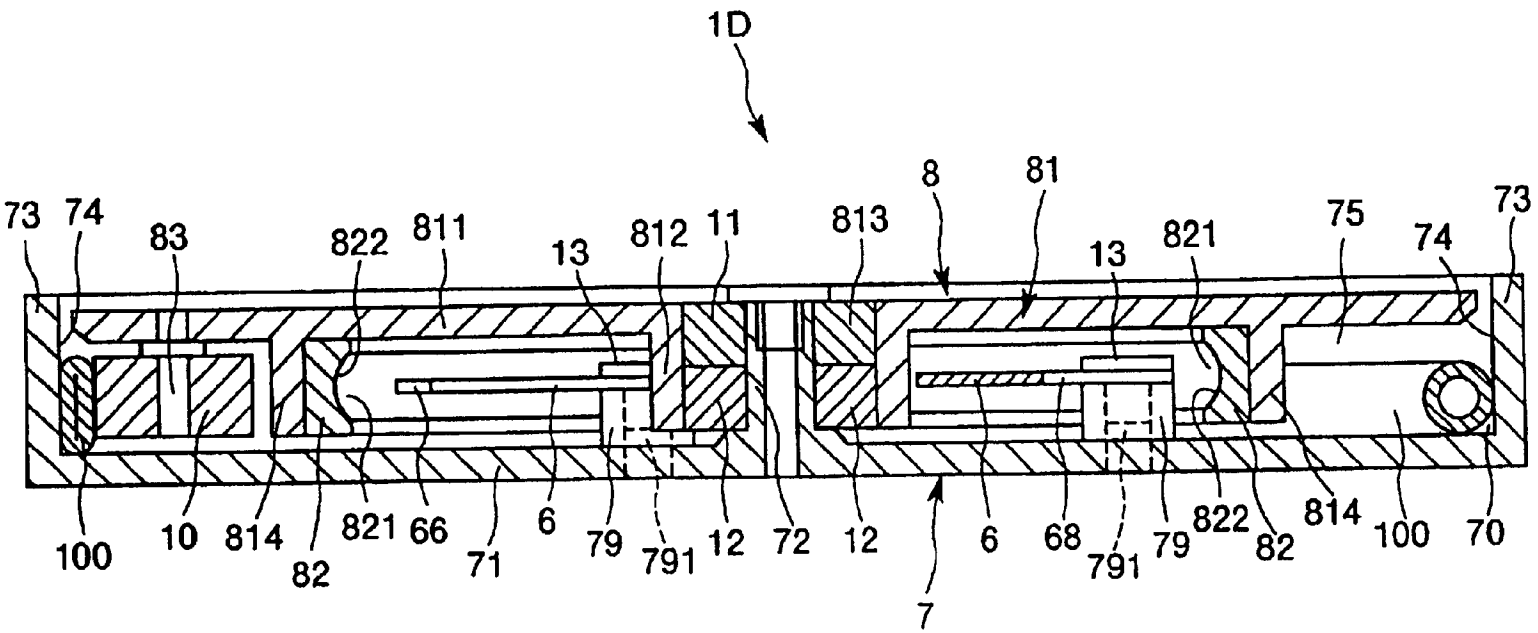
FIG. 10 is a cross-sectional side view taken along the plane of the line Z—Z of FIG. 9.

FIG. 9 is a partially cutaway plan view showing a fourth embodiment of the tube pump of the present invention. FIG. 10 is a cross-sectional side view taken along the plane of the line Z—Z of FIG. 9. In the following description, the upper side and the lower side of FIG. 10 are assumed to be "top" and "bottom", respectively.

The following description will describe the fourth embodiment of the tube pump of the present invention with reference to these drawings; however, the following description will chiefly describe a difference from the first embodiment above and the description as to the similar arrangements is omitted.

A tube pump 1D shown in FIGS. 9 and 10 is provided with a main body 7 having an attachment portion 70 to which an elastic tube 100 is attached, a rotor 8 mounted rotatably with respect to the main body 7, a plurality of oscillators 6 mounted to the main body 7, and a plurality of rollers 10 mounted to the rotor 8.

As shown in FIG. 10, the main body 7 includes a substrate 71, a rotor rotational axis 72 installed so as to protrude upward from the central portion of the substrate 71, and a wall portion 73 erected upward from the periphery of the substrate 71.

An inner circumferential face 74 of the wall portion 73 in approximately the right half of FIG. 9 is formed arc-wise about the rotor rotational axis 72. A space 75 defined essentially disc-wise by being surrounded with the substrate 71 and the wall portion 73 accommodates the rotor 8 described below.

The wall portion 73 in the left side of FIG. 9 is provided with slots 76 and 77, each of which communicates with the outside of the main body 7 from the space 75. The slot 76 is positioned at the upper side of FIG. 9 and the slot 77 is positioned at the lower side of FIG. 9. Also, the slots 76 and 77 are formed essentially in a dogleg shape (e.g., angled) so that they become closer to each other toward the left side of FIG. 9.

In the present embodiment, an inner circumferential face 78 of the wall portion 73 between the slot 76 and the slot 77 is also formed arc-wise. However, the inner circumferential face 78 does not have to be formed arc-wise, and for example, it may be formed linearly.

The tube 100 is attached to the main body 7 arranged as above along the slot 76, the inner circumferential face 74, and the slot 77 essentially in the shape of a letter C. In other words, the tube 100 includes an arc portion 103 placed along the inner circumferential face 74, a downstream portion 102 extending to the outside of the main body 7 from one end of the arc portion 103 via the slot 76, and an upstream portion 101 extending to the outside of the main body 7 from the other end of the arc portion 103 via the slot 77.

As has been described, the attachment portion 70 for the tube 100 is composed of the vicinity of the inner circumferential face 74 and the slots 76 and 77.

The rotor 8 includes a rotor main body 81 and an annular ring 82.

As shown in FIG. 10, the rotor main body 81 includes a base portion 811 shaped like a circular plate and having a hole 813 at the central portion, a bearing placement portion 812 protruding cylindrically downward from the edge portion of the hole 813, and a ring placement portion 814 protruding cylindrically (annularly) downward from the base portion 811 and concentrically with the bearing placement portion 812 at the outer circumference side thereof.

With the rotor main body 81 arranged as above, the rotor rotational axis 72 is inserted into the hole 813 on the inside of the bearing placement portion 812, so that the rotor main body 81 is mounted rotatably on the rotor rotational axis 72 of the main body 7 through bearings 11 and 12 both placed on the inside of the bearing placement portion 812.

As has been described, in the present embodiment, the main body 7 is not provided with any member equivalent to the aforementioned cover 22 and supports the rotor 8 from one side, that is, from the lower side of the drawing. In short, the main body 7 does not cover the rotor 8 from the upper side. This arrangement makes the tube pump 1D advantageous particularly in reducing the thickness.

Two roller rotational axes 83 are installed so as to protrude downward from the base portion 811 at the outer circumference side of the ring placement portion 812. In short, the roller rotational axes 83 are installed in parallel with the rotor rotational axis 72. The rollers 10 are mounted on the respective roller rotational axes 83 through unillustrated bearings. The two rollers 10 are mounted along the circumferential direction of the rotor 8 at equiangular intervals, that is, at intervals of 180°.

When the rotor 8 rotates in a counterclockwise direction of FIG. 9, one or two rollers 10 squeeze the arc portion 103 of the tube 100 along the rotational direction of the rotor 8 while pressurizing the arc portion 103 with the inner circumferential face 74, whereby a fluid within the tube 100 is fed forward. Consequently, the fluid is taken in from the upstream portion 101 of the tube 100 and discharged from the downstream portion 102 of the tube 100.

As shown in FIG. 10, in the present embodiment, essentially the entire rollers 10 are positioned in a space as thick as the rotor 8 in the vertical direction. This arrangement makes the tube pump 1D advantageous particularly in reducing the thickness.

The ring 82 serving as a driven member is fixed to the inner circumference of the ring placement portion 812 by press-fit, for example.

The oscillators 6 are mounted to the main body 7 at the inner circumference side of the ring 82. To be more specific, oscillator mount portions 79 each having a screw hole 791 are provided so as to protrude upward from the substrate 71, so that the oscillators 6 are secured to their respective oscillator mount portions 79 by the bolts 13 inserted into the holes 681 of the arm portions 68.

The oscillators 6 are located so as to touch the ring 82 from the inner circumference side in the radius direction, and drive the ring 82 of the rotor 8 to rotate in a counterclockwise direction of FIG. 9.

As has been described, in the present embodiment, the oscillators 6 are positioned at the inner circumference side of the ring 82. In other words, the entire oscillators 6 are positioned on the inside of the outermost radius of the rotor 8. This arrangement makes the tube pump ID further advantageous in reducing the size, particularly in reducing the occupied area in FIG. 9.

Also, a slot 821 is formed at the inner circumference of the ring 82 along the circumferential direction, and the convex portions 66 of the oscillators 6 touch an inner face 822 of the slot 821. This arrangement makes it possible to achieve the same advantage attained in the first embodiment above by providing the slot 531.

In the present embodiment, two oscillators 6 are provided, and these two oscillators 6 together drive the rotor 8. This arrangement lessens a driving force that one oscillator 6 has to produce, and therefore, makes it possible to reduce the size of each oscillator 6. Hence, they are suitable when mounted on the inside of the outermost radius of the rotor 8 as are in the present embodiment. Also, even when a plurality of the oscillators 6 are mounted at the outer circumference side of the rotor 8, the oscillators 6 contribute to a reduction of the size of the tube pump ID, particularly a reduction of the occupied area in FIG. 9.

Also, the two oscillators 6 are mounted along the circumferential direction of the rotor 8 at nearly equiangular intervals, that is, at intervals of 180°. According to this arrangement, forces perpendicular to the axial direction that act on the bearings 11 an 12 are set off, thereby making it possible to reduce the loading on the bearings 11 and 12.

In the present invention, three or more oscillators 6 may be provided. In this case, it is preferable that the oscillators 6 are mounted along the circumferential direction of the rotor 8 at nearly equiangular intervals.

(Fifth Embodiment)

Figure 11:
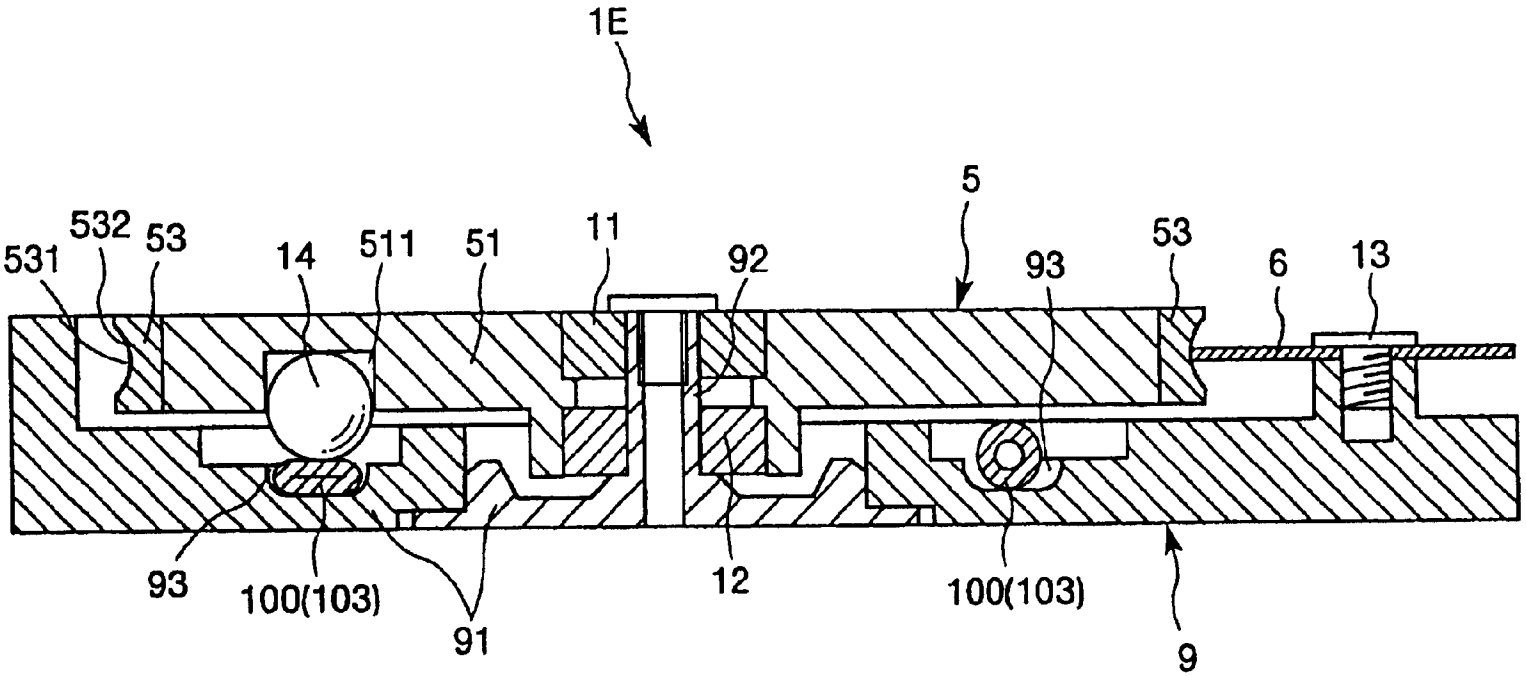
FIG. 11 is a cross-sectional side view showing a fifth embodiment of the tube pump of the present invention.

FIG. 11 is a cross-sectional side view showing a fifth embodiment of the tube pump of the present invention. In the following description, the upper side and the lower side of FIG. 11 are assumed to be "top" and "bottom", respectively.

The following description will describe the fifth embodiment of the tube pump of the present invention with reference to this drawing; however, the following description will chiefly describe a difference from the first embodiment above and the description as to the similar arrangements is omitted.

A tube pump 1E of the present embodiment is provided with a main body 9 having a tube attachment slot 93 serving as an attachment portion to which an elastic tube 100 is attached, a rotor 5 mounted rotatably with respect to the main body 9, an oscillator 6 mounted to the main body 9 so as to touch the rotor 5 from the outer circumference side, and balls 14 serving as a plurality of pressurizing portions provided to the rotor 5. The main body 9 includes a substrate 91 and a rotor rotational axis 92 installed so as to protrude upward from the central portion of the substrate 91. The rotor 5 includes a rotor main body 51 and a ring 53 fixed to the outer circumferential portion of the rotor main body 51 by press-fit, for example.

As with the fourth embodiment above, the main body 9 supports the rotor 5 from one side, which makes the tube pump 1E advantageous particularly in reducing the thickness.

The substrate 91 is provided with the tube attachment slot 93 on the top face along the circumferential direction of the rotor 5 at the inner circumference side of the outermost radius of the rotor 5. In other words, the tube attachment slot 93 is provided so as to form an arc when viewed in an unillustrated plane. A segment of the tube 100 is attached so that it is inserted into the tube attachment slot 93, and the segment positioned within the tube attachment slot 93 forms the arc portion 103.

The rotor main body 51 is provided with the balls 14 for pressurizing the arc portion 103 of the tube 100 from the upper side. Each ball 14 is provided so that the upper side thereof is fit into a concave portion 511 formed at the bottom face of the rotor main body 51, and is allowed to rotate in an arbitrary direction with respect to the rotor main body 51.

In the present embodiment, because the contact area between the balls 14 and the tube 100 is smaller than the case using the rollers 10, the rotational resistance of the balls 14 is small, which makes it possible to reduce the torque required to drive the rotor 5. Also, because the pressurizing portions are composed of the balls 14, they are not retained in any particular direction, and therefore, only the balls 14 have to be accommodated or fit into the concave portions 511, which obviates the roller rotational axes, thereby making it possible to make the structure further simplified and smaller.

Further, as with the second embodiment above, because the arc portion 103 of the tube 100 is positioned on the inside of the outermost radius of the rotor 5, the torque required to rotate the rotor 5 is relatively small. Hence, in the present embodiment, the oscillator 6 can be further reduced in size, which makes it possible to further reduce the size of the entire tube pump 1E.

Also, in the present embodiment, by pressurizing the tube 100 along the direction of the rotor rotational axis 92, the tube 100 and the rotor 5 can be superimposed in the thickness direction of the rotor 5, that is, in the direction of the rotor rotational axis 92. This arrangement is advantageous particularly in reducing the size of the entire tube pump 1E.

According to the arrangement shown in the drawing, the tube attachment slot 93 is shaped to have a flat bottom. However, in a case where the balls 14 directly press the tube 100 like in the present embodiment, it is more preferable that the tube attachment slot 93 has an arc-like or semi-circular cross section, that is, a curved bottom. According to this arrangement, the tube 100 is pressurized at a portion thereof to be sealed in a shape such that its cross section forms a curved arc along a clearance between the balls 14 and the tube attachment slot 93, thereby making it possible to pressurize the tube 100 at a portion thereof to be sealed in a more reliable manner without having any clearance.

In the present embodiment, one oscillator 6 is provided; however, in the present invention, more than one oscillator 6 may be provided.

(Sixth Embodiment)

Figure 12:
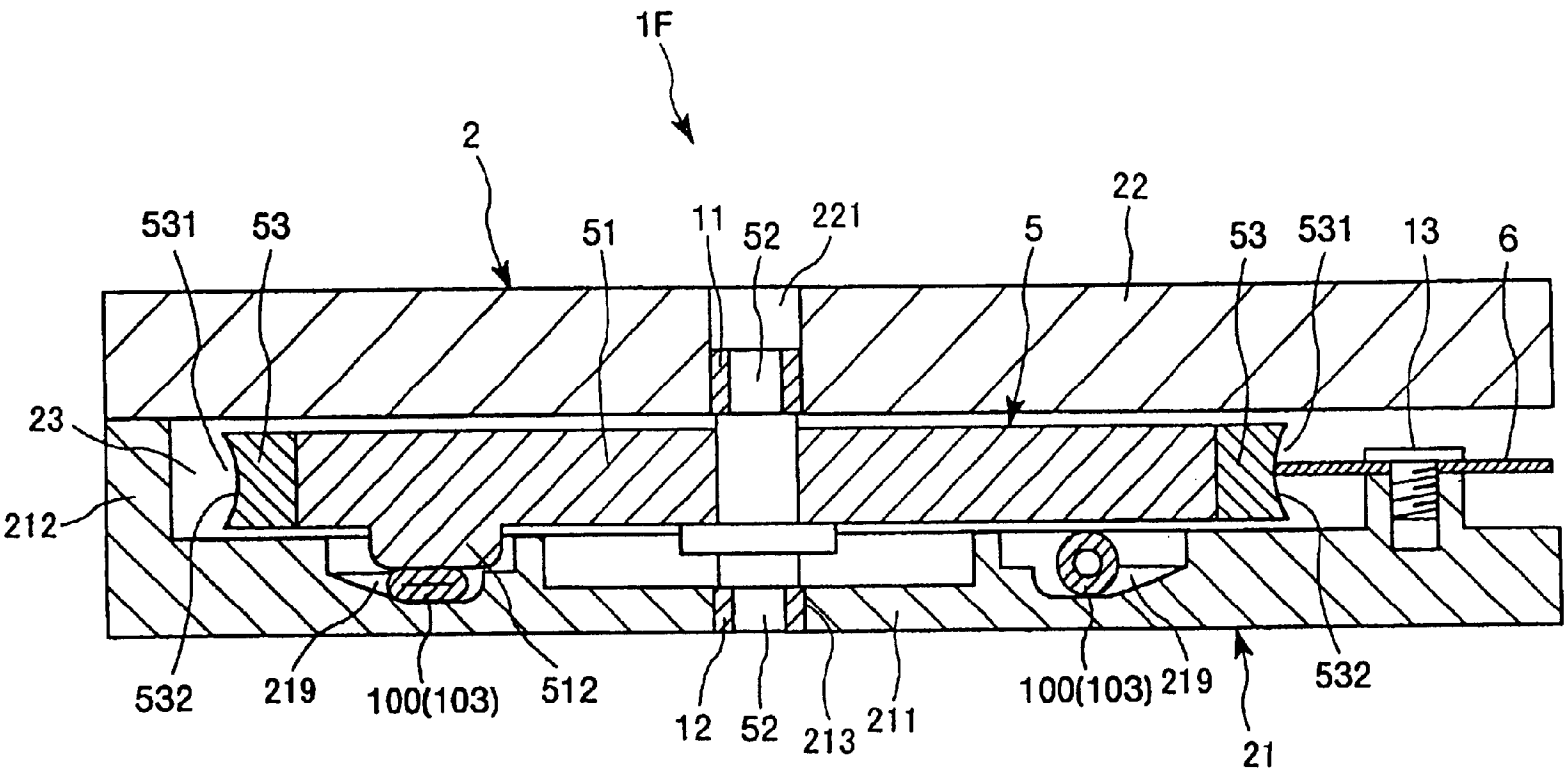
FIG. 12 is a cross-sectional side view showing a sixth embodiment of the tube pump of the present invention.

FIG. 12 is a cross-sectional side view showing a sixth embodiment of the tube pump of the present invention. In the following description, the upper side and the lower side of FIG. 12 are assumed to be "top" and "bottom", respectively.

The following description will describe the sixth embodiment of the tube pump of the present invention with reference to this drawing; however, the following description will chiefly describe a difference from the first embodiment above and the description as to the similar arrangements is omitted.

With a tube pump 1F of the present embodiment, a tube attachment slot 219 substantially similar to the aforementioned tube attachment slot 93 serving as the attachment portion is provided on the top face of the bottom plate 211 of the base 21, and a segment of the tube 100 is attached so that it is inserted into the tube attachment slot 219. The segment positioned within the tube attachment slot 219 forms the arc portion 103.

The rotor main body 51 is provided with a plurality of convex portions 512 as the pressurizing portions at the bottom face thereof, and these convex portions 512 pressurize the arc portion 103 of the tube 100 at a portion thereof to be sealed from the upper side.

Like these convex portions 512, in the present invention, the pressurizing portions may be provided immovably to the rotor 5. This arrangement can make the structure of the pressurizing portions further simplified. In this case, it is preferable to reduce friction between the tube 100 and the pressurizing portions like the convex portions 512 by coating both or one of the outer surface of the tube 100 and the surface of the pressurizing portions like the convex portions 512 with a low friction material or by applying a lubricant. Examples of the low friction material include fluorine-based resin, such as polytetrafluoro-ethylene (Teflon).

Also, as with the fifth embodiment above, in the present embodiment, by pressurizing the tube 100 along the direction of the rotor rotational axis 52, the tube 100 and the rotor 5 can be superimposed in the thickness direction of the rotor 5, that is, in the direction of the rotor rotational axis 52, which is advantageous particularly in reducing the size of the entire tube pump 1F.

In the present embodiment, one oscillator 6 is provided; however, in the present invention, more than one oscillator 6 may be provided.

(Seventh Embodiment)

Figure 13:
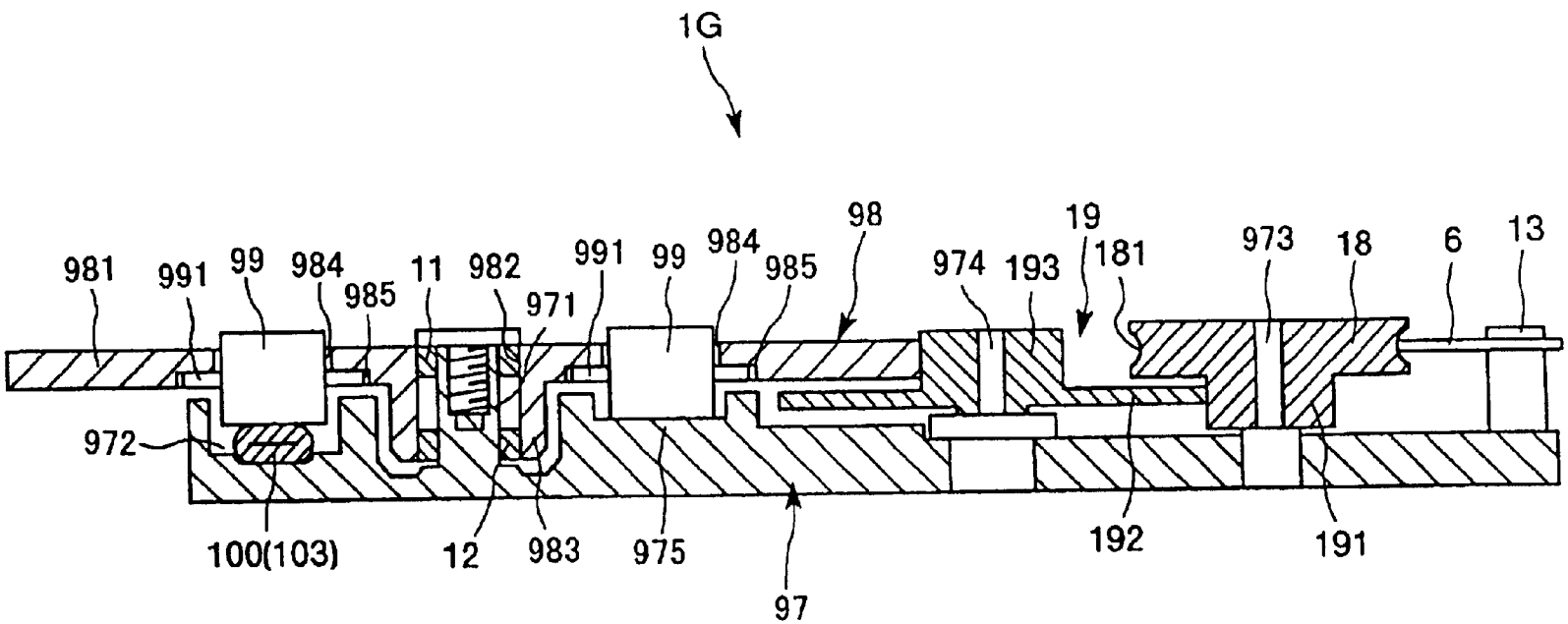
FIG. 13 is a cross-sectional side view showing a seventh embodiment of the tube pump of the present invention.

FIG. 13 is a cross-sectional side view showing a seventh embodiment of the tube pump of the present invention. In the following description, the upper side and the lower side of FIG. 13 are assumed to be "top" and "bottom", respectively.

The following description will describe the seventh embodiment of the tube pump of the present invention with reference to this drawing; however, the following description will chiefly describe a difference from the first embodiment above and the description as to the similar arrangements is omitted.

A tube pump 1G of the present embodiment is provided with a main body 97 having a tube attachment slot 972 serving as an attachment portion to which an elastic tube 100 is attached, a gear rotor 98 serving as a rotor mounted rotatably with respect to the main body 97, rollers 99 serving as a plurality of pressurizing portions provided to the gear rotor 98, an oscillator 6 mounted to the main body 97, a driven member 18 driven by the oscillator 6, and a rotational force transmission mechanism 19.

The main body 97 as a whole is essentially shaped like a plate, and includes a rotor rotational axis 971 installed so as to protrude upward.

The gear rotor 98 includes a base portion 981 essentially shaped like a circular plate, and a bearing placement portion 983 protruding cylindrically downward from the edge portion of a hole 982 made in the base portion 981 at the central portion thereof. Teeth of a gear are formed at the outer circumference of the base portion 981, and the gear rotor 98 serves also as a gear.

With the gear rotor 98 arranged as above, the rotor rotational axis 971 is inserted into the hole 982 on the inside of the bearing placement portion 983, so that the gear rotor 98 is mounted rotatably on the rotor rotational axis 971 of the main body 97 through bearings 11 and 12 both placed on the inside of the bearing placement portion 983.

As has been described, in the present embodiment, the main body 97 supports the gear rotor 98 from one side, that is, from the lower side. This arrangement, as with the fourth embodiment above, makes the tube pump 1G advantageous particularly in reducing the thickness.

In the present embodiment, the driven member 18 driven by the oscillator 6 and the gear rotor 98 are provided separately, and the driven member 18 rotates the gear rotor 98 through the rotational force transmission mechanism 19.

The driven member 18 is essentially shaped like a disc, and mounted rotatably on a driven member rotational axis 973 provided to the main body 97 through an unillustrated bearing. A slot 181 similar to the aforementioned slot 531 is formed at the outer circumference of the driven member 18.

The main body 97 is provided with the oscillator 6 in such a manner that the convex portion 66 thereof touches the inner face of the slot 181. According to this arrangement, like the aforementioned rotor 5, the driven member 18 is driven rotationally by the oscillator 6.

The rotational force transmission mechanism 19 is composed of a spur gear train, which includes a pinion 191, a gear wheel 192 that engages with the pinion 191, and a pinion 193 coaxially fixed to the gear wheel 192.

The pinion 191 is coaxially fixed to the driven member 18 and rotates together with the driven member 18.

The gear wheel 192 and the pinion 193 are mounted rotatably on a gear rotational axis 974 provided to the main body 97 through unillustrated bearings and rotate together. The pinion 193 is mounted so as to engage with the gear rotor 98.

The rotational force transmission mechanism 19 arranged as above reduces the speed of rotation of the driven member 18 in two steps and transmits the same to the gear rotor 98. In short, the rotational force transmission mechanism 19 serves as a speed changing unit, in particular, a speed reducing unit.

Also, according to the arrangement shown in the drawing, the driven member 18 and the gear rotor 98 rotate in the same direction. It should be appreciated, however, that by selecting the number of gears, etc., the driven member 18 and the gear rotor 98 rotate in the opposite directions.

In the present embodiment, by driving the gear rotor 98 through the rotational force transmission mechanism 19, it is possible to heighten a degree of freedom as to where the oscillator 6 is located. Also, by changing the rotational speed with the rotational force transmission mechanism 19, the gear rotor 98 is allowed to rotate at a desired speed, which makes it possible to adjust a fluid feeding speed. In particular, in a case where the rotational speed is reduced by the rotational force transmission mechanism 19, a small driving force from the oscillator 6 is sufficient, thereby making it possible to further reduce the oscillator 6 in size.

The rotational force transmission mechanism 19 is not limited to the gear train as shown in the drawing, and for example, it may be a winding transmission mechanism using a pulley, a belt, a chain, etc. Alternatively, it may be a unit such that changes directions of rotational axes of the driven member 18 and the gear rotor 98 by using a bevel gear, worm gears, etc.

The main body 97 is provided with the tube attachment slot 972 on the top face along the circumferential direction of the gear rotor 98 at the inner circumference side of the outermost radius of the gear rotor 98. In short, the tube attachment slot 972 is provided so as to form an arc when viewed in an unillustrated plane. A segment of the tube 100 is attached so that it is inserted into the tube attachment slot 972, and the segment positioned within the tube attachment slot 972 forms the arc portion 103.

The base portion 981 of the gear rotor 98 is provided with rollers 99 that pressurize the arc portion 103 of the tube 100 at the portion thereof to be sealed from the upper side. Each roller 99 includes a rotational axis 991, and the rotational axis 991 is installed so as to intersect with the rotor rotational axis 971 at nearly right angles.

The base portion 981 is provided with windows 984 serving as holes into which the upper portions of the rollers 99 are inserted. Also, the base portion 981 is provided with rotational axis insert slots 985 at the bottom face in close proximity to the windows 984, so that by inserting the rotational axes 991 into the rotational axis insert slots 985, the gear rotor 98 supports the rollers 99 rotatably. Because the tube 100 or a touching portion 975 described below constantly touches the lower sides of the rollers 99, the rotational axes 991 will not come off from the rotational axis insert slots 985.

In the present embodiment, because the arc portion 103 of the tube 100 is positioned on the inside of the outermost radius of the gear rotor 98, as with the second embodiment above, there is offered an advantage that the torque required to rotate the gear rotor 98 is relatively small. Hence, according to the present embodiment, the oscillator 6 can be further reduced in size, which makes it possible to further reduce the size of the entire tube pump 1G.

Also, in the present embodiment, as with the fifth embodiment above, by pressurizing the tube 100 along the direction of the rotor rotational axis 971, the tube 100 and the gear rotor 98 can be superimposed in the thickness direction of the gear rotor 98, that is, in the direction of the rotor rotational axis 971. This arrangement is advantageous particularly in reducing the size of the entire tube pump 1G.

The main body 97 includes the touching portion 975 that touches the roller 99, like the roller 99 in the right side of FIG. 13, which is present at a position for not pressurizing the arc portion 103 of the tube 100. By providing the touching portion 975, there can be offered an advantage as follows.

The gear rotor 98 receives a force that tilts the gear rotor 98 due to a reactive force from the arc portion 103 of the tube 100 that the rollers 99 pressurize at a portion thereof to be sealed. In other words, this force functions so that the gear rotor 98 tilts downward to the right of FIG. 13. At this point, in the present embodiment, by allowing the roller 99 in the right side of FIG. 13 to touch the touching portion 975, the gear rotor 98 is prevented from tilting, thereby allowing the gear rotor 98 to rotate more smoothly in a reliable manner. Also, the arc portion 103 of the tube 100 can be pressurized at a portion thereof to be sealed in a reliable manner without the roller 99 in the left side of FIG. 13 being lifted up.

In the present embodiment, one oscillator 6 is provided; however, in the present invention, more than one oscillator 6 may be provided.

(Eighth Embodiment)

Figure 14:
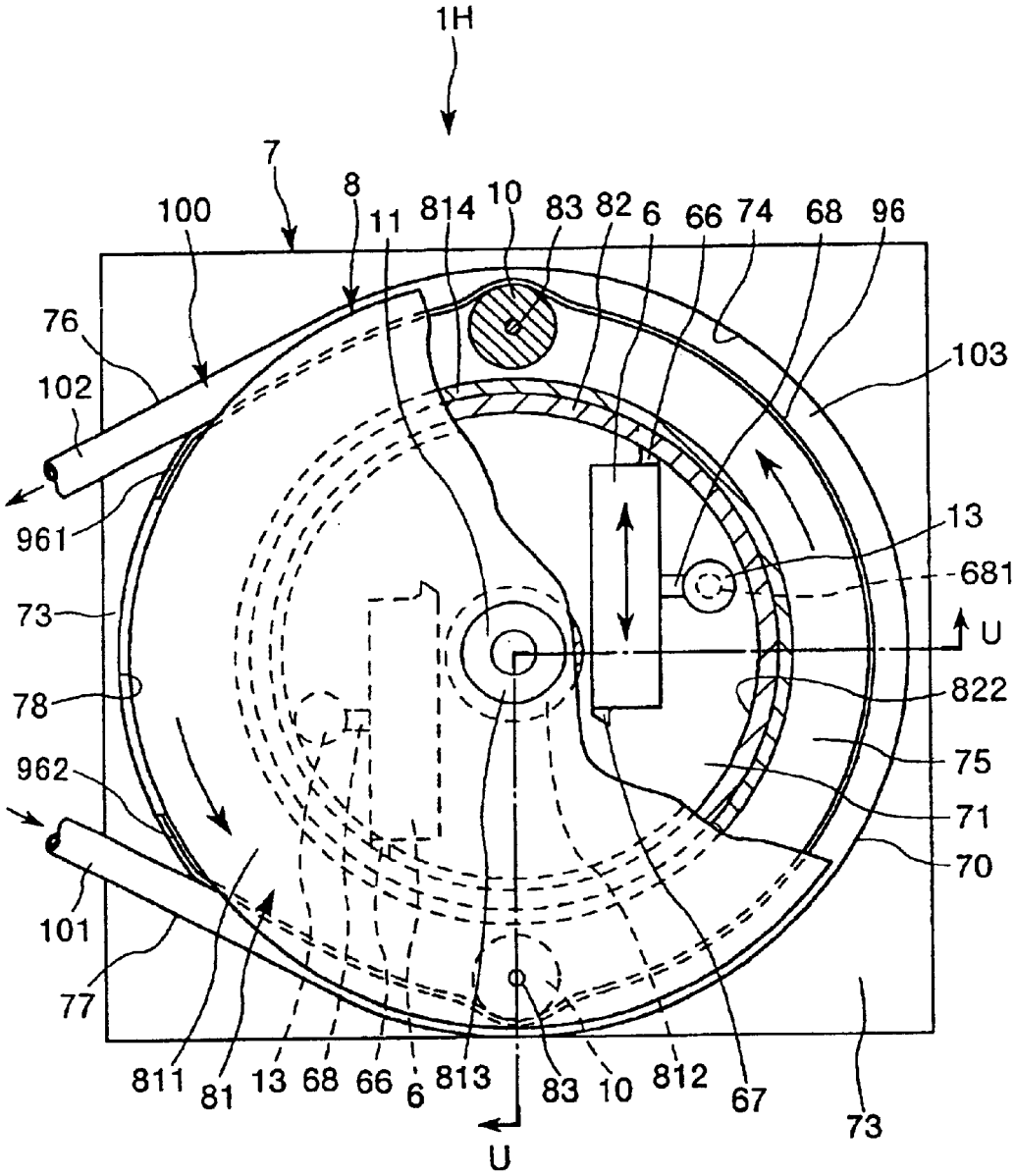
FIG. 14 is a partially cutaway plan view showing an eighth embodiment of the tube pump of the present invention.
Figure 15:
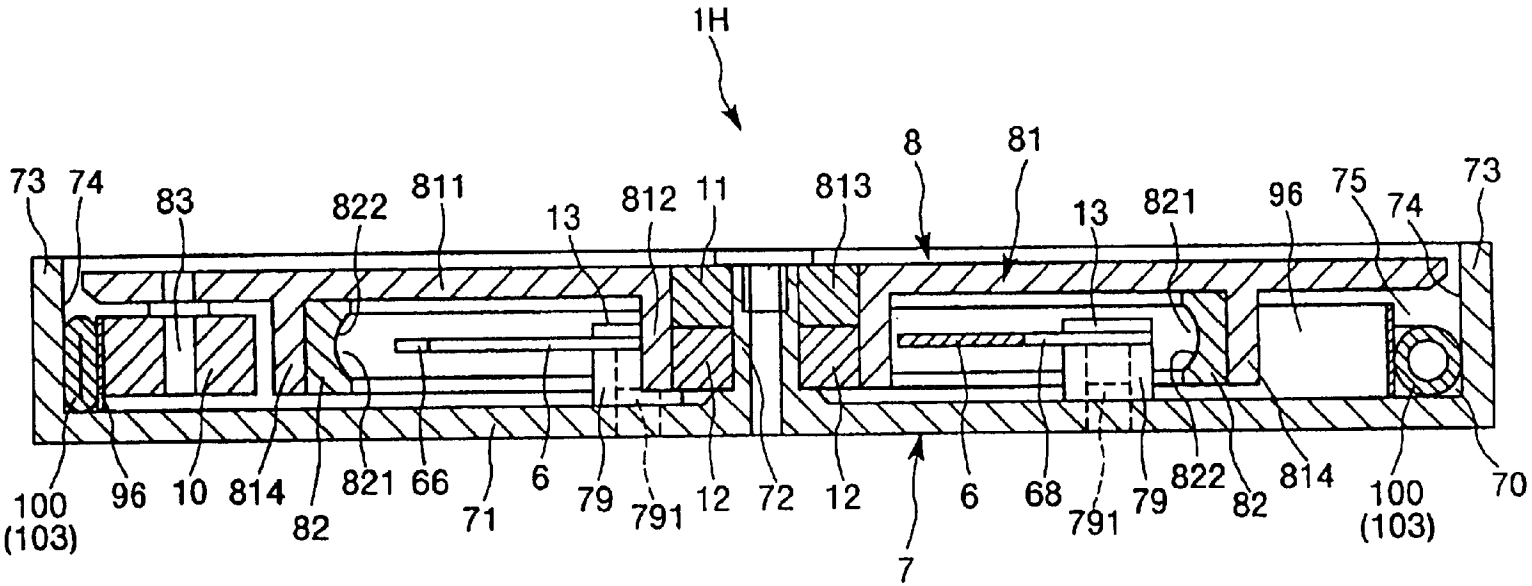
FIG. 15 is a cross-sectional side view taken along the plane of the line U—U of FIG. 14.

FIG. 14 is a partially cutaway plan view showing an eighth embodiment of the tube pump of the present invention. FIG. 15 is a cross-sectional side view taken along the plane of the line U—U of FIG. 14. In the following description, the upper side and the lower side of FIG. 15 are assumed to be "top" and "bottom", respectively.

The following description will describe the eighth embodiment of the tube pump of the present invention with reference to these drawings; however, the following description will chiefly describe a difference from the embodiments described above and the description as to the similar arrangements is omitted.

The present embodiment is the same as the fourth embodiment above except that a thin plate 96 is provided in close proximity to the tube 100 attached to the attachment portion 70.

With a tube pump 1H of the present embodiment, the thin plate 96 as a flexible plate member is provided along the inner circumference of the tube 100 attached to the attachment portion 70 essentially in the shape of a letter C, and the rollers 10 pressurize a segment of the arch portion 103 of the tube 100 at a portion thereof to be sealed through the thin plate 96.

The thin plate 96 is shaped like a strip and is located so as to touch the inner circumference of the tube 100 attached to the attachment portion 70. The thin plate 96 is displaceable in the thickness direction, and segments pressed by the rollers 10 are displaced toward the outer circumference side.

Also, the thin plate 96 is secured to the main body 7 in close proximity to the slot 76 at a securing portion 961 at one end, and secured to the main body 7 in close proximity to the slot 77 at a securing portion 962 at the other end. This arrangement prevents the thin plate 96 from moving in the in-plane direction, that is, in the rotational direction of the rotor 8, as being secured to the securing portions 961 and 962.

In the present embodiment, by using the thin plate 96 arranged as above, the tube 100 is prevented from being in direct friction with the pressurizing portions like the rollers 10, and the tube 100 only receives a force in a flattened direction, that is, in a direction intersecting at right angles with the axial direction of the tube 100 from the pressurizing portions like the rollers 10, and receives no force that drags the tube 100, that is, a force in the axial direction of the tube 100. Hence, the tube 100 is prevented from moving or twisting, which makes it possible to feed a fluid smoothly. Also, deterioration of the tube 100 is prevented, and the lifespan of the tube 100 can be extended.

The securing portions 961 and 962 are preferably secured to the main body 7 by an unillustrated screw tightening mechanism or an unillustrated arbitrary sandwiching mechanism, such as a clip, so that the thin plate 96 is preferably detachable/attachable from/to the main body 7. By providing the thin plate 96 in a detachable/attachable manner, it is possible to replace the thin plate 96. Hence, when the thin plate 96 is deteriorated or damaged, it can be replaced with a new one. Also, the thin plate 96 can be replaced with a thin plate 96 of the same kind having different thickness, quality of materials, hardness, etc. in response to the fluid feeding speed, that is, a rotational speed of the rotor 8, the diameter of the rollers 10, and the diameter, quality of materials, and hardness of the tube 100, etc., which makes it possible to selectively use an optimal thin plate 96 as needed.

In the present embodiment, the thin plate 96 is provided from the vicinity of the slot 76 to the vicinity of the slot 77, so that it is provided across the arc portion 103, which is a segment of the tube 100 pressurized at a portion thereof to be sealed by the rollers 10. According to this arrangement, the advantages described above can be attained across the segment. Therefore, as has been described, it is preferable that the thin plate 96 is provided almost across the segment of the tube 100 pressurized at a portion thereof to be sealed by the rollers 10, namely, the arc portion 103.

A forming material of the thin plate 96 is not especially limited, but a low friction material is preferable, examples of which include metal materials of various kinds, and synthetic resin materials of various kinds, such as polytetrafluoro-ethylene (Teflon).

Also, the thin plate 96 preferably has the ability to restore to the original shape after it is deformed, that is, elasticity.

In addition, the thickness of the thin plate 96 is not especially limited, but a preferable thickness is approximately 0.005 to 0.1 mm. If the thin plate 96 is too thick, the thin plate 96 will not readily deform depending on the forming material thereof, and the tube 100 may not be pressurized at a portion thereof to be sealed in a satisfactory manner. On the other hand, when the thin plate 96 is too thin, the thin plate 96 may readily break depending on the forming material thereof.

Also, according to the present embodiment, it is possible to reduce the size of the pressurizing portions like the rollers 10 by using the thin plate 96.

When the pressurizing portions like the rollers 10 are reduced in size, the pressing area is diminished in general and they engage in the tube 100 when pressurizing the same, which may cause inconveniences by, for example, accelerating deterioration of the tube 100, interfering with smooth rotations of the rotor 8, etc.

In contrast, in the present embodiment, an area pressing the tube 100 is enlarged by pressurizing the tube 100 through the thin plate 96, so that the pressing force can be dispersed across the in-plane of the thin plate 96. To be more specific, even when the pressurizing portions like the rollers 10 are made smaller in diameter, they pressurize the tube 100 at a portion thereof to be sealed with a large curvature because of the rigidity of the thin plate 96, thereby making it possible to prevent local deformation of the tube 100. Hence, no inconveniences as described above will arise even when the pressurizing portions like the rollers 10 are reduced in size or the pressurizing portions are the balls 14 having small pressure-contacted points. In view of the foregoing, in the present embodiment, the pressurizing portions like the rollers 10 can be reduced in size, which makes it possible to further reduce the size of the entire tube pump 1H.

(Ninth Embodiment)

Figure 16:
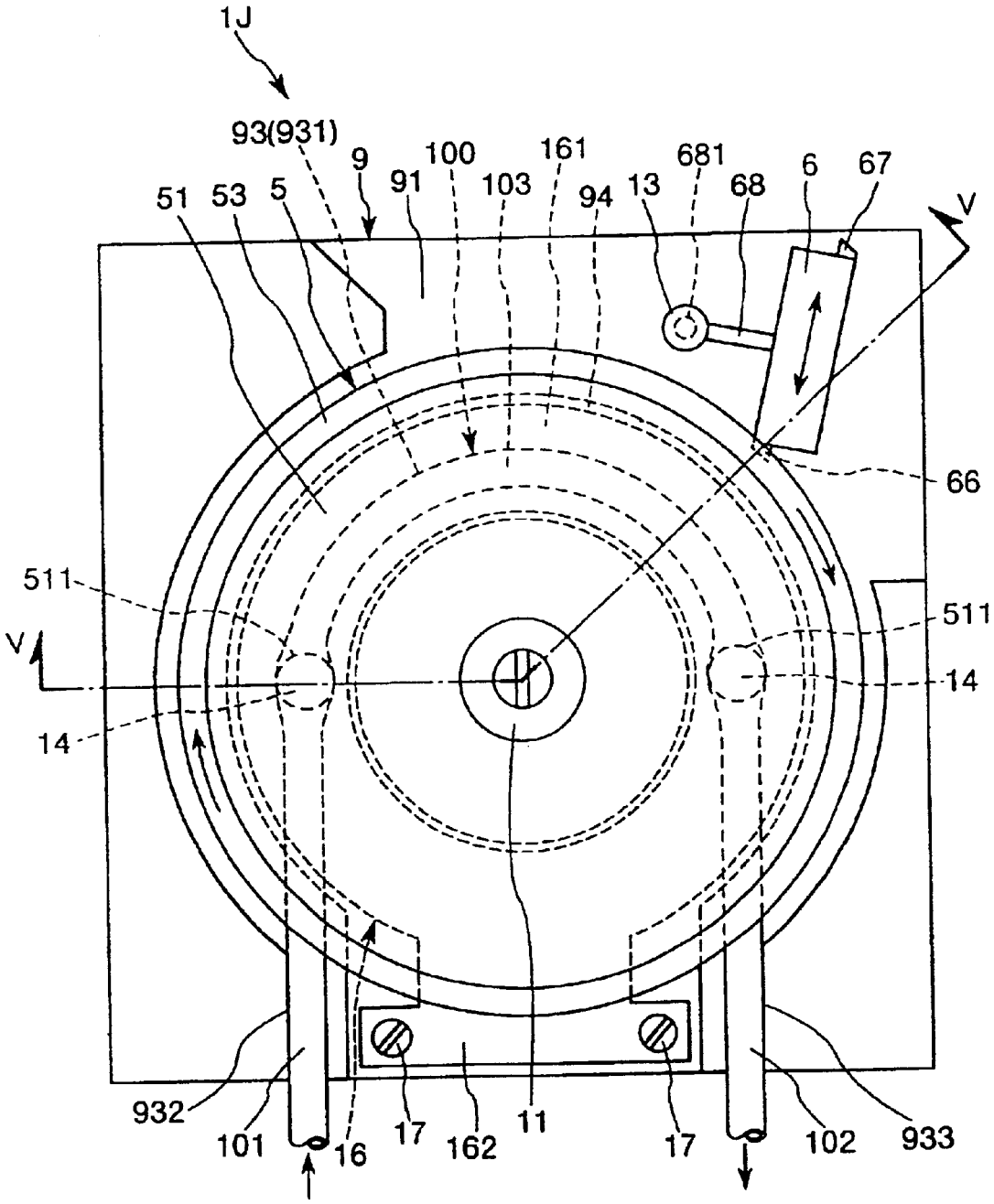
FIG. 16 is a plan view showing a ninth embodiment of the tube pump of the present invention.
Figure 17:
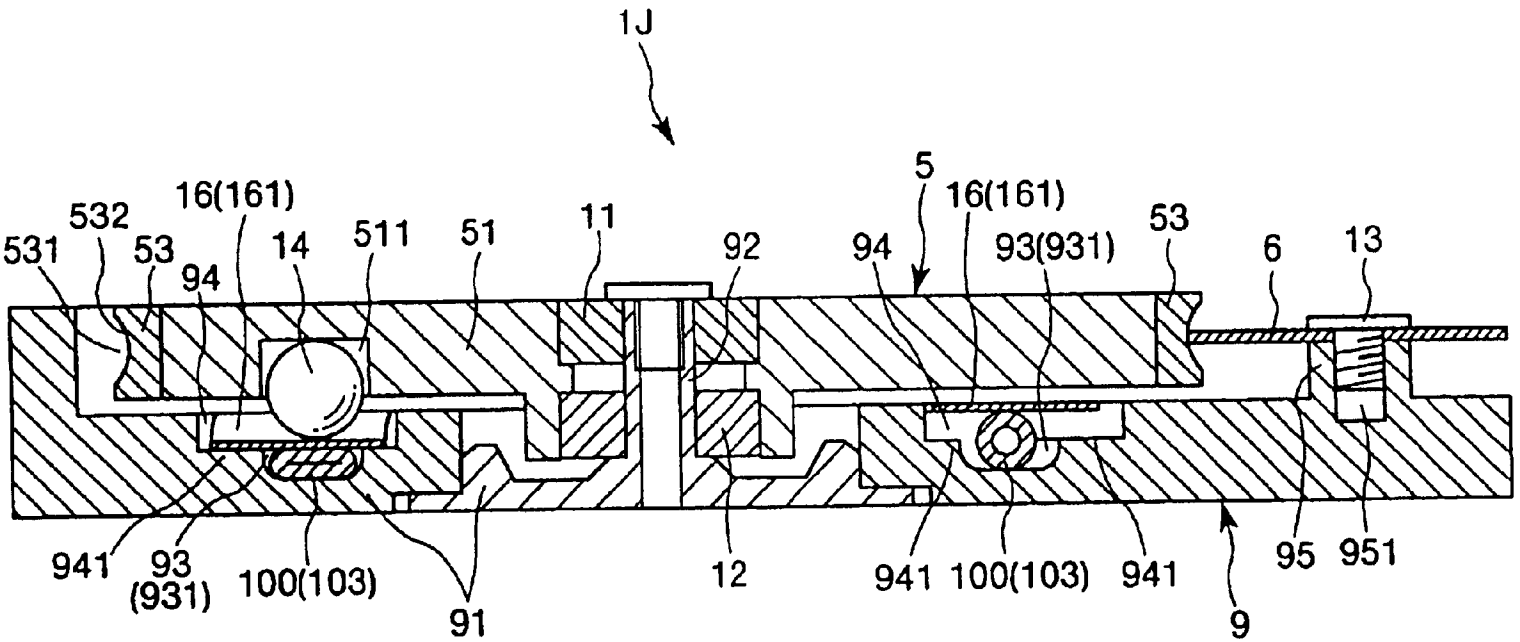
FIG. 17 is a cross-sectional side view taken along the plane of the line V—V of FIG. 16.

FIG. 16 is a plan view showing a ninth embodiment of the tube pump of the present invention. FIG. 17 is a cross-sectional side view taken along the plane of the line V—V of FIG. 16. In the following description, the upper side and the lower side of FIG. 17 are assumed to be "top" and "bottom", respectively.

The following description will describe the ninth embodiment of the tube pump of the present invention with reference to these drawings; however, the following description will chiefly describe a difference from the embodiments described above and the description as to the similar arrangements is omitted.

The present embodiment is the same as the fifth embodiment above except that a thin plate 16 is provided.

A tube pump 1J of the present embodiment is provided with a main body 9 having a tube attachment slot 93 serving as an attachment portion to which an elastic tube 100 is attached, a rotor 5 mounted rotatably with respect to the main body 9, an oscillator 6 mounted to the main body 9 so as to touch the rotor 5 from the outer circumference side in the radius direction, balls 14 serving as a plurality of pressurizing portions provided to the rotor 5, and the thin plate 16 disposed between the rotor 5 and the tube 100.

As shown in FIG. 17, the main body 9 includes a substrate 91 and a rotor rotational axis 92 installed so as to protrude upward from the central portion of the substrate 91.

The substrate 91 is provided with, on the top face thereof, a thin plate insert slot 94 of an annular shape about the rotor rotational axis 92.

The substrate 91 is further provided with, on the top face thereof, the tube attachment slot 93 essentially in the shape of a letter U when viewed in a plane shown in FIG. 16.

The tube attachment slot 93 is composed of an arc portion 931 formed arc-wise about the rotor rotational axis 92, a linear portion 932 extending downward in FIG. 16 from the left end portion of the arc portion 931 of FIG. 16, and a linear portion 933 extending downward in FIG. 16 from the right end portion of the arc portion 931 of FIG. 16.

As shown in FIG. 17, the arc portion 931 is formed at a bottom portion 941 of the thin plate insert slot 94. To be more specific, the width of the tube attachment slot 93 is less than the width of the thin plate insert slot 94, and the arc portion 931 is provided so as to further form a concave portion at the bottom portion 941 of the thin plate insert slot 94.

The tube 100 is attached to the main body 9 along the tube attachment slot 93 arranged as above essentially in the shape of a letter U, and includes an arc portion 103 positioned at the arc portion 931, an upstream portion 101 positioned at the linear portion 932, and a downstream portion 102 positioned at the linear portion 933.

The rotor main body 51 is provided with the two balls 14 serving as the pressurizing portions placed along the circumferential direction of the rotor 5 at nearly equiangular intervals, that is, at intervals of 180°. Each ball 14 is provided so that the upper side thereof is fit into a concave portion 511 formed at the bottom face of the rotor main body 51, and is allowed to rotate in an arbitrary direction with respect to the rotor main body 51.

These balls 14 pressurize a segment of the arc portion 103 of the tube 100 at a portion thereof to be sealed from the upper side through the thin plate 16 described below.

One oscillator 6 is provided at the outer circumference side of the rotor 5. As shown in FIG. 17, an oscillator mount portion 95 having a screw hole 951 is provided so as to protrude from the substrate 91 at the outer circumference side of the rotor 5, so that the oscillator 6 is secured to the oscillator mount portion 95 by the bolt 13 inserted into the hole 681 in the arm portion 68. The oscillator 6 drives the rotor 5 to rotate in a clockwise direction of FIG. 16.

The thin plate 16 is disposed between the tube 100 and the rotor 5, so that the tube 100 is pressurized at a portion thereof to be sealed by the balls 14 through the thin plate 16.

The thin plate 16 is composed of an annular ring portion 161 about the rotor rotational axis 92, and a securing portion 162 formed so as to protrude toward the outer circumference side from the ring portion 161. The thin plate 16 is secured to the securing portion 162 by two bolts 17 in a detachable/attachable manner with respect to the main body 9, and is arranged so as not to move in the in-plane direction of FIG. 16.

The ring portion 161 is provided along the thin plate insert slot 94 and covers the arc portion 103 of the tube 100 from the upper side. The width of the ring portion 161 is slightly less than the width of the thin plate insert slot 94.

As is shown at the right side of FIG. 17, a segment of the ring portion 161 pressed by the ball 14 is inserted into the thin plate insert slot 94 as being displaced in the thickness direction thereof, that is, downward, whereby the tube 100 is pressurized at a portion thereof to be sealed.

At this point, the edge portion of the ring portion 161 touches the bottom portion 941 of the thin plate insert slot 94, so that any further downward displacement is inhibited. According to this arrangement, a position of the segment of the ring portion 161 pressed by the ball 14 and displaced in the thickness direction is determined, which not only prevents the ring portion 161 from tilting, but also makes it possible to pressurize the tube 100 at a portion thereof to be sealed with a constant quantity of flattening all the time. Hence, it is possible to prevent the tube 100 from being pressurized excessively at a portion thereof to be sealed, which suppresses deterioration of the tube 100, thereby further extending the lifespan thereof.

As has been described, in the present embodiment, the bottom portion 941 functions as displacement quantity regulating means for regulating the thin plate 16 so as not to be displaced over a certain limit. Herein, the shape and depth of the arc portion 931 of the tube attachment slot 93 are set to attain an optimal quantity of flattening of the tube 100.

In the present embodiment, one oscillator 6 is provided; however, in the present invention, more than one oscillator 6 may be provided.

(Tenth Embodiment)

Figure 18:
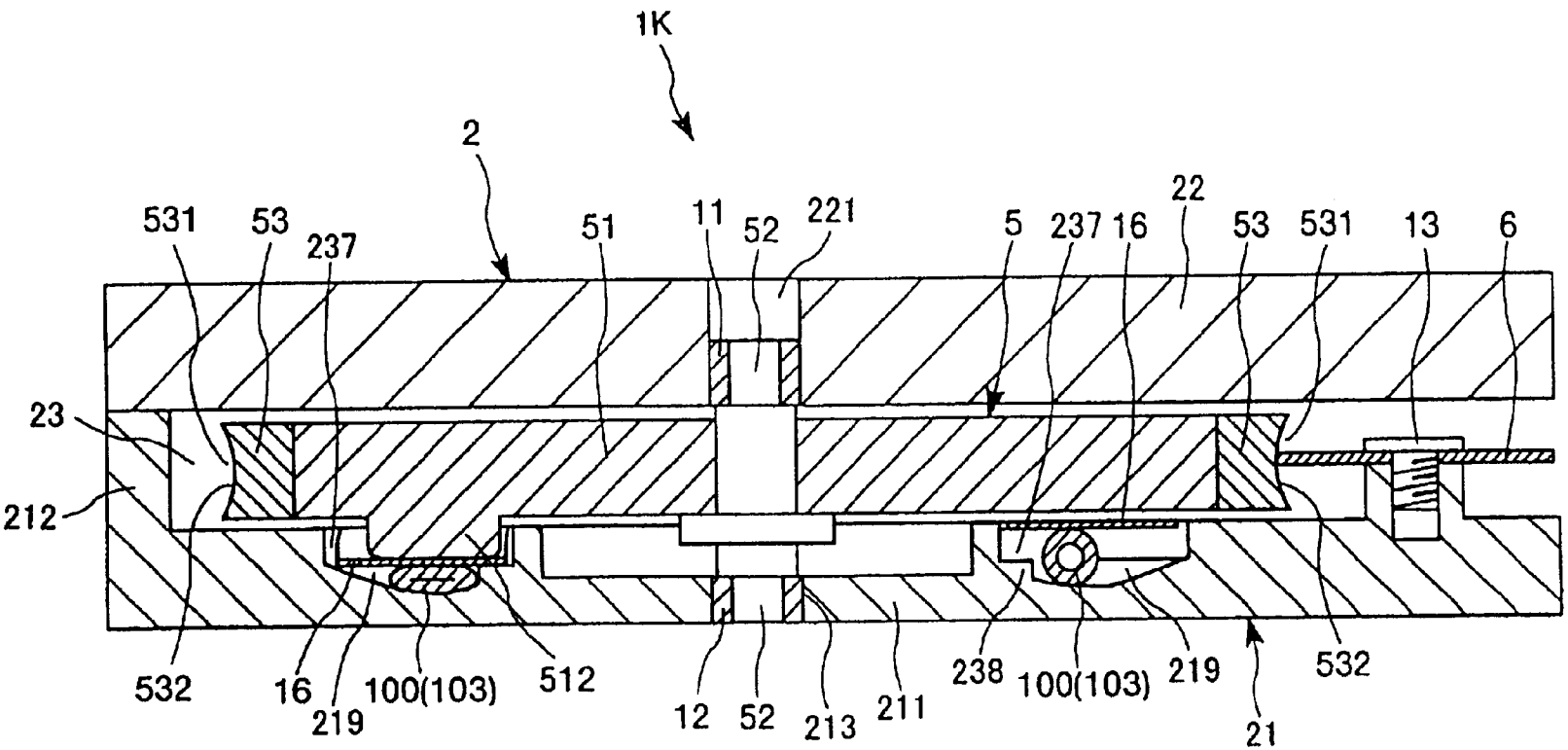
FIG. 18 is a cross-sectional side view showing a tenth embodiment of the tube pump of the present invention.

FIG. 18 is a cross-sectional side view showing a tenth embodiment of the tube pump of the present invention. In the following description, the upper side and the lower side of FIG. 18 are assumed to be "top" and "bottom", respectively.

The following description will describe the tenth embodiment of the tube pump of the present invention with reference to this drawing; however, the following description will chiefly describe a difference from the embodiments described above and the description as to the similar arrangements is omitted.

The present embodiment is the same as the sixth embodiment above except that the thin plate 16 is provided.

The main body 2 is provided with, on the top face of the bottom plate 211 of the base 21, a thin plate insert slot 237 substantially similar to the aforementioned thin plate insert slot 94, and a tube attachment slot 219 substantially similar to the aforementioned tube attachment slot 93. The tube 100 is attached along the tube attachment slot 219.

The rotor main body 51 is provided with a plurality of convex portions 512 serving as the pressurizing portions at the bottom face thereof, and these convex portions 512 pressurize the arc portion 103 of the tube 100 at a portion thereof to be sealed from the upper side through the thin plate 16. In short, the convex portions 512 slide on the thin plate 16.

In the present embodiment, because the pressurizing portions pressurize the tube 100 at a portion thereof to be sealed through the thin plate 16, the pressurizing portions do not contact the tube 100 directly. Hence, even when the pressurizing portions are provided immovably to the rotor 5 like the convex portions 512, it is possible to prevent deterioration of or damages on the tube 100 in a more reliable manner, thereby extending the lifespan thereof.

In the present embodiment, it is preferable to reduce friction between the thin plate 16 and the convex portions 512 by forming at least the surfaces of both or one of the thin plate 16 and the convex portions 512 from a material having a relatively small coefficient of friction. Examples of the low friction material include fluorine-based resin, such as polytetrafluoro-ethylene (Teflon).

Also, friction between the thin plate 16 and the convex portions 512 may be reduced by applying a lubricant. Examples of the lubricant include grease, silicon oil, etc.

Segments of the thin plate 16 pressed by the convex portions 512 are inserted into the thin plate insert slot 237, and the edge portions thereof touch a bottom portion 238 of the thin plate insert slot 237. As a result, as with the ninth embodiment above, it is possible to pressurize the tube 100 at a portion thereof to be sealed at a constant quantity of flattening all the time.

In the present embodiment, one oscillator 6 is provided; however, in the present invention, more than one oscillator 6 may be provided.

(Eleventh Embodiment)

Figure 19:
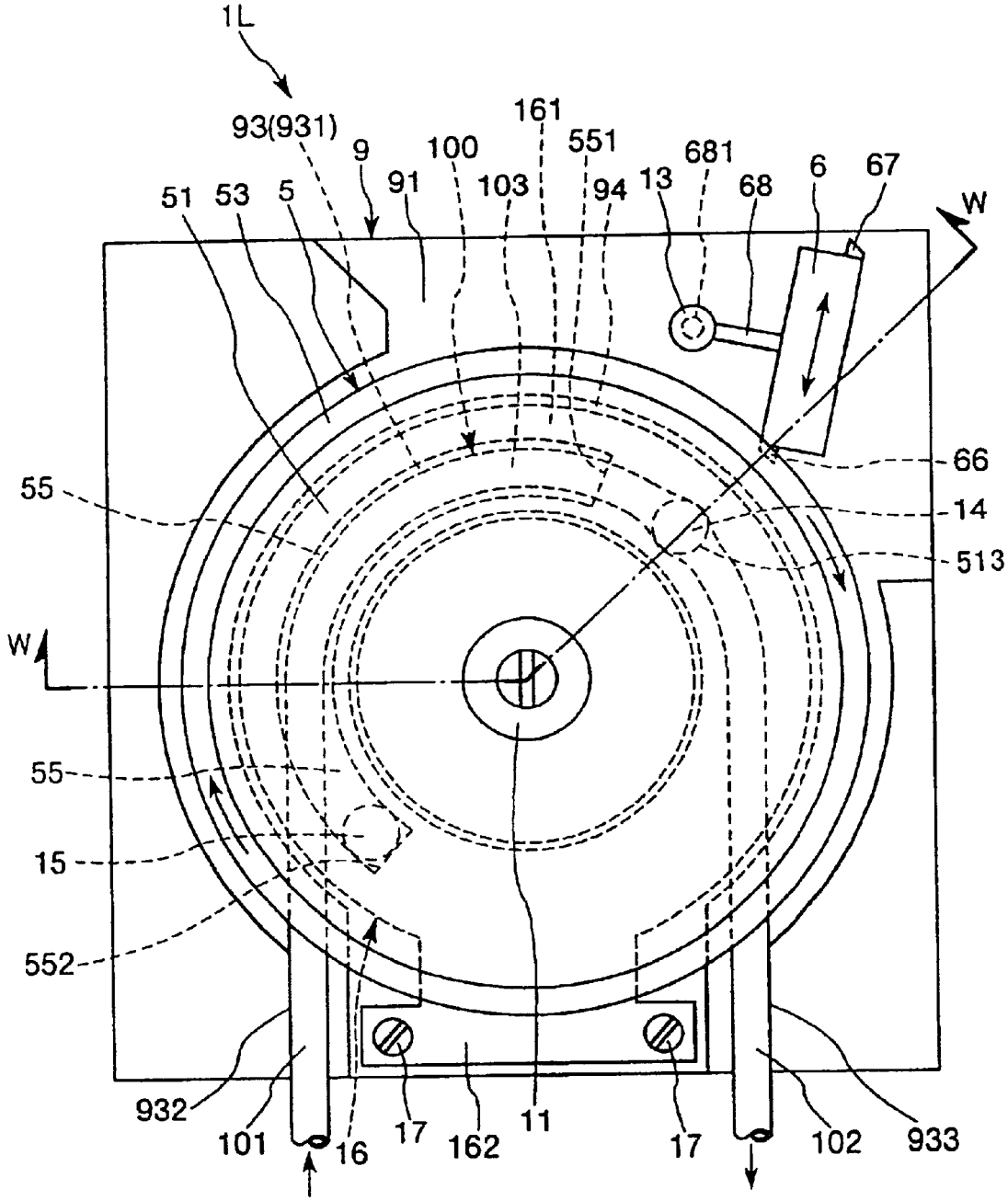
FIG. 19 is a plan view showing an eleventh embodiment of the tube pump of the present invention.
Figure 20:
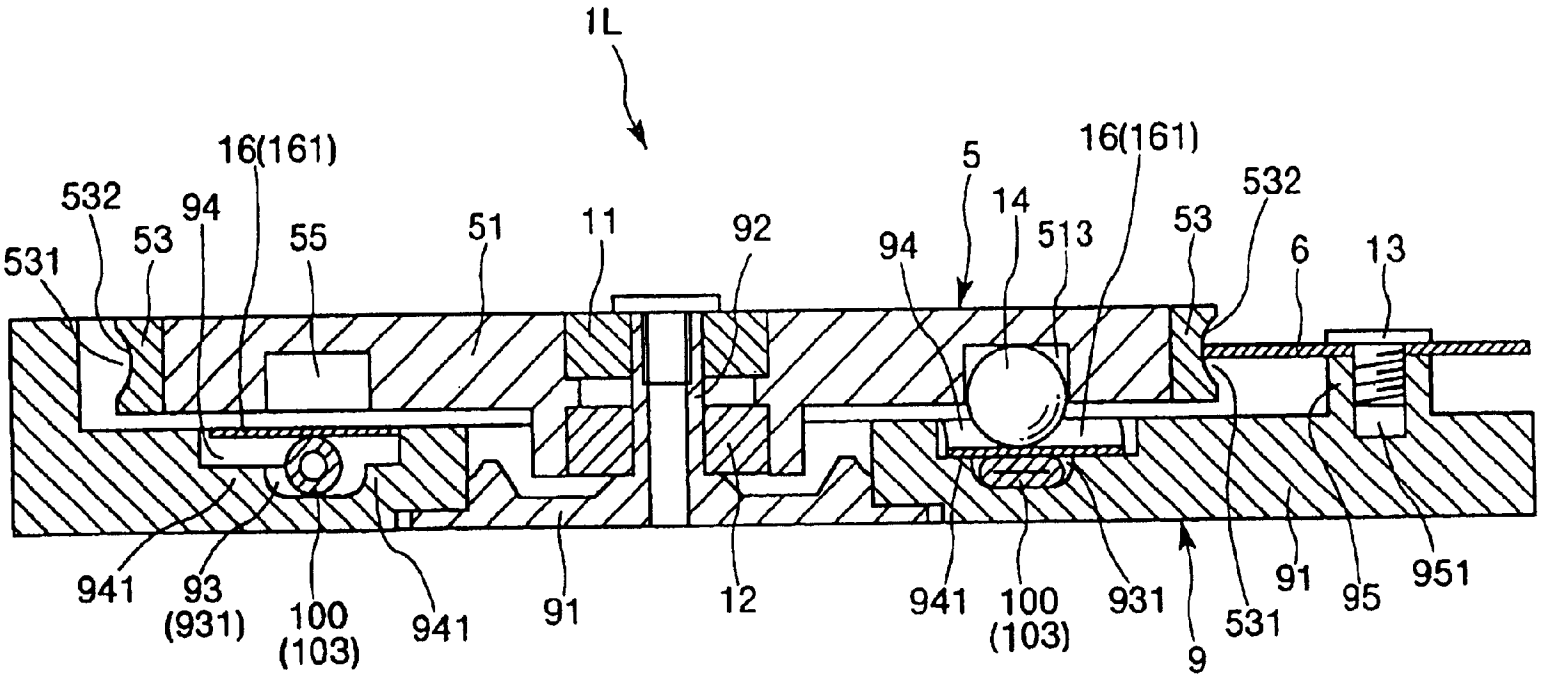
FIG. 20 is a cross-sectional side view taken along the plane of the line W—W of FIG. 19.
Figure 21:
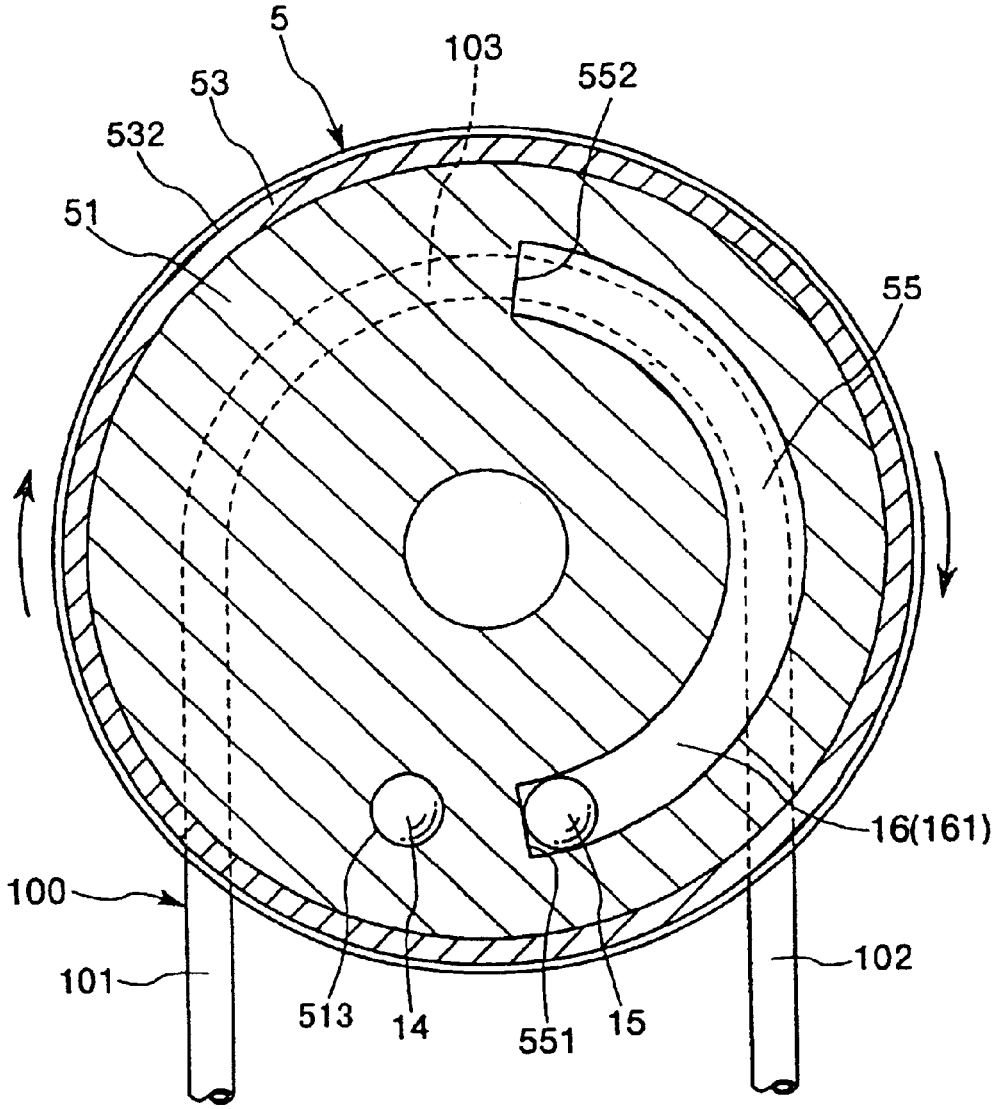
FIG. 21 is a cross-sectional plan view explaining a positional relation of balls with respect to a rotor and a tube in the tube pump shown in FIGS. 19 and 20.
Figure 22:
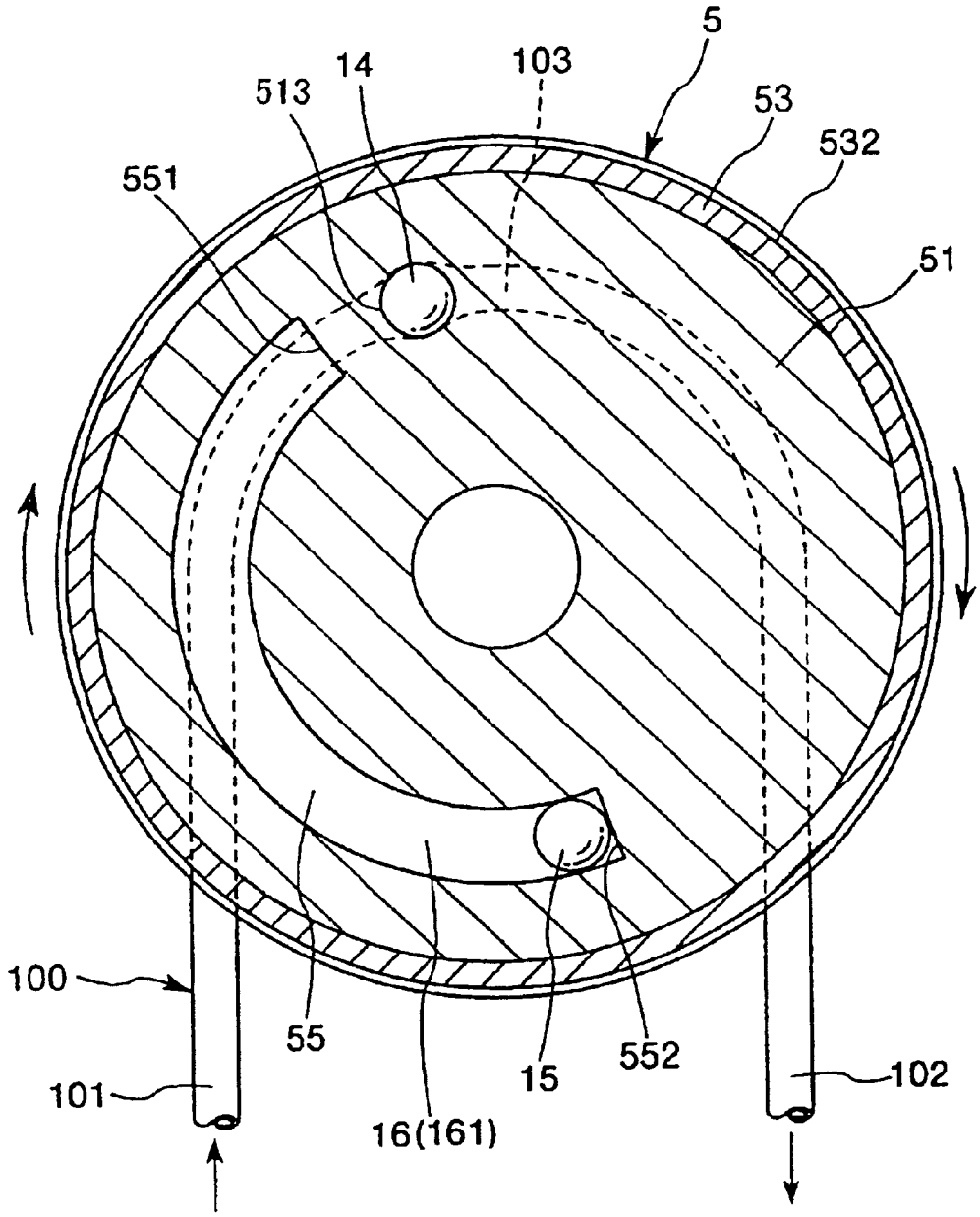
FIG. 22 is a cross-sectional plan view explaining a positional relation of the balls with respect to the rotor and the tube in the tube pump shown in FIGS. 19 and 20.

FIG. 19 is a plan view showing an eleventh embodiment of the tube pump of the present invention. FIG. 20 is a cross-sectional side view taken along the plane of the line W—W of FIG. 19. FIGS. 21 and 22 are cross-sectional plan views explaining a positional relation of balls with respect to a rotor and a tube in the tube pump shown in FIGS. 19 and 20. In the following description, the upper side and the lower side of FIG. 20 are assumed to be "top" and "bottom", respectively.

The following description will describe the eleventh embodiment of the tube pump of the present invention with reference to these drawings; however, the following description will chiefly describe a difference from the embodiments described above and the description as to the similar arrangements is omitted.

The present embodiment is the same as the ninth embodiment above except that a ball 15 serving as the pressurizing portion is allowed to move with respect to a rotor 5 within a predetermined movable range.

A tube pump 1L of the present embodiment is provided with a main body 9 having a tube attachment slot 93 serving as an attachment portion to which an elastic tube 100 is attached, the rotor 5 mounted rotatably with respect to the main body 9, an oscillator 6 mounted to the main body 9 for rotationally driving the rotor 5, balls 14 and 15 serving as the pressurizing portions, and a thin plate 16 disposed between the rotor 5 and the tube 100.

The rotor main body 51 of the rotor 5 is provided with the ball 14 and the ball 15 both serving as the pressurizing portions for pressurizing the tube 100. Each of the balls 14 and 15 pressurizes a segment of the arc portion 103 of the tube 100 at a portion thereof to be sealed from the upper side through the thin plate 16.

As shown in FIG. 20, the ball 14 is provided so that the upper side thereof is fit into a concave portion 513 formed at the bottom face of the rotor main body 51, and the lower side of the ball 14 protrudes from the bottom face of the rotor main body 51. The distance between the concave portion 513 and the rotor rotational axis 92 is substantially equal to the distance between the arc portion 103 and the rotor rotational axis 92.

The ball 14 is allowed to rotate on its axis in an arbitrary direction with respect to the rotor 5. Also, the ball 14 is arranged so as not to move substantially with respect to the rotor 5. In other words, the concave portion 513 is of a size that does not allow the ball 14 to move substantially with respect to the rotor 5.

On the other hand, the ball 15 is allowed to move with respect to the rotor 5 within a range of a ball movement slot 55. In other words, the ball 15 is provided so that the upper side thereof is inserted into the ball movement slot 55 formed at the bottom face of the rotor main body 51, so that it is allowed to move with respect to the rotor 5 along the ball movement slot 55.

Like the ball 14, the lower side of the ball 15 protrudes from the bottom face of the rotor main body 51. Also, like the ball 14, the ball 15 is allowed to rotate on its axis in an arbitrary direction with respect to the rotor 5.

As shown in FIG. 19, the ball movement slot 55 is formed arc-wise along the circumferential direction of the rotor 5, and is provided a little less than halfway from the vicinity of the ball 14 in the reverse direction of the normal rotational direction of the rotor 5, that is, in a counterclockwise direction of FIG. 19. The distance between the ball movement slot 55 and the rotor rotational axis 92 is substantially equal to the distance between the arc portion 103 and the rotor rotational axis 92.

Hereinafter, the inner face of the end portion of the ball movement slot 55 closer to the ball 14 is referred to as the front end face 551, and the inner face of the end portion farther from the ball 14 is referred to as the rear end face 552.

According to these arrangements, the ball 15 is allowed to move with respect to the rotor 5 between the position in close proximity to the ball 14 and the front end face 551 (the state shown in FIG. 21), and the position at the opposite side with respect to the ball 14 having the rotor rotational axis 92 in between, that is, in close proximity to the rear end face 552 (the states shown in FIGS. 19 and 22). In the states shown in FIGS. 19 and 22, the balls 14 and 15 are positioned along the circumferential direction of the rotor 5 at equiangular intervals, that is, at intervals of 180°.

In the present embodiment, because the ball 15 is allowed to move with respect to the rotor 5, as will be described below, it is possible to prevent the tube 100 from having a flattening habit or to prevent the tube 100 from being blocked due to adhesion of the inner wall resulting from lamination thereof while the tube pump is not in use.

As shown in FIG. 21, with the tube pump 1L, by positioning the ball 15 in close proximity to the ball 14 and by setting the rotational position of the rotor 5 so that both the balls 14 and 15 are positioned between the upstream portion 101 and the downstream portion 102 of the tube 100, there can be obtained a state that neither the ball 14 nor the ball 15 is pressurizing the arc portion 103 of the tube 100.

Hence, by leaving the tube pump 1L in the state shown in FIG. 21 while not in use, it is possible to prevent the tube 100 from having a flattening habit or being blocked due to adhesion of the inner wall. Thus, by leaving the tube pump 1L in the state shown in FIG. 21 at the time of fabrication in the factory, for example, even when there is a considerable time until it is sold or used, the tube 100 will neither have a flattening habit nor be blocked due to adhesion of the inner wall.

When the rotor 5 starts to rotate in the state shown in FIG. 21, the ball 14 starts to revolve about the rotor rotational axis 92. On the other hand, the ball 15 remains at the same position with respect to the main body 9 and starts to move relatively with respect to the rotor 5 along the ball movement slot 55.

When the state is changed as the rotor 5 rotates to the position where the rear end face 552 touches the ball 15 (the state shown in FIG. 22), the ball 15 is pressed by the rear end face 552 and starts to revolve about the rotor rotational axis 92.

In other words, when the rotor 5 starts to rotate in the state shown in FIG. 21, the ball 15 moves with respect to the rotor 5 by starting to revolve later than the ball 14, and automatically goes into the state shown in FIG. 22.

Having shifted to the state shown in FIG. 22, that is, in the steady rotation state of the rotor 5, the balls 14 and 15 revolve while being placed along the circumferential direction of the rotor 5 at equiangular intervals, that is, at intervals of 180° (see FIG. 19). According to these arrangements, in the steady rotation state of the rotor 5, at least one of the balls 14 and 15 pressurizes the arc portion 103 of the tube 100 at a portion thereof to be sealed regardless of the rotational position of the rotor 5. Hence, a fluid within the tube 100 is fed smoothly in one direction without flowing backward.

As has been described, in the present embodiment, the ball 15 automatically moves with respect to the rotor 5 when the rotor 5 starts to rotate. Hence, it is possible to prevent the tube 100 from having a flattening habit or being blocked due to adhesion of the inner wall while the tube pump is not in use without performing any special manipulation or the like, thereby achieving enhanced convenience. Also, by merely rotating the rotor 5 approximately halfway from a state when the tube pump is not in use shown in FIG. 21, the balls 14 and 15 can be placed at the positions in the steady rotation state shown in FIG. 22. Hence, there is no delay in operation, that is, no delay in feeding the fluid.

When the operation of the tube pump 1L is stopped, the rotor 5 can be stopped as it is returned to the state shown in FIG. 21 again by being rotated in the reverse direction, namely, in the counterclockwise direction of FIGS. 21 and 22, by an adequate angle up to 360°. By performing this operation, it is possible to prevent the tube 100 from having a flattening habit or being blocked due to adhesion of the inner wall not only in a period until the tube pump 1L is used first since the shipment from the factory, but also in an idle period between the use periods of the tube pump 1L.

When the rotor 5 rotates more than once in the reverse direction, the balls 14 and 15 revolve at the positional relation shown in FIG. 21. Hence, when the rotor 5 rotates in the reverse direction, there is a state that neither the ball 14 nor the ball 15 is pressurizing the arc portion 103 of the tube 100 while the rotor 5 rotates once, during which the fluid flown backward within the tube 100 returns. Hence, the fluid within the tube 100 does not flow backward practically. As has been described, in the present embodiment, there is another advantage that the fluid within the tube 100 does not flow backward practically even when the rotor 5 rotates in the reverse direction because of some trouble.

In the present embodiment, one oscillator 6 is provided; however, in the present invention, more than one oscillator 6 may be provided.

(Twelfth Embodiment)

Figure 23:
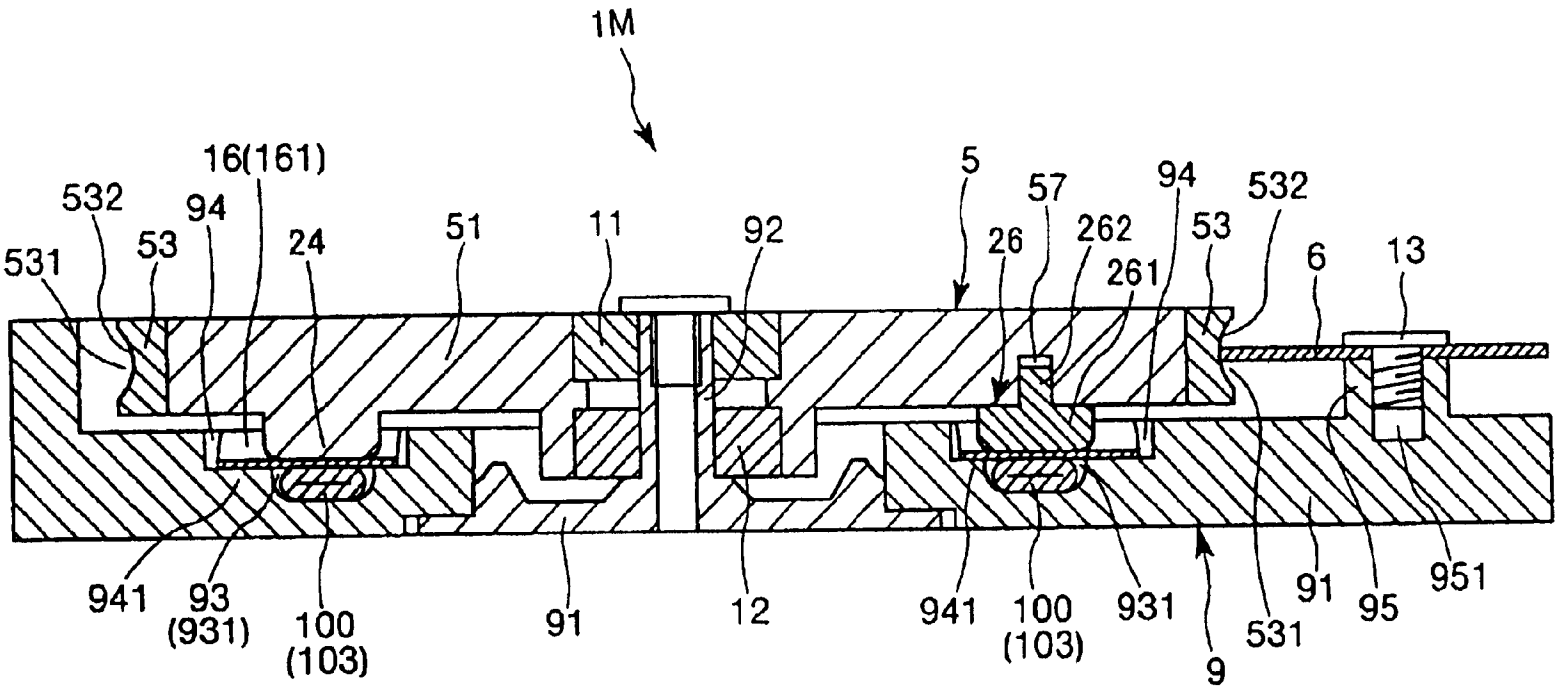
FIG. 23 is a cross-sectional side view showing a twelfth embodiment of the tube pump of the present invention.
Figure 24:
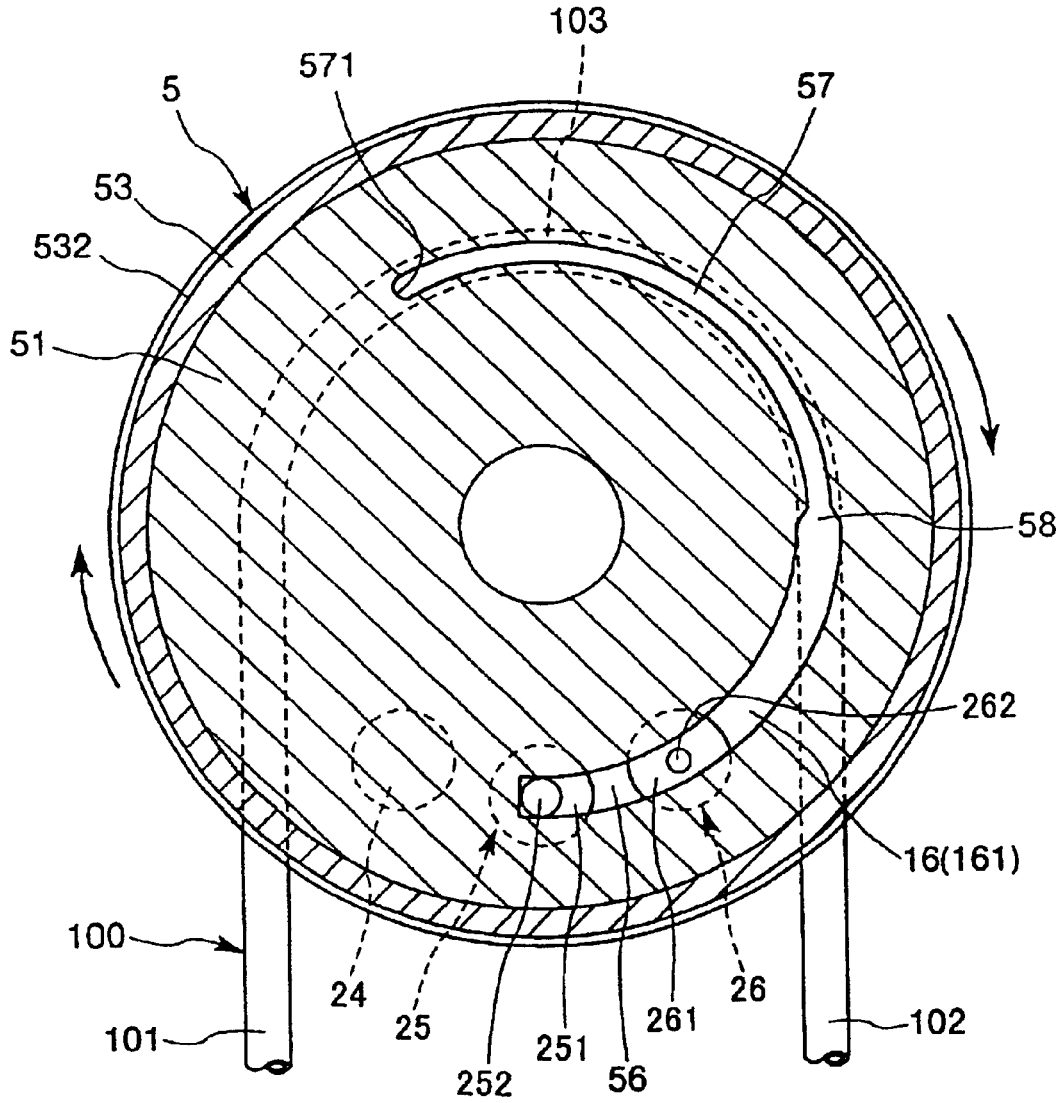
FIG. 24 is a cross-sectional plan view explaining a positional relation of pressurizing portions with respect to a rotor and a tube in the tube pump shown in FIG. 23.
Figure 25:
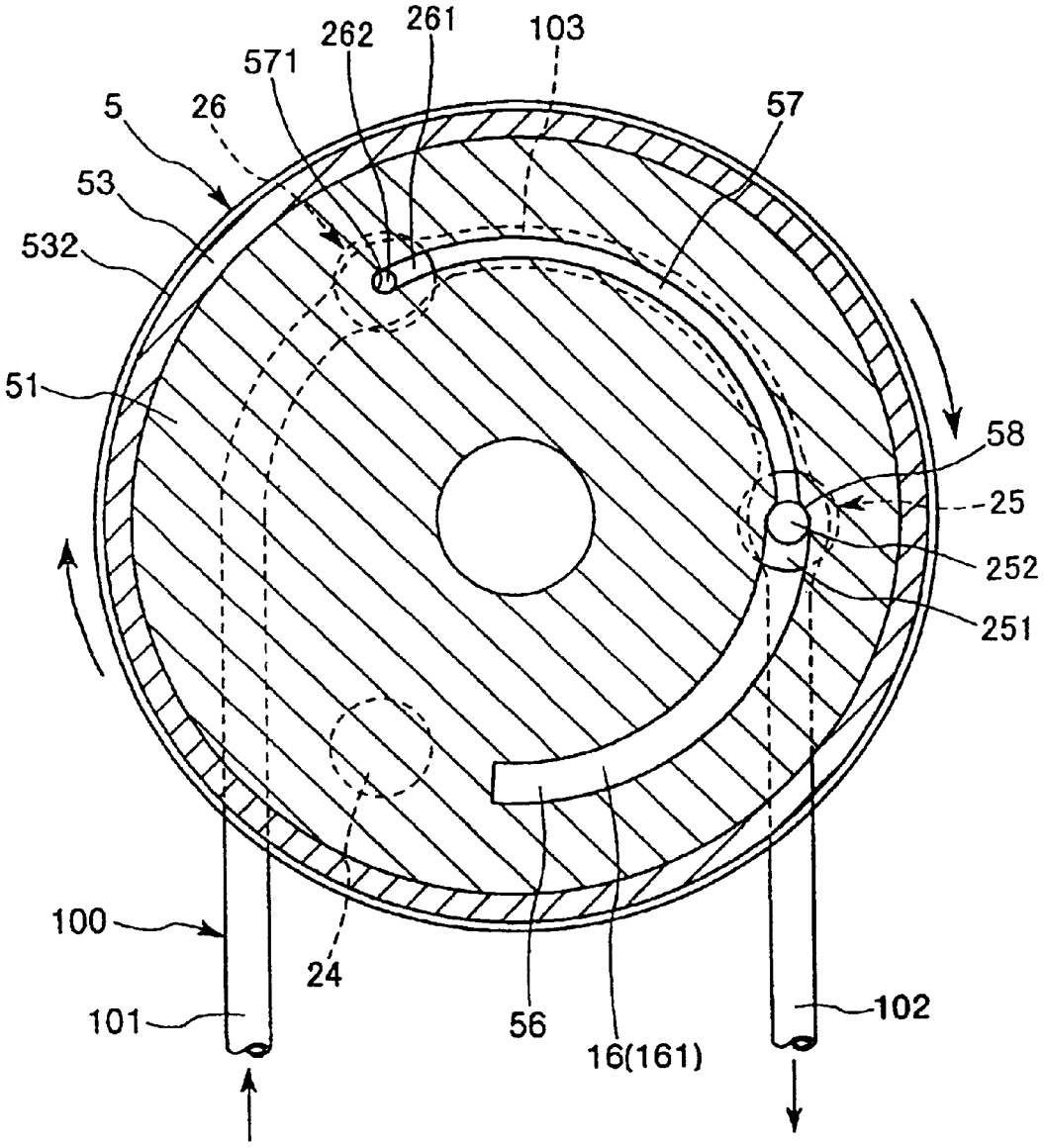
FIG. 25 is a cross-sectional plan view explaining a positional relation of the pressurizing portions with respect to the rotor and the tube in the tube pump shown in FIG. 23.

FIG. 23 is a cross-sectional side view showing a twelfth embodiment of the tube pump of the present invention. FIGS. 24 and 25 are cross-sectional plan views explaining a positional relation of pressurizing portions with respect to a rotor and a tube in the tube pump shown in FIG. 23. In the following description, the upper side and the lower side of FIG. 23 are assumed to be "top" and "bottom", respectively.

The following description will describe the twelfth embodiment of the tube pump of the present invention with reference to these drawings; however, the following description will chiefly describe a difference from the embodiments described above and the description as to the similar arrangements is omitted.

A tube pump 1M of the present embodiment is the same as the eleventh embodiment above except that the arrangement and the number of the pressurizing portions are different.

In the present embodiment, three pressurizing portions 24, 25, and 26 protruding from the bottom face of the rotor main body 51 are provided. These pressurizing portions 24, 25 and 26 are provided so that the distance from each to the rotor rotational axis 92 is substantially equal to the distance between the arc portion 103 of the tube 100 and the rotor rotational axis 92, and each pressurizes a segment of the arc portion 103 at a portion thereof to be sealed from the upper side through the thin plate 16. These pressurizing portions 24, 25, and 26 do not rotate on their respective axes and slide on the thin plate 16.

As shown in FIG. 23, the pressurizing portion 24 composed of a convex portion is provided immovably to the rotor main body 51. In other words, the pressurizing portion 24 is fixed to the rotor main body 51 and does not move with respect to the rotor 5. The pressurizing portion 24 is formed so as to protrude almost cylindrically or disc-wise from the bottom face of the rotor main body 51.

On the other hand, the pressurizing portions 25 and 26 are allowed to move with respect to the rotor 5. In other words, the rotor main body 51 is provided with pressurizing portion movement slots 56 and 57 at the bottom face thereof, and the pressurizing portions 25 and 26 move along the pressurizing portion movement slots 56 and 57.

The pressurizing portion 25 is composed of a pressurizing portion main body 251 and a cylindrical protrusion 252 protruding from the top face of the pressurizing portion main body 251. The pressurizing portion main body 251 is a portion protruding from the bottom face of the rotor main body 51 and formed essentially cylindrically or disc-wise. The protrusion 252 fits into the pressurizing portion movement slot 56.

Likewise, the pressurizing portion 26 is composed of a pressurizing portion main body 265 and a cylindrical protrusion 262 protruding from the top face of the pressurizing portion main body 265. The major diameter of the protrusion 262 is less than that of the protrusion 252, and the protrusion 262 fits into the pressurizing portion movement slot 56 or 57.

As shown in FIG. 24, the pressurizing portion movement slots 56 and 57 are formed arc-wise along the circumferential direction of the rotor 5.

The pressurizing portion movement slot 56 is provided in a little less than 60° range of the central angle from the vicinity of the pressurizing portion 24 in the reverse direction of the normal rotational direction of the rotor 5, that is, in a counterclockwise direction of FIG. 24. The width of the pressurizing portion movement slot 56 is substantially equal to or slightly larger than the major diameter of the protrusion 252.

The pressurizing portion movement slot 57 is formed consecutively from the end portion of the pressurizing portion movement slot 56 in the same direction, that is, in the counterclockwise direction of FIG. 24, and is provided in an approximately 60° range of the central angle. The width of the pressurizing portion movement slot 57 is substantially equal to or slightly larger than the major diameter of the protrusion 262. In short, the width of the pressurizing portion movement slot 57 is narrower than the width of the pressurizing portion movement slot 56.

According to these arrangements, the pressurizing portion 26 is allowed to move along the pressurizing portion movement slots 56 and 57 within the range of the pressurizing portion movement slots 56 and 57 as the protrusion 262 thereof moves within the pressurizing portion movement slots 56 and 57.

On the other hand, as to the pressurizing portion 25, because the protrusion 252 thereof has the major diameter larger than the width of the pressurizing portion movement slot 57, it can move only up to a boundary portion 58 between the pressurizing portion movement slot 56 and the pressurizing portion movement slot 57, and hence, is allowed to move within the range of the pressurizing portion movement slot 56.

While the tube pump 1M is not in use, by bringing the pressurizing portions 25 and 26 into a state that they are moved in close proximity to the pressurizing portion 24 as shown in FIG. 24, there can be obtained a state that none of the pressurizing portions 24, 25, and 26 is pressurizing the arc portion 103 of the tube 100. Consequently, as with the eleventh embodiment above, it is possible to prevent the tube 100 from having a flattening habit or being blocked due to adhesion of the inner wall while the tube pump is not in use.

When the rotor 5 starts to rotate in the state shown in FIG. 24, the pressurizing portion 24 starts to revolve about the rotor rotational axis 92. On the other hand, the pressurizing portions 25 and 26 remain at the same positions with respect to the main body 9 and move relatively with respect to the rotor 5 along the pressurizing portion movement slot 56.

When the rotor 5 rotates to a position where the wall face of the boundary portion 58 touches the pressurizing portion 25, the pressurizing portion 25 is pressed by the wall face of the boundary portion 58 and starts to revolve about the rotor rotational axis 92. The pressurizing portion 26 still remains at the same position and moves relatively with respect to the rotor 5 along the pressurizing portion movement slot 57.

When the rotor 5 rotates further to the position where a rear end face 571 of the pressurizing portion movement slot 57 touches the pressurizing portion 26, the pressurizing portion 26 is pressed by the rear end face 571 and starts to revolve about the rotor rotational axis 92. Consequently, as shown in FIG. 25, the pressurizing portions 24, 25, and 26 are in the state that they are placed along the circumferential direction of the rotor 5 at nearly equiangular intervals, that is, at intervals of 120°, namely, in the steady rotation state, and they squeeze the tube 100 as they revolve in this state.

In the present embodiment, three pressurizing portions 24, 25, and 26 are provided, and the tube 100 is pressurized at more points thereof to be sealed, which makes it possible to feed a fluid more smoothly, thereby making it possible to further reduce a change in pressure in the pump output.

Also, according to the arrangement shown in the drawing, the arc portion 103 of the tube 100 is formed in an approximately 180° range of the central angle. In the present embodiment, however, because the pressurizing portions 24, 25, and 26 are placed at intervals of approximately 120°, the range of the arc portion 103 of the tube 100 may be shortened to an approximately 120° range of the central angle. This heightens a degree of freedom as to where the tube 100 is placed.

In the present invention, four or more pressurizing portions may be provided. In this case, it is preferable that the pressurizing portions are placed along the circumferential direction of the rotor 5 at nearly equiangular intervals.

Also, in the present embodiment, by providing the thin plate 16, it is possible to prevent deterioration of or damages on the tube 100 even when the pressurizing portions are the ones that do not rotate on their axes like the pressurizing portions 24, 25, and 26.

Also, in the present embodiment, it is preferable to reduce friction between the thin plate 16 and the pressurizing portions 24, 25, and 26 by forming at least the surfaces of both or one of the thin plate 16 and the pressurizing portions 24, 25, and 26 from a material having a relatively small coefficient of friction. Examples of the low friction material include fluorine-based resin, such as polytetrafluoroethylene (Teflon).

Also, friction between the thin plate 16 and the pressurizing portions 24, 25, and 26 may be reduced by applying a lubricant. Examples of the lubricant include grease, silicon oil, etc.

In the present embodiment, one oscillator 6 is provided; however, in the present invention, more than one oscillator 6 may be provided.

(Thirteenth Embodiment)

Figure 26:
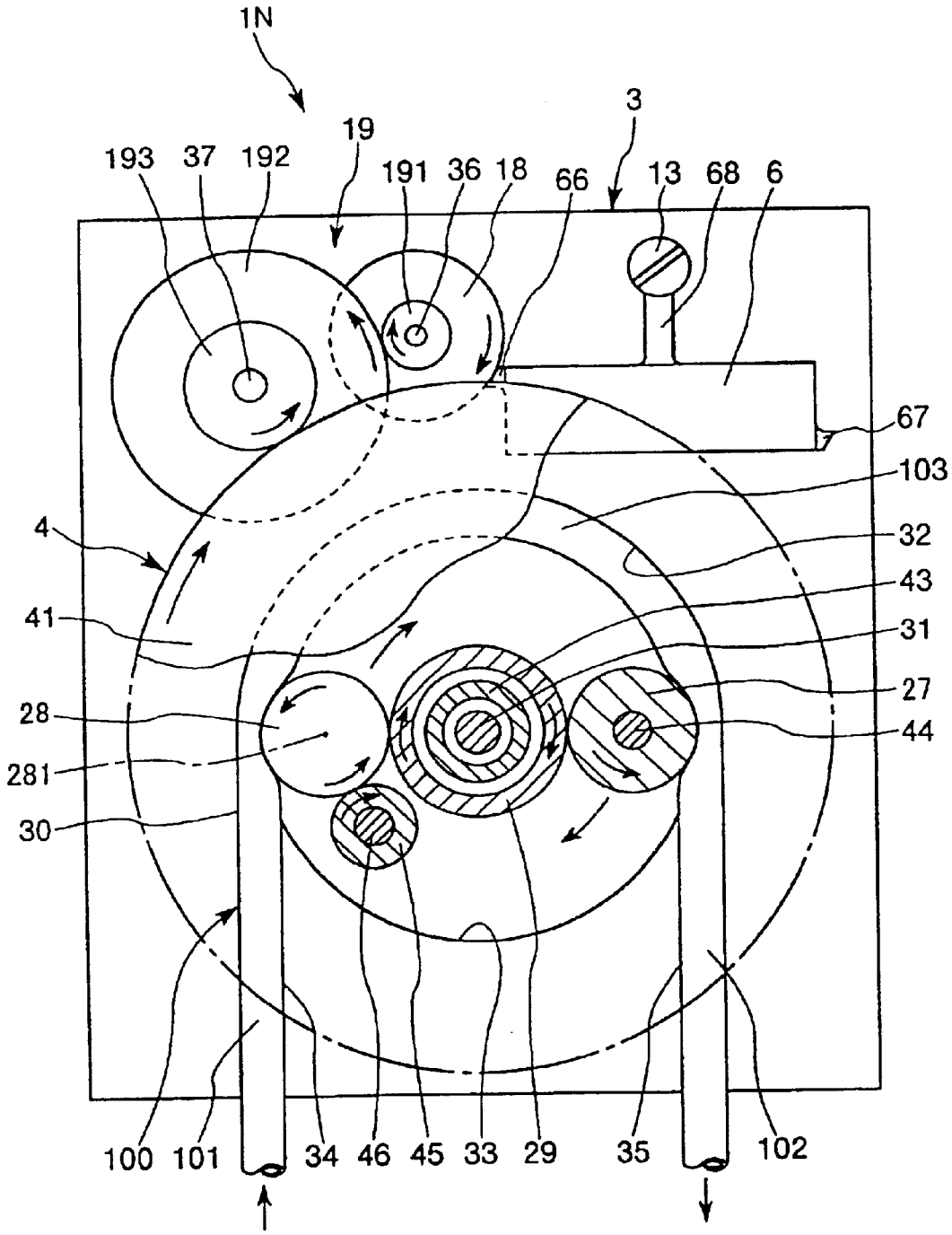
FIG. 26 is a partially cutaway plan view showing a thirteenth embodiment of the tube pump of the present invention.
Figure 27:
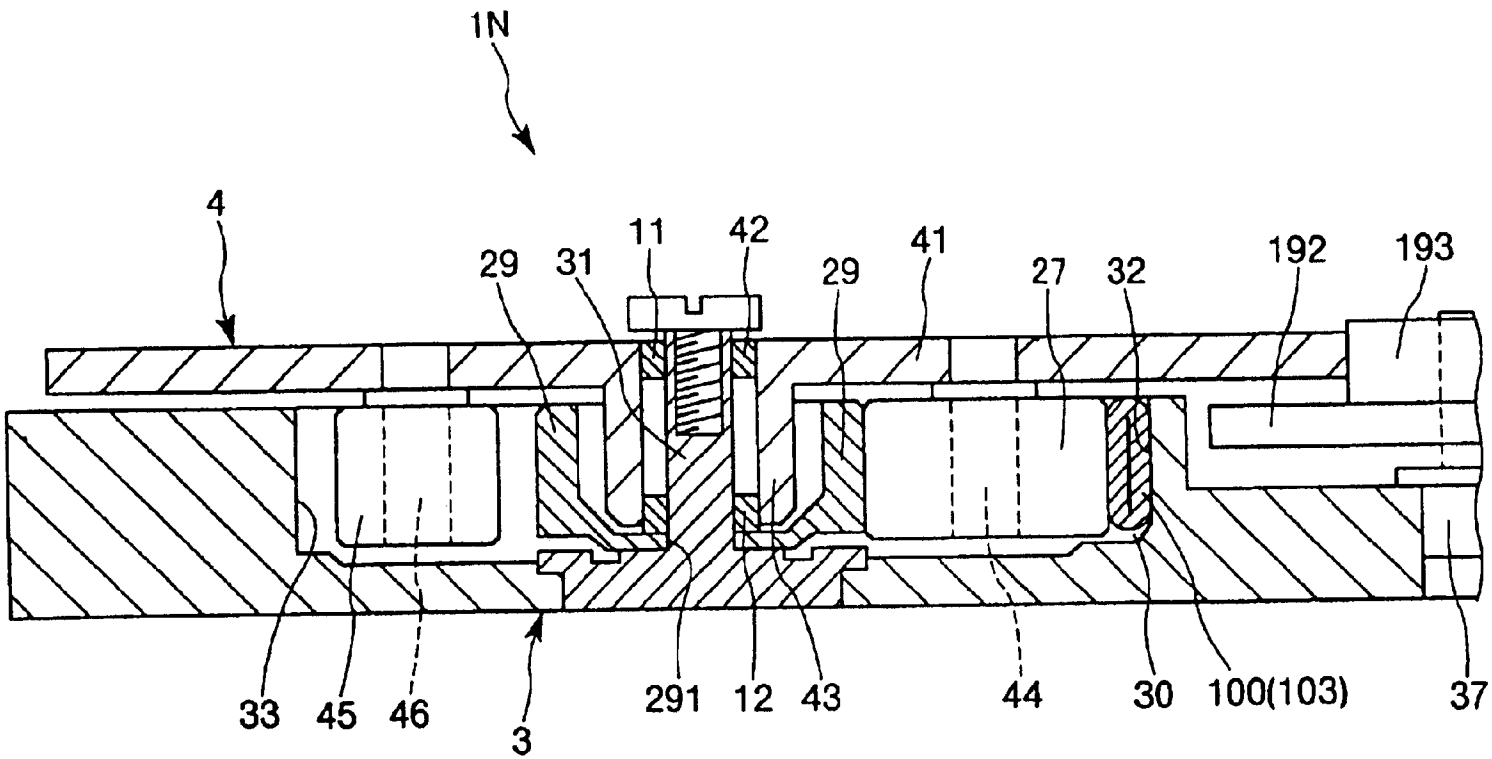
FIG. 27 is a cross-sectional side view showing the vicinity of a rotor in the tube pump shown in FIG. 26.
Figure 28:
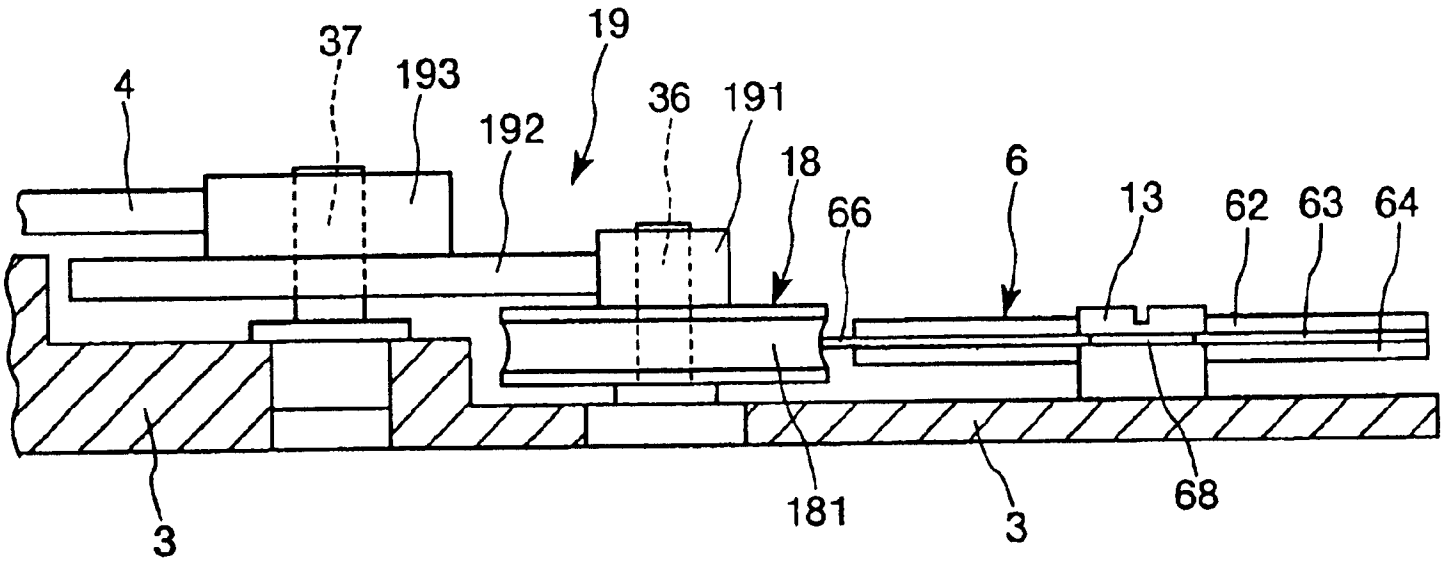
FIG. 28 is a cross-sectional development elevation showing a rotational force transmission mechanism in the tube pump shown in FIG. 26.
Figure 29:
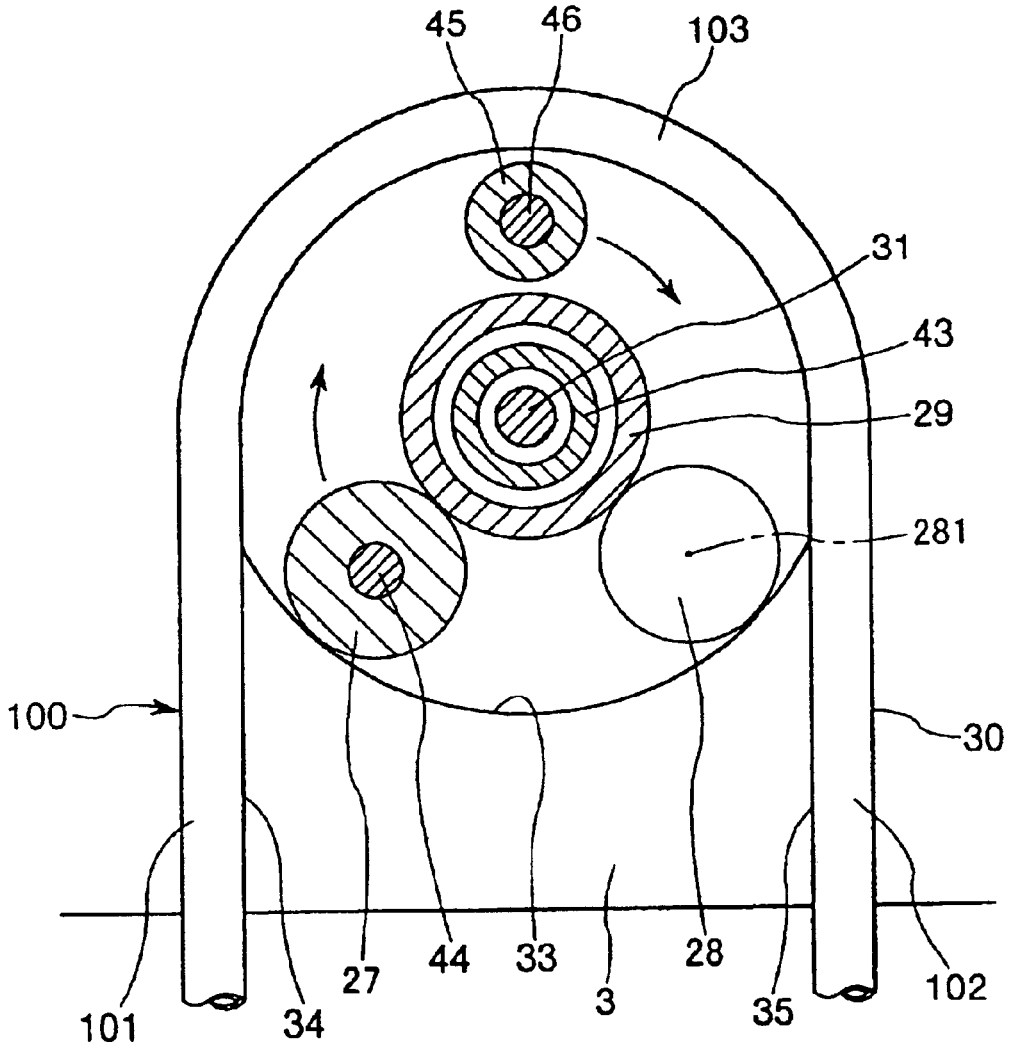
FIG. 29 is a cross-sectional plan view explaining a positional relation of rollers with respect to a rotor and a tube in the tube pump shown in FIG. 26.
Figure 30:
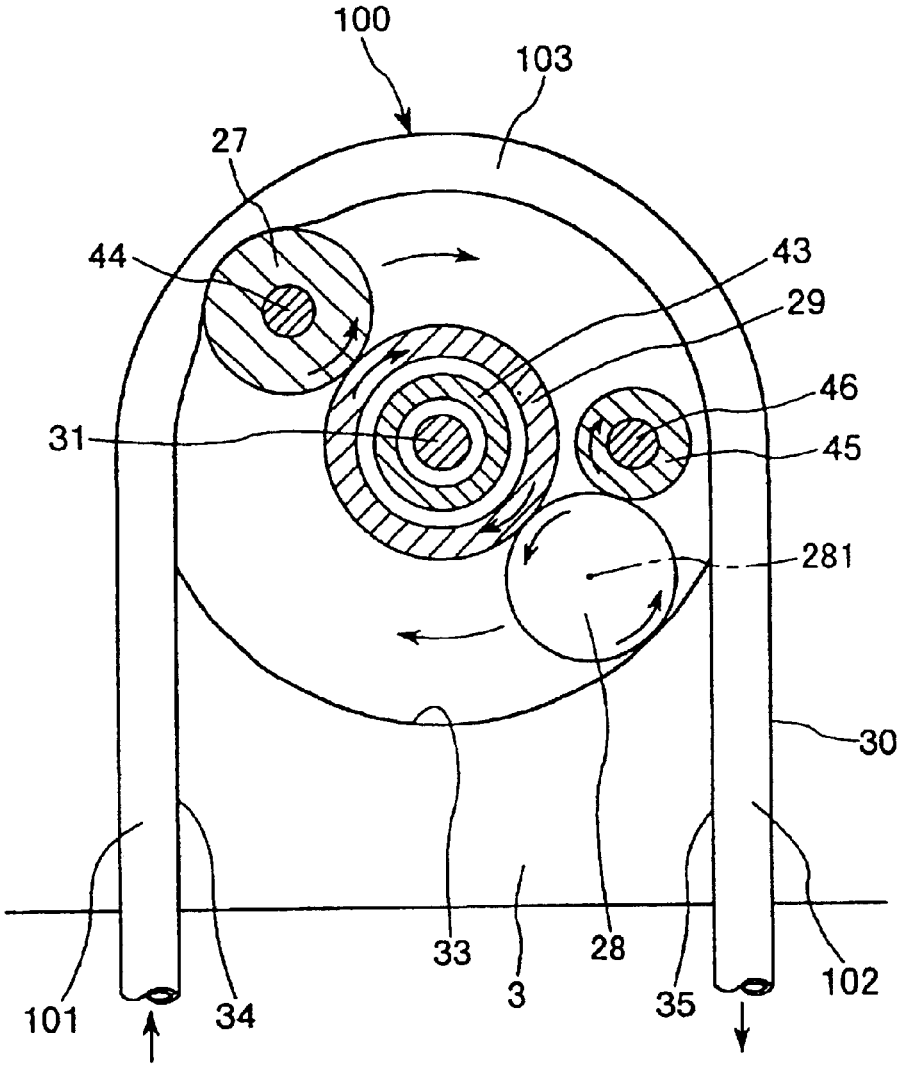
FIG. 30 is a cross-sectional plan view explaining a positional relation of the rollers with respect to the rotor and the tube in the tube pump shown in FIG. 26.

FIG. 26 is a partially cutaway plan view showing a thirteenth embodiment of the tube pump of the present invention. FIG. 27 is a cross-sectional side view showing the vicinity of a rotor in the tube pump shown in FIG. 26. FIG. 28 is a cross-sectional development elevation showing a rotational force transmission mechanism in the tube pump shown in FIG. 26. FIGS. 29 and 30 are cross-sectional plan views explaining a positional relation of rollers with respect to the rotor and a tube in the tube pump shown in FIG. 26. In the following description, the upper side and the lower side of FIGS. 27 and 28 are assumed to be "top" and "bottom", respectively.

The following description will describe the thirteenth embodiment of the tube pump of the present invention with reference to these drawings; however, the following description will chiefly describe a difference from the embodiments described above and the description as to the similar arrangements is omitted.

A tube pump 1N of the present embodiment is provided with a main body 3 having an attachment portion 30 to which an elastic tube 100 is attached, a gear rotor 4 serving as a rotor mounted rotatably with respect to the main body 3, rollers 27 and 28 serving as pressurizing portions, an oscillator 6 mounted to the main body 3, a driven member 18 driven by the oscillator 6, and a rotational force transmission mechanism 19.

As shown in FIGS. 26 and 27, the main body 3 as a whole is essentially shaped like a plate, and a rotor rotational axis 31 is installed so as to protrude upward from the central portion thereof.

Also, the main body 3 is provided with a wall portion having inner circumferential faces 32 and 33 formed arc-wise about the rotor rotational axis 31. The inner circumferential face 32 is formed along approximately halfway of the upper side of FIG. 26 and the inner circumferential face 33 is formed along approximately halfway of the lower side of FIG. 26.

Also, the main body 3 is provided with linear tube attachment slots 34 and 35.

The tube 100 is attached to the main body 3 arranged as above along the tube attachment slot 34, the inner circumferential face 32, and the tube attachment slot 35 essentially in the shape of a letter U. To be more specific, the tube 100 includes an arc portion 103 placed arc-wise along the inner circumferential face 32, an upstream portion 101 extending to the outside of the main body 3 from the left end portion of the arc portion 103 of FIG. 26 via the tube attachment slot 34, and a downstream portion 102 extending to the outside of the main body 3 from the right end portion of the arc portion 103 of FIG. 26 via the tube attachment slot 35.

As has been described, the attachment portion 30 for the tube 100 is composed of the vicinity of the inner circumferential face 32 and the tube attachment slots 34 and 35.

As shown in FIG. 27, the gear rotor 4 includes a rotor main body 41 essentially shaped like a circular plate, and a bearing placement portion 43 protruding cylindrically downward from the edge portion of a hole 42 made in the rotor main body 41 at the central portion thereof. Teeth of a gear are formed at the outer circumference of the rotor main body 41, and the gear rotor 4 serves also as a gear.

With the gear rotor 4 arranged as above, the rotor rotational axis 31 is inserted into the hole 42 on the inside of the bearing placement portion 43, so that the gear rotor 4 is mounted rotatably on the rotor rotational axis 31 of the main body 3 through bearings 11 and 12 both placed on the inside of the bearing placement portion 43. Although it will be described below, the oscillator 6 drives the gear rotor 4 to rotate in a clockwise direction of FIG. 26.

As shown in FIG. 27, a pressure-applying rotor 29 is further mounted rotatably on the rotor rotational axis 31. In short, the pressure-applying rotor 29 is provided coaxially with the gear rotor 4. The pressure-applying rotor 29 is essentially shaped like a bottomed-cylinder, and is mounted in a state that the rotor rotational axis 31 is inserted into a hole 291 made at the center of the bottom portion thereof.

As to the fabrication order, the pressure-applying rotor 29 is mounted on the rotor rotational axis 31 first, and the gear rotor 4 is mounted thereon, so that the bearing placement portion 43 is positioned on the inside of the pressure-applying rotor 29. The pressure-applying rotor 29 and the gear rotor 4 are allowed to rotate independently.

A roller rotational axis 44 is installed fixedly to the rotor main body 41 so as to protrude downward. In short, the roller rotational axis 44 is installed in parallel with the rotor rotational axis 31.

The roller 27 is mounted on the roller rotational axis 44 through an unillustrated bearing so that it is allowed to rotate on its axis. In short, the roller 27 does not move with respect to the gear rotor 4.

The other roller 28 is a mere cylindrical member, and is not supported by the gear rotor 4 with a rotational axis member like the roller rotational axis 44.

The rollers 27 and 28 are arranged so that they can be positioned at the inner circumference side of the arc portion 103 of the tube 100, and pressurize the arc portion 103 at a portion thereof to be sealed with the inner circumferential face 32. In other words, the rollers 27 and 28 pressurize the arc portion 103 at a portion thereof to be sealed from the inner circumference side in the radius direction of the gear rotor 4. According to these arrangements, in the present embodiment, the direction of a reactive force that the gear rotor 4 receives from the arc portion 103 of the tube 100 becomes nearly perpendicular to the rotor rotational axis 31, which prevents the gear rotor 4 from tilting, thereby allowing the gear rotor 4 to rotate more smoothly in a reliable manner.

The inner circumferential face 33 is formed to have a radius of curvature so that it can touch the rollers 27 and 28 or leaves a minimal clearance with the rollers 27 and 28.

The rotor main body 41 is provided with a pressing roller 45 serving as a pressing portion for pressing the roller 28 in the rotational direction of the gear rotor 4. The pressing roller 45 is mounted on a pressing roller rotational axis 46, which is installed fixedly so as to protrude downward from the rotor main body 41, through an unillustrated bearing so that it is allowed to rotate on its axis. The diameter of the pressing roller 45 is less than the diameters of the rollers 27 and 28, and the pressing roller 45 is arranged so as not to touch the arc portion 103 and the inner circumferential face 33.

The roller 28 is inserted at a position so that it can touch the pressing roller 45 in the reverse direction of the rotational direction of the gear rotor 4, that is, in a counterclockwise direction of FIG. 26.

According to these arrangements, the roller 28 is allowed to move with respect to the gear rotor 4 between the position where it touches the pressing roller 45 (the states shown in FIGS. 26 and 30), and the position where it touches the roller 27 (not shown). In the state that the roller 28 touches the pressing roller 45, the rollers 27 and 28 are placed along the circumferential direction of the gear rotor 4 at nearly equiangular intervals, that is, at intervals of 180°.

While the tube pump 1N is not in use, by bringing the rollers 27 and 28 in the state that the latter is moved in close proximity to the former as shown in FIG. 29, there can be obtained a state that neither the roller 27 nor the roller 28 is pressurizing the arc portion 103 of the tube 100. Consequently, as with the eleventh and twelfth embodiments above, it is possible to prevent the tube 100 from having a flattening habit or being blocked due to adhesion of the inner wall while the tube pump is not in use.

When the gear rotor 4 starts to rotate in the state shown in FIG. 29, the roller 27 starts to revolve about the rotor rotational axis 31. On the other hand, the roller 28 remains at the same position with respect to the main body 3, and moves relatively with respect to the gear rotor 4 in the circumferential direction.

When the state is changed as the gear rotor 4 rotates to the position where the pressing roller 45 touches the roller 28 (the state shown in FIG. 30), the roller 28 is pressed by the pressing roller 45 in the rotational direction of the gear rotor 4, and starts to revolve about the rotor rotational axis 31.

In the steady rotation state of the gear rotor 4 (the state after the state shown in FIG. 30), as shown in FIG. 26, the rollers 27 and 28 keep revolving while being placed along the circumferential direction of the gear rotor 4 at nearly equiangular intervals.

When the roller 28 pressurizes the arc portion 103 of the tube 100 at a portion thereof to be sealed, it receives a force directing toward the outer circumference side in the radius direction of the gear rotor 4 from the pressure-applying rotor 29 and pressurizes the tube 100 at a portion thereof to be sealed with that force.

Also, the roller 28 rotates about the rotational axis 281 as its axis while contacting the pressure-applying rotor 29 and the pressing roller 45. In other words, each of the rollers 27 and 28 and the pressure-applying rotor 29 rotates on their respective axes as indicated by arrows of FIG. 26, and operate as a planetary gear mechanism as a whole. Consequently, the tube pump 1N of the present embodiment can achieve an extremely smooth operation.

As has been described, in the present embodiment, by providing the pressure-applying rotor 29 and the pressing roller 45, it is no longer necessary to support the roller 28, which is movable with respect to the gear rotor 4, by a rotational axis member.

Different from the above arrangement, in the case of supporting the roller 28 by the rotational axis member, it is necessary to provide, for example, arm members at the top and bottom of the gear rotor 4 for supporting the rotational axis member at the top and bottom thereof and for allowing the roller 28 to move with respect to the gear rotor 4, which increases the dimension in the thickness direction, that is, in the vertical direction of FIG. 27. In contrast, the present embodiment does not cause such an inconvenience, and therefore, the tube pump 1N can prevent the tube 100 from having a flattening habit, and at the same time, is advantageous particularly in reducing the thickness.

Also, in the present embodiment, the driven member 18 driven by the oscillator 6 and the gear rotor 4 are provided separately, and the driven member 18 rotates the gear rotor 4 through the rotational force transmission mechanism 19. The rotational force transmission mechanism 19 is composed of a spur gear train substantially similar to the counterpart in the seventh embodiment.

As shown in FIGS. 26 and 28, the driven member 18 is mounted rotatably on a driven member rotational axis 36 provided to the main body 3 through an unillustrated bearing.

A gear wheel 192 and a pinion 193 are mounted rotatably on a gear rotational axis 37 provided to the main body 3 through unillustrated bearings, and rotate together. The pinion 193 is mounted so as to engage with the gear rotor 4.

In the present embodiment, one oscillator 6 is provided; however, in the present invention, more than one oscillator 6 may be provided.

(Fourteenth Embodiment)

Figure 31:
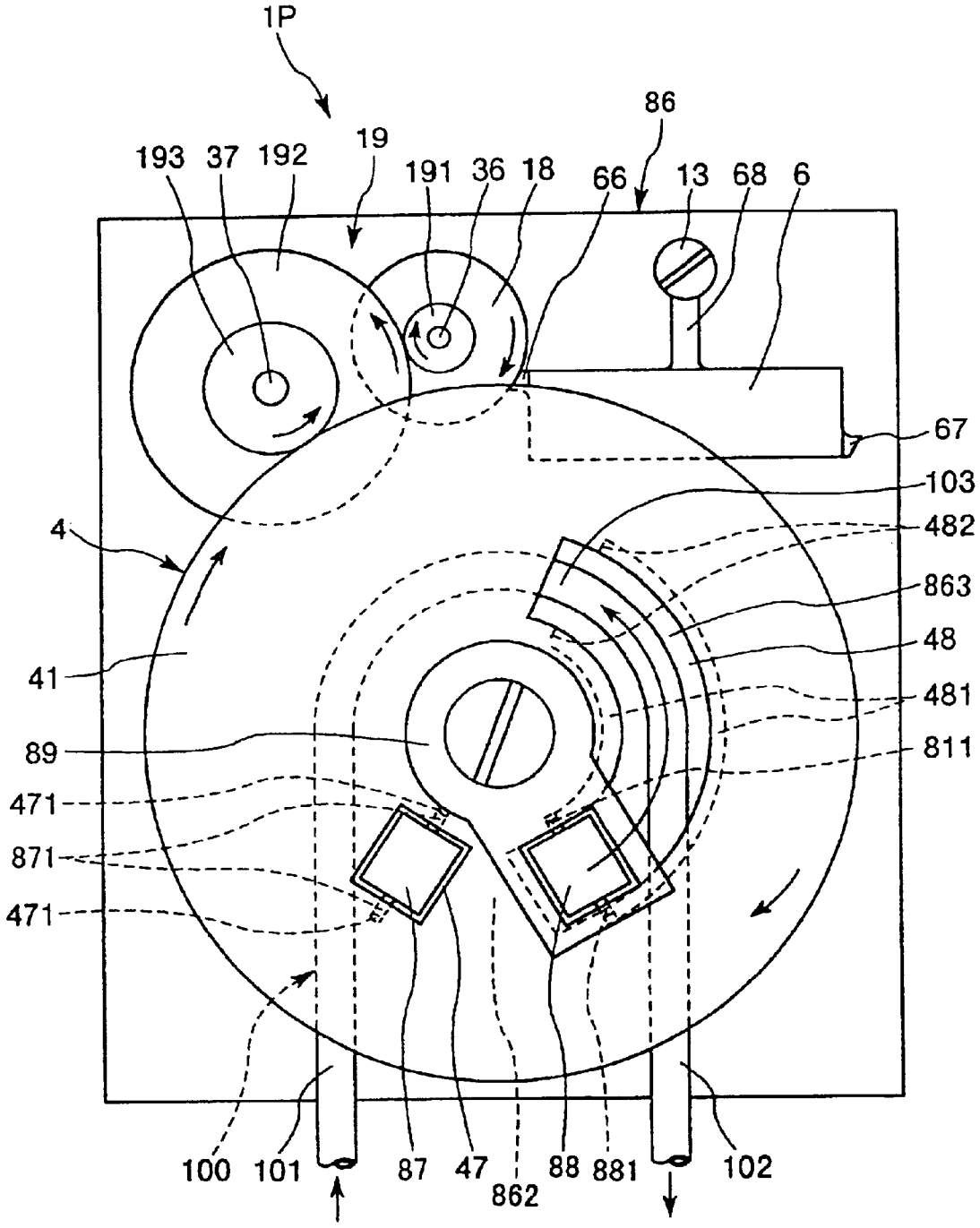
FIG. 31 is a plan view showing a fourteenth embodiment of the tube pump of the present invention.
Figure 32:
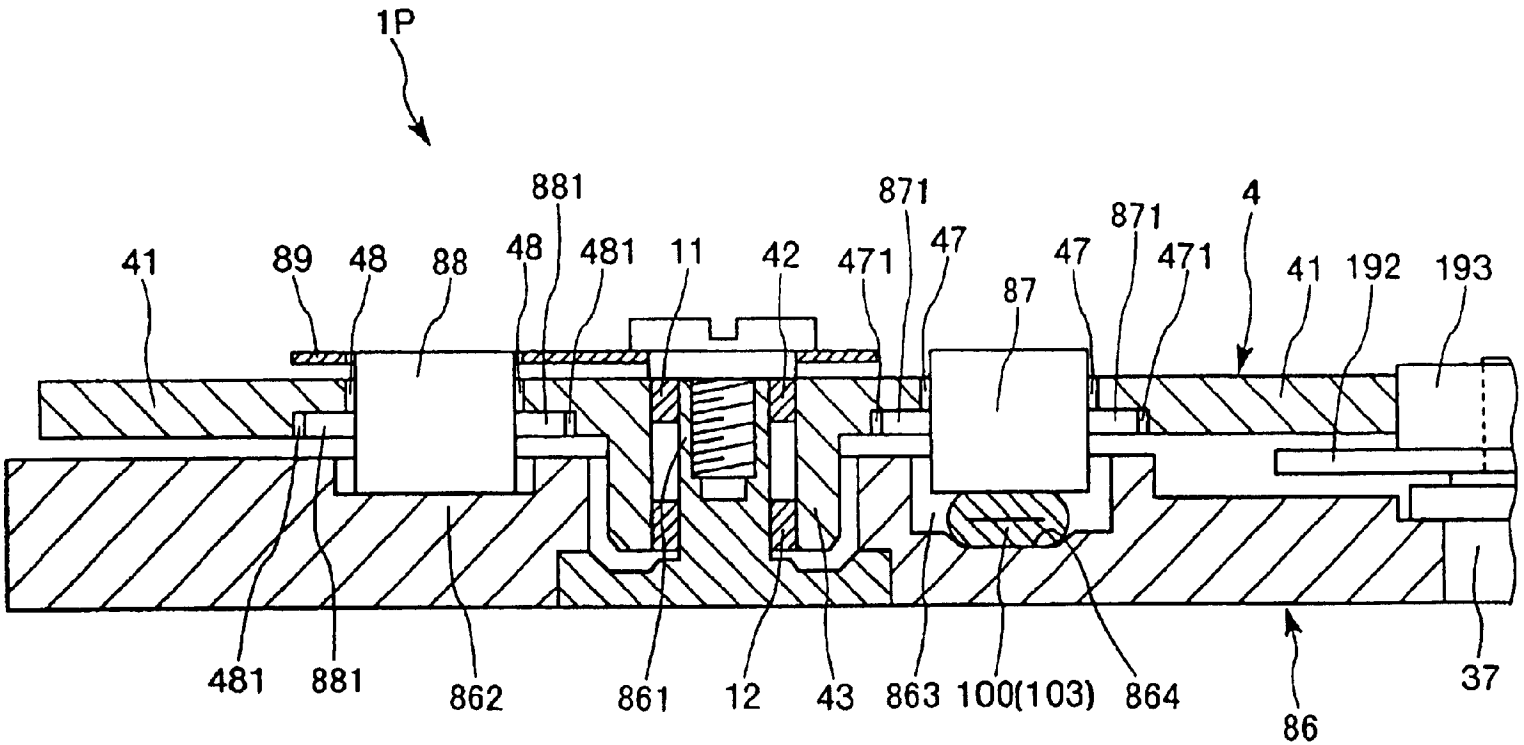
FIG. 32 is a cross-sectional side view showing the vicinity of a rotor in the tube pump shown in FIG. 31.
Figure 33:
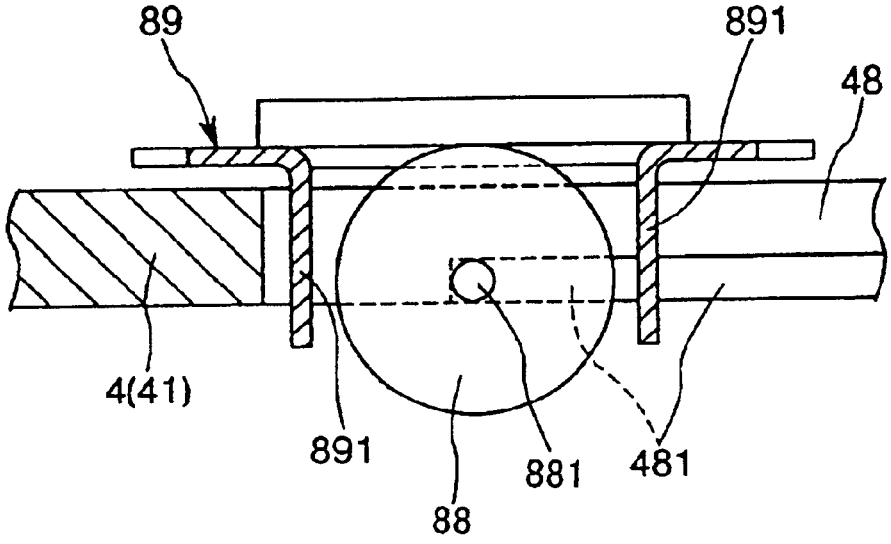
FIG. 33 is a cross section showing a mount portion for a movable roller in the tube pump shown in FIG. 31.

FIG. 31 is a plan view showing a fourteenth embodiment of the tube pump of the present invention. FIG. 32 is a cross-sectional side view showing the vicinity of a rotor in the tube pump shown in FIG. 31. FIG. 33 is a cross section showing a mount portion of a movable roller in the tube pump shown in FIG. 31. In the following description, the upper side and the lower side of FIG. 32 are assumed to be "top" and "bottom", respectively.

The following description will describe the fourteenth embodiment of the tube pump of the present invention with reference to these drawings; however, the following description will chiefly describe a difference from the embodiments described above and the description as to the similar arrangements is omitted.

A tube pump 1P of the present embodiment is provided with a main body 86 having a tube attachment slot 863 serving as an attachment portion to which an elastic tube 100 is attached, a gear rotor 4 serving as a rotor mounted rotatably with respect to the main body 86, rollers 87 and 88 serving as pressurizing portions provided to the gear rotor 4, an oscillator 6 mounted to the main body 86, a driven member 18 driven by the oscillator 6, and a rotational force transmission mechanism 19 for transmitting rotations of the driven member 18 to the gear rotor 4 with a reduced speed.

As shown in FIGS. 31 and 32, the main body 86 as a whole is essentially shaped like a plate, and a rotor rotational axis 861 is installed so as to protrude upward from the central portion thereof.

Also, the main body 86 is provided with, on the top face thereof, the tube attachment slot 863 essentially in the shape of a letter U when viewed in a plane shown in FIG. 31. The tube 100 is attached to the main body 86 along the tube attachment slot 863 essentially in the shape of a letter U.

The rotor main body 41 of the gear rotor 4 is provided with the rollers 87 and 88, each of which serves as the pressurizing portion and is allowed to rotate on its axis. The rollers 87 and 88 are respectively provided with rotational axes 871 and 881 protruding from their respective rollers, and these rotational axes 871 and 881 are installed so as to intersect with the rotor rotational axis 861 at nearly right angles. The rollers 87 and 88 pressurize the arc portion 103 of the tube 100 at a portion thereof to be sealed from the upper side with a bottom 864 of the tube attachment slot 863.

The roller 87 is mounted so as not to move with respect to the gear rotor 4. The roller 87 is mounted in a state that the upper side thereof is inserted into a hole made in the rotor main body 41 as a window 47.

The rotor main body 41 is provided with two rotational axis insert slots 471 in close proximity to the window 47 at the bottom face thereof, and the roller 87 is supported rotatably by the gear rotor 4 as both end portions of the rotational axis 871 are inserted into the two rotational axis insert slots 471, respectively.

The roller 88 is mounted movably with respect to the gear rotor 4. The roller 88 is mounted in a state that the upper side thereof is inserted into a hole made in the rotor main body 41 as a window 48. The rotor main body 41 is provided with two rotational axis insert slots 481 in close proximity to the window 48 at the bottom face thereof, and the roller 88 is supported rotatably by the gear rotor 4 as both end portions of the rotational axis 881 are inserted into the two rotational axis insert slots 481, respectively.

The window 48 and the rotational axis insert slots 481 are provided along the circumferential direction of the gear rotor 4 to form an elongate arc. The roller 88 is allowed to move along the circumferential direction of the gear rotor 4 within the window 48. According to these arrangements, the roller 88 is allowed to move between the position in close proximity to the roller 87 (the state shown in FIG. 31) and the position at the opposite side with respect to the roller 87 with the center of rotation of the gear rotor 4, that is, the rotor rotational axis 861, in between (not shown).

Because the tube 100 or a touching portion 862 described below constantly touches the lower sides of the rollers 87 and 88, the rotational axes 871 and 881 will never come off from the rotational axis insert slots 471 and 481, respectively.

The roller 88 is provided with a regulating member 89. As shown in FIG. 31, the regulating member 89 is mounted rotatably about the rotor rotational axis 861. Also, as shown in FIG. 33, the regulating member 89 includes two regulating plates 891 that can touch the roller 88 from both sides of the gear rotor 4 in the circumferential direction, respectively, and the roller 88 is inserted between the two regulating plates 891. Regulation by the regulating plates 891 allows the roller 88 to maintain the orientation such that the rotational axis 881 intersects with the rotor rotational axis 861 at nearly right angles.

When the roller 88 moves along the window 48, the regulating member 89 rotates with respect to the gear rotor 4 in association. As a result, the roller 88 moves with respect to the gear rotor 4 while maintaining the orientation such that the rotational axis 881 intersects with the rotor rotational axis 861 at nearly right angles.

With the tube pump 1P arranged as above, by brining the rollers 87 and 88 in a state that the latter is moved in close proximity to the former as shown in FIG. 31 while the tube pump is not in use, there can be obtained a state that neither the roller 87 nor the roller 88 is pressurizing the arc portion 103 of the tube 100. Consequently, as with the eleventh through thirteenth embodiments above, it is possible to prevent the tube 100 from having a flattening habit or being blocked due to adhesion of the inner wall while the tube pump is not in use.

When the gear rotor 4 starts to rotate in the state shown in FIG. 31, the roller 87 starts to revolve about the rotor rotational axis 861. On the other hand, the roller 88 remains at the same position with respect to the main body 86, and moves with respect to the gear rotor 4 in the circumferential direction along the window 48 as indicated by an arrow of FIG. 31.

When the gear rotor 4 rotates until rear end faces 482 of the rotational axis insert slots 481 touch the rotational axis 881, the rotational axis 881 is pressed by the rear end faces 482, which causes the roller 88 to start revolving.

Thereafter, the rollers 87 and 88 are brought into a state that they are placed along the circumferential direction of the gear rotor 4 at equiangular intervals, that is, at intervals of 180°, whereby at least one of the rollers 87 and 88 pressurizes the arc portion 103 of the tube 100 at a portion thereof to be sealed.

In the present embodiment, each of the rotational axes 871 and 881 of the rollers 87 and 88 is aligned substantially in parallel with the rotor main body 41 of the gear rotor 4, which is advantageous particularly in reducing the thickness of the entire tube pump 1P. Also, by mounting the rollers 87 and 88 so that they are inserted into the windows 47 and 48, respectively, there can be offered a further advantage in reducing the thickness.

Also, the main body 86 is provided with the touching portion 862 that touches the roller 87 or 88 (the roller 88 in FIG. 32) whichever is present at a position for not pressurizing the arc portion 103 of the tube 100. By providing the touching portion 862, there can be offered an advantage as follows.

The gear rotor 4 receives a force such that tilts the gear rotor 4 due to a reactive force from the arc portion 103 of the tube 100 that the roller 87 or 88 (the roller 87 in FIG. 32) pressurizes at a portion thereof to be sealed. In other words, in FIG. 32, this force acts on the gear rotor 4 such that the gear rotor 4 tilts downward to the left. At this point, in the present embodiment, the roller 87 or 88 touches the touching portion 862, which prevents the gear rotor 4 from tilting, thereby allowing the gear rotor 4 to rotate more smoothly in a reliable manner. Also, the roller 87 or 88, whichever is pressurizing the tube 100, will not be lifted up, thereby making it possible to pressurize the arc portion 103 of the tube 100 at a portion thereof to be sealed in a reliable manner. Also, a change in a reactive force associated with the pressurizing of the tube 100 is lessened, and therefore, a change in the rotational loading or a change in the rotational speed of the gear rotor 4 is reduced, which stabilizes a quantity of discharge.

In the present embodiment, one oscillator 6 is provided; however, in the present invention, more than one oscillator 6 may be provided.

The above description described the illustrated first through fourteenth embodiments of the tube pump of the present invention. It should be appreciated, however, that two or more characteristics of the first through fourteenth embodiments can be combined arbitrarily in the present invention.

Also, in the present invention, the minor diameter of the tube 100 can be anything from small to large. For example, a tube having the minor diameter of approximately 0.1 to 20 mm can be used, and the present invention is particularly suitable to a tube pump using a small-diameter tube having the minor diameter of approximately 0.2 to 2 mm.

Also, a quantity of discharge, that is, a flow rate, of the tube pump of the present invention is not especially limited, and it can be approximately 0.01 to 600 mL/min. However, the present invention is particularly suitable to a fluid feeding pump with a small quantity of discharge of approximately 30 mL/min. or less.

It is needless to say that the tube pump of the present invention may feed a fluid intermittently, that is, it may reduce a quantity of discharge to 0 temporarily. In this case, the value for the quantity of discharge specified above means a value while the fluid is being fed, that is, while the rotor is rotating.

Also, the present invention is not limited to the illustrated embodiments above, and each component forming the tube pump can be replaced with an arbitrary arrangement that can function equivalently.

For example, in the present invention, the shape and the arrangement of the oscillator are not limited to the arrangements shown in the drawings, and any oscillator capable of driving the driven member is available. For example, the oscillator may have one piezoelectric element, omit the reinforcing plate, or have a shape such that the width thereof decreases gradually toward the portion touching the driven member.

Also, the oscillator may be able to rotate the rotor in both the normal and reverse rotational directions, that is, to switch the fluid feeding directions, by changing the oscillation style thereof depending on how a current is passed through the same.

Also, in the present invention, as with the eleventh through fourteenth embodiments above, at least one of a plurality of the pressurizing portions may be allowed to move with respect to the rotor. Alternatively, in the present invention, all the plurality of pressurizing portions may be allowed to move with respect to the rotor. In these cases, means for regulating the movable range of the pressurizing portion(s) movable with respect to the rotor is not limited to a slot or a window formed in the rotor, and can be any means. For example, it may be arranged so as to regulate the movable range of the pressurizing portion(s) with a protrusion or a convex portion formed in the rotor.

As has been described, according to the present invention, by rotating the rotor with the oscillator, it is possible to reduce the size, particularly the thickness of the entire tube pump.

Also, the structure can be simpler, and therefore, it is possible to save the manufacturing costs.

Also, because no typical motor is used, electromagnetic noises are none at all or minimal, if any, so that it is possible to eliminate adverse effects on the peripheral equipment.

Also, it is possible to prevent unwanted backflow of a fluid within the tube.

Also, in a case where the driven member is formed integrally with or fixed to the rotor, not only can the size and the thickness be further reduced, but also the structure can be extremely simple.

Also, in a case where a plate member is provided in close proximity to the tube so that the tube is pressurized at a portion thereof to be sealed through the plate member, deterioration of or damages on the tube can be prevented, thereby making it possible to extend the lifespan thereof.

Also, in a case where at least one of a plurality of the pressurizing portions is allowed to move with respect to the rotor, it is possible to prevent the tube from having a flattening habit or being locked due to adhesion of the inner wall while the tube pump is not in use. Hence, it is possible to prevent adverse effects as follows: deterioration takes place at the segment having a flattening habit; a quantity of discharge from the tube pump becomes unstable; and a desired quantity of discharge cannot be obtained.

The entire disclosures of Japanese Application Nos. 2001-218794 filed Jul. 18, 2001, 2001-235396, filed Aug. 2, 2001 and 2001-262056 filed Aug. 30, 2001 are incorporated by reference.

What is claimed is:

1. A tube pump comprising:

a main body having an attachment portion to which an elastic tube is attached;

a rotor mounted rotatably with respect to the main body;

a plurality of pressurizing portions, operably associated with the rotor, adapted to pressurize a segment of the tube;

a driven member adapted to move in association with the rotor; and at least one oscillator located so as to touch the driven member along a radius direction of the rotor, the oscillator having a piezoelectric element, wherein the oscillator oscillates when an alternating current voltage is applied to the piezoelectric element and drives the driven member by repetitively applying a force to the driven member by means of oscillations, thereby rotating the rotor.

2. The tube pump according to claim 1, wherein the driven member is formed integrally with or fixed to the rotor.

3. The tube pump according to claim 1, wherein the oscillator is located so as to touch the driven member from an outer circumference side of the rotor.

4. The tube pump according to claim 1, wherein the oscillator is located so as to touch the driven member from an inner circumference side of the rotor.

5. The tube pump according to claim 1, wherein the driven member rotates the rotor through a rotational force transmission mechanism.

6. The tube pump according to claim 5, wherein the rotational force transmission mechanism is a speed changing unit.

7. The tube pump according to claim 1, wherein the oscillator is positioned, almost entirely, on an inside of an outermost radius of the rotor.

8. The tube pump according to claim 1, wherein the oscillator is positioned, almost entirely, within a space as thick as the rotor in a direction of a rotational axis of the rotor.

9. The tube pump according to claim 1, wherein the driven member is provided with a slot, and the oscillator touches an inner face of the slot.

10. The tube pump according to claim 1, wherein the oscillator is of a shape having a longer direction and a shorter direction.

11. The tube pump according to claim 10, wherein an end portion of the oscillator in a length direction touches the driven member.

12. The tube pump according to claim 1, wherein the oscillator is shaped like a plate.

13. The tube pump according to claim 12, wherein the oscillator is essentially shaped like a rectangle.

14. The tube pump according to claim 12, wherein the oscillator is located in an orientation substantially in parallel with the rotor.

15. The tube pump according to claim 1, further comprising an arm portion provided so as to protrude from the oscillator, wherein the oscillator is supported by the arm portion.

16. The tube pump according to claim 1, wherein more than one oscillator is provided.

17. The tube pump according to claim 1, wherein the pressurizing portions are provided immovably with respect to the rotor.

18. The tube pump according to claim 1, wherein the pressurizing portions are provided rotatably with respect to the rotor.

19. The tube pump according to claim 18, wherein the pressurizing portions are rollers supported rotatably about their respective rotational axes in a direction substantially along a rotational axis of the rotor.

20. The tube pump according to claim 18, wherein the pressurizing portions are rollers supported rotatably about their respective rotational axes in a direction intersecting with a rotational axis of the rotor at nearly right angles.

21. The tube pump according to claim 18, wherein the pressurizing portions are balls rotatable in an arbitrary direction.

22. The tube pump according to claim 1, wherein the pressurizing portions pressurize the tube at a portion thereof to be sealed along a radius direction of the rotor.

23. The tube pump according to claim 1, wherein the pressurizing portions pressurize the tube at a portion thereof to be sealed along a direction of a rotational axis of the rotor.

24. The tube pump according to claim 1, wherein an arc portion of the tube attached to the attachment portion is positioned on an inside of an outermost radius of the rotor.

25. The tube pump according to claim 24, wherein the main body includes a touching portion for touching any of the pressurizing portions present at a tube non-pressurizing position.

26. The tube pump according to claim 1, wherein the main body supports the rotor from one side of the rotor.

27. The tube pump according to claim 1, further comprising a flexible plate member provided in close proximity to the tube attached to the attachment portion, wherein the pressurizing portions pressurize the segment of the tube at a portion thereof to be sealed through the plate member.

28. The tube pump according to claim 27, wherein the plate member is provided essentially across the segment of the tube attached to the attachment portion pressurized at a portion thereof to be sealed by the pressurizing portions.

29. The tube pump according to claim 27,wherein the plate member is provided in a displaceable manner in a thickness direction thereof.

30. The tube pump according to claim 27, wherein the plate member is provided so as not to be displaced in an in-plane direction thereof.

31. The tube pump according to claim 27, wherein the plate member is provided in a detachable/attachable manner with respect to the main body.

32. The tube pump according to claim 27, further comprising displacement quantity regulating means for regulating the plate member so as not to be displaced over a certain limit.

33. The tube pump according to claim 1, wherein at least one of the plurality of pressurizing portions is allowed to move with respect to the rotor in a predetermined movable range.

34. A The tube pump according to claim 33, wherein the plurality of pressurizing portions are adapted to operate into a first state that none of the plurality of pressurizing portions is pressurizing the tube while the rotor is at rest, and when the rotor starts to rotate, the movable pressurizing portion moves relatively with respect to the rotor within the movable range, so that, in a steady rotation state of the rotor, the plurality of pressurizing portions are adapted to operate in a second state that the plurality of pressurizing portions are placed at positions where at least one of the plurality of pressurizing portions pressurizes the tube at portions thereof to be sealed regardless of a rotational position of the rotor.

35. The tube pump according to claim 33, wherein the movable pressurizing portion is adapted to move in a circumferential direction of the rotor within at least a part of the movable range.

36. The tube pump according to claim 33, wherein the plurality of pressurizing portions are placed along a circumferential direction of the rotor at nearly equiangular intervals in a steady rotation state of the rotor.

37. The tube pump according to claim 33, wherein the movable pressurizing portion is adapted to move along a slot or a window formed in the rotor.

38. The tube pump according to claim 33, wherein the pressurizing portions are convex portions protruding from the rotor.

39. The tube pump according to claim 33, wherein:

the pressurizing portions are rollers rotatable about their respective rotational axes in a direction intersecting with a rotational axis of the rotor at nearly right angles; and the movable roller is provided with a regulating member for regulating an orientation of the movable roller so that the rotational axis of the movable roller intersects with the rotational axis of the rotor at nearly right angles.

40. The tube pump according to claim 33, wherein:

the pressurizing portions are rollers rotatable about their respective rotational axes in a direction substantially along a rotational axis of the rotor;

the tube pump further comprises, a pressure-applying rotor mounted coaxially with the rotor, and a pressing portion, operably associated with the rotor, for pressing the movable roller in a rotational direction of the rotor; and the movable roller is not supported by the rotor, and in a steady rotation state of the rotor, the movable roller rotates while touching the pressure-applying rotor and the pressing portion.

* * * * *